US010265945B2

(12) United States Patent
Hirano

(10) Patent No.: US 10,265,945 B2
(45) **Date of Patent: *Apr. 23, 2019**

(54) INK SUPPLY METHOD AND INK SUPPLY DEVICE

(71) Applicant: Komori Corporation, Tokyo (JP)

(72) Inventor: Masahiro Hirano, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/037,935

(22) PCT Filed: Nov. 21, 2014

(86) PCT No.: PCT/JP2014/080882

§ 371 (c)(1),
(2) Date: May 19, 2016

(87) PCT Pub. No.: WO2015/076364

PCT Pub. Date: May 28, 2015

(65) Prior Publication Data

US 2016/0288487 A1 Oct. 6, 2016

(30) Foreign Application Priority Data

Nov. 22, 2013 (JP) ..... 2013-242299
Nov. 22, 2013 (JP) ..... 2013-242300

(51) Int. Cl.
*B41F 31/20* (2006.01)
*B41F 3/81* (2006.01)
(Continued)

(52) U.S. Cl.
CPC ..... *B41F 31/20* (2013.01); *B41F 3/56* (2013.01); *B41F 3/81* (2013.01); *B41F 31/045* (2013.01);
(Continued)

(58) Field of Classification Search
CPC ..... B41F 31/45; B41F 35/06; B41F 35/04; B41F 35/02; B41F 31/20; B41F 31/10;
(Continued)

(56) References Cited

U.S. PATENT DOCUMENTS 5,524,542 A * 6/1996 Toyama ..... B41F 33/0045 101/365
6,142,078 A * 11/2000 Lachajewski ..... B41F 33/0045 101/211
(Continued)

FOREIGN PATENT DOCUMENTS

JP S58-199155 A 11/1983
JP S58-201008 A 11/1983
(Continued)

OTHER PUBLICATIONS

WO 2015 076364 ISR English Translation.*
WO 2015 076364 Written Opinion English Translation.*
Machine Translation JP 05-008376.*

*Primary Examiner* — David H Banh
(74) *Attorney, Agent, or Firm* — Womble Bond Dickinson (US) LLP

(57) ABSTRACT

Correction values (Δθ1-Δθn) according to image area ratios in ranges of a printing plate of a preceding print job corresponding to ink fountain keys (4-1-4-n) are obtained. Opening amounts (θ1*b*-θnb) of the ink fountain keys (4-1-4-n) corresponding to the image of the printing plate (7') of a next print job are corrected by correction values (Δθ1-Δθn) to obtain corrected opening amounts (θ1*b*'-θnb'). In a state in which ink in an ink roller group (6) has been decreased by scraping and removing it by an ink scraper blade (15) and in a state in which the opening amounts of the ink fountain keys (4-1-4-n have been set to the corrected opening amounts (θ1*b*'-θnb'), an ink film thickness distribution corresponding (Continued)

to the image of the printing plate of the next print job is formed on the ink roller group (6).

15 Claims, 66 Drawing Sheets

(51) Int. Cl.

| | |
|---|---|
| ***B41F 3/56*** | (2006.01) |
| ***B41F 31/04*** | (2006.01) |
| ***B41F 31/12*** | (2006.01) |
| ***B41F 31/13*** | (2006.01) |
| ***B41F 31/14*** | (2006.01) |
| ***B41F 31/30*** | (2006.01) |
| ***B41F 33/00*** | (2006.01) |
| ***B41F 33/10*** | (2006.01) |

(52) U.S. Cl.
CPC ..... *B41F 31/12* (2013.01); *B41F 31/13* (2013.01); *B41F 31/14* (2013.01); *B41F 31/301* (2013.01); *B41F 33/0027* (2013.01); *B41F 33/0045* (2013.01); *B41F 33/10* (2013.01); *B41P 2231/12* (2013.01); *B41P 2233/11* (2013.01)

(58) Field of Classification Search
CPC .. B41F 31/13; B41F 33/0045; B41P 2231/12; B41P 2233/11
See application file for complete search history.

(56) References Cited

U.S. PATENT DOCUMENTS

| | | | | |
|---|---|---|---|---|
| 6,318,260 | B1 * | 11/2001 | Chu | B41F 31/00 101/365 |
| 9,662,874 | B2 * | 5/2017 | Hirano | B41F 31/20 |
| 2007/0216918 | A1 * | 9/2007 | Honeck | B41F 31/045 358/1.9 |
| 2013/0061768 | A1 * | 3/2013 | Hirano | B41F 31/045 101/364 |
| 2013/0061769 | A1 * | 3/2013 | Hirano | B41F 31/045 101/367 |
| 2014/0130689 | A1 * | 5/2014 | Hirano | B41F 31/027 101/363 |

FOREIGN PATENT DOCUMENTS

| | | | | | |
|---|---|---|---|---|---|
| JP | S58-201010 | A | | 11/1983 | |
| JP | H02-041248 | A | | 2/1990 | |
| JP | H03-097564 | A | | 4/1991 | |
| JP | H05-004329 | A | | 1/1993 | |
| JP | H05-008376 | A | | 1/1993 | |
| JP | H10-016193 | A | | 1/1998 | |
| JP | H11-188844 | A | | 7/1999 | |
| JP | H11-188849 | A | | 7/1999 | |
| JP | 2005-096085 | A | | 4/2005 | |
| JP | 2006-123185 | A | | 5/2006 | |
| JP | 2013-059878 | A | | 4/2013 | |
| JP | 2013-226715 | A | | 11/2013 | |
| JP | 2013226715 | A | * | 11/2013 | B41F 31/04 |

* cited by examiner

INK SUPPLY METHOD AND INK SUPPLY DEVICE

TECHNICAL FIELD

The present invention relates to an ink supply method and an ink supply device for supplying, via an ink roller group, ink supplied to an ink fountain roller to a printing plate mounted on a plate cylinder by the feed operation of an ink ductor roller.

BACKGROUND ART

FIG. 23 shows the main part of an inker (ink supply device) in a printing unit of each color of a web offset printing press. Referring to FIG. 23, reference numeral 1 denotes an ink fountain; 2, ink stored in the ink fountain 1; 3, an ink fountain roller; 4 (4-1 to 4-n), a plurality of ink fountain keys juxtaposed in the axial direction of the ink fountain roller 3; 5, an ink ductor roller; 6, an ink roller group; 7, a printing plate; 8, a plate cylinder on which the printing plate 7 is mounted; 9, a blanket cylinder; and 10, an impression cylinder.

This ink supply device supplies the ink 2 in the ink fountain 1 to the ink fountain roller 3 by adjusting the opening ratios of the ink fountain keys 4-1 to 4-n, and supplies, via the ink roller group 6, the ink supplied to the ink fountain roller 3 to the printing plate 7 by the feed operation of the ink ductor roller 5.

An image is printed on the printing plate 7. The ink supplied to the printing plate 7 is received by the blanket cylinder 9. The ink received by the blanket cylinder 9 is transferred to printing paper (target printing material) 11 conveyed between the blanket cylinder 9 and the impression cylinder 10.

Note that ink form rollers 6-1 to 6-4 in contact with the printing plate 7 are provided at the end of the ink flow path of the ink roller group 6. Together with the ink supplied via the ink form rollers 6-1 to 6-4, dampening water stored in a fountain pan 13 is supplied to the printing plate 7 via a dampening form roller 12.

In this ink supply device, when a print job is switched, that is, when the printing plate 7 of a preceding print job is exchanged with a printing plate 7' of the next print job, the opening ratios of the ink fountain keys 4-1 to 4-n and the rotation amount of the ink fountain roller 3 are changed to values corresponding to the image of the printing plate 7' of the next print job, and the ink 2 in the ink fountain 1 is supplied to the exchanged printing plate 7' via the ink roller group 6. In this case, test printing is performed before final printing, and the ink supply amount is adjusted, thereby obtaining a satisfactory color tone. A desired ink film thickness distribution (the gradient of an ink film thickness) is thus formed on the ink roller group 6, the plate cylinder 8, and the blanket cylinder 9.

However, in this ink supply device, when exchanging the printing plate 7 with the printing plate 7' and executing the next print job, the ink film thickness distribution for the printing plate 7 of the preceding print job still remains on the ink roller group 6. In this case, the ink film thickness distribution for the printing plate 7 of the preceding print job needs to be gradually changed to the ink film thickness distribution for the printing plate 7' of the next print job. Excessive ink supply amount adjustment and test printing are needed until a satisfactory color tone is obtained. This poses problems such as "an increase in the preparation time before printing", "an increase in working load", "a waste of printing materials", "a decrease in production efficiency", and "an increase in cost".

Hence, aiming at decreasing the numbers of times of ink supply amount adjustment and test printing until a satisfactory color tone is obtained, "ink film thickness control methods" described in patent literatures 1 and 2 have been proposed.

[Patent Literature 1 (Ink Decrease+Preinking 2)]

In the ink film thickness control method described in patent literature 1, when switching a print job, the feed operation of the ink ductor roller 5 is turned off. In a state in which the printing plate 7 of the preceding print job is kept mounted, the printing press is operated to print a predetermined number of sheets (blank sheet printing). The ink in the ink supply device is thus decreased (ink decrease), and a minimum ink film thickness distribution Ma (see FIG. 24A) that is needed during printing and becomes thinner from the upstream to the downstream, that is, the reference ink film thickness distribution Ma corresponding to a portion (a portion where the image area ratio is zero) of the printing plate 7 without any image is left on the ink roller group 6 (ink removing).

Next, the opening ratios of the ink fountain keys 4-1 to 4-n, the rotation amount of the ink fountain roller 3, and the like are set to values corresponding to the image of the printing plate 7' of the next print job. Then, in a state in which the ink form rollers 6-1 to 6-4 are thrown off, the printing press is operated to cause the ink ductor roller 5 to perform the feed operation a predetermined number of times, thereby superimposing an ink film thickness distribution Mb (see FIG. 24B) corresponding to the image of the printing plate 7' of the next print job on the reference ink film thickness distribution Ma remaining on the ink roller group 6 (preinking 2).

[Patent Literature 2 (Ink return+Preinking 1)]

In the ink film thickness control method described in patent literature 2, when switching a print job, the opening amounts of the ink fountain keys 4-1 to 4-n are set to zero. In this state, the ink ductor roller 5 is caused to perform the feed operation a predetermined number of times, thereby wholly returning the ink on the ink roller group 6 to the ink fountain 1 (ink return). A state in which each roller in the ink roller group 6 does not hold ink is thus attained.

Next, the opening ratios of the ink fountain keys 4-1 to 4-n are set to a predetermined opening ratio (for example, 50%). In addition, the rotation amount of the ink fountain roller 3 is set to a predetermined amount (for example, 50%). Then, the ink ductor roller 5 is caused to perform the feed operation a predetermined number of times, thereby forming the minimum ink film thickness distribution (reference ink film thickness distribution) Ma (see FIG. 24A) needed during printing on the ink roller group 6 (the first step of preinking 1).

The opening ratios of the ink fountain keys 4-1 to 4-n, the rotation amount of the ink fountain roller 3, and the like are set to values corresponding to the image of the printing plate 7' of the next print job. Then, in a state in which the ink form rollers 6-1 to 6-4 are thrown off, the printing press is operated to cause the ink ductor roller 5 to perform the feed operation a predetermined number of times, thereby superimposing the ink film thickness distribution Mb (see FIG. 24B) corresponding to the image of the printing plate 7' of the next print job on the reference ink film thickness distribution Ma formed on the ink roller group 6 (the second step of preinking 1).

FIG. 25 shows a printed product printed by the printing press including the ink supply device. A strip-shaped color bar 11-2 is printed in a margin portion except an image region 11-1 on the printed product (target printing material) 11. In general four-color printing, the color bar 11-2 is formed from density measurement patches (density measurement solid color patches of a percent dot area of 100%) 11*a*1, 11*a*2, 11*a*3, and 11*a*4 of cyan, magenta, yellow, and black. Regions S1 to Sn correspond to the key zones of the ink fountain keys 4-1 to 4-n in the printing units of the respective colors of the printing press.

[Color Matching]

A reference density is set in advance for the printing unit of each color. That is, a reference density value is set in advance for each of cyan, magenta, yellow, and black. When printing the printed product 11, the opening ratios of the ink fountain keys 4-1 to 4-n in the printing unit of each color are adjusted so as to make the density value of each color match the reference density value. The adjustment of the opening ratios of the ink fountain keys 4-1 to 4-n in the printing unit of each color is performed by an ink supply amount adjustment device (not shown) based on the densities of the density measurement patches 11*a* (11*a*1, 11*a*2, 11*a*3, and 11*a*4) of the respective colors printed on the printed product 11.

For example, the region S1 in the printed product 11 will representatively be described. The density values of the density measurement patches 11*a* of the respective colors on the printed product 11 obtained by test printing or final printing are measured. The density difference between the measured density value of each color and the preset reference density value of the color is obtained. The adjustment value of the opening amount of the ink fountain key 4-1 (the adjustment value of the ink supply amount to the region S1) in the printing unit of each color is obtained from the density difference of the color. The obtained adjustment value (reference adjustment value) is multiplied by a unique coefficient (control ratio) to obtain a correction value. The opening amount of the ink fountain key 4-1 in the printing unit of each color is adjusted using the correction value as a feedback amount.

For the regions S2 to Sn as well, the adjustment values of the opening amounts of the ink fountain keys 4-2 to 4-n (the adjustment values of the ink supply amounts to the regions S2 to Sn) in the printing unit of each color are obtained in a similar manner. The obtained adjustment values (reference adjustment values) are multiplied by a unique coefficient (control ratio) to obtain correction values. The opening amounts of the ink fountain keys 4-2 to 4-n in the printing unit of each color are adjusted using the correction values as feedback amounts.

However, in the ink film thickness control method described in patent literature 1 (ink decrease+preinking 2), since blank sheet printing is performed when leaving the ink film thickness distribution Ma on the ink roller group 6, paper is wasted.

In the ink film thickness control method described in patent literature 2 (ink return+preinking 1), since the ink on the ink roller group 6 is wholly returned to the ink fountain 1, and a corrected ink film thickness distribution (Ma+Mb) is formed from zero, a long time is needed. Additionally, in this method, since emulsified ink (ink blended with dampening water) is returned to the ink fountain 1, a printing failure occurs, and printing materials are wasted.

The present applicant considers an ink supply method that enables to divide the ink roller group 6 in the ink supply device into the upstream side and the downstream side, provides an ink scraper blade configured to remove ink remaining on the roller group on the upstream side and removes the ink remaining on the roller group on the upstream side in a state in which the ink roller group 6 is separated into the upstream side and the downstream side to decrease the ink, connects the roller group on the upstream side and the roller group on the downstream side after that, sets the opening amounts of the ink fountain keys to opening amounts corresponding to the image of the printing plate 7' of the next print job, and performs the feed operation of the ink ductor roller 5 a predetermined number of times in that state to superimpose an ink film thickness distribution corresponding to the image of the printing plate 7' of the next print job, thereby enabling to immediately print a normal printed product.

In this ink supply method, however, even if the ink remaining on the roller group on the upstream side is scraped by the ink scraper blade, the difference in the ink film thickness caused by the difference in the image area ratio in the area corresponding to the ink fountain keys cannot completely be eliminated. The adverse effect remains in the ink film thickness distribution corresponding to the image of the next print job, and a normal printed product cannot be printed immediately. Hence, the printing materials are wasted.

This problem, that is, the problem that even if the ink remaining on the roller group on the upstream side is scraped by the ink scraper blade, the difference in the ink film thickness caused by the difference in the image area ratio in areas corresponding to the ink fountain keys cannot completely be eliminated will be described with reference to FIGS. 26, 27A, and 27B.

FIG. 26 is a view showing the images of printing plates of a preceding print job (job A) and a current print job (job B) and ink film thicknesses (printed states) in the ink supply device corresponding to the images. The view on the upper side of FIG. 26 shows the images of the printing plates of the jobs A and B, and the view on the lower side shows the ink film thicknesses in the ink supply device corresponding to the images of the printing plates of the jobs A and B.

In the job A, the image area ratio in the area corresponding to the ink fountain keys increases (the ink film thickness increases) from left to right. In the job B, the image area ratio in the area corresponding to the ink fountain keys increases (the ink film thickness increases) from right to left, contrary to the job A. Note that t1 is the reference ink film thickness, t2 is the image film thickness, and W is the width of the printing plate. Each of the reference ink film thickness t1 and the image film thickness t2 indicates the average value of ink film thicknesses that decrease from the upstream side to the downstream side on the ink roller group 6.

FIG. 27A shows an ink film thickness after ink is decreased by the method (blank sheet printing) described in patent literature 1 (a film thickness after removing) when switching the print job from the job A to the job B. In this case, since the ink is decreased by blank sheet printing, the image film thickness t2 of the printing plate of the job A is removed, and only the reference ink film thickness t1 is left. Hence, when the opening amounts of the ink fountain keys are set to opening amounts corresponding to the image of the printing plate of the job B, the image film thickness t2 of the job B is superimposed on the reference ink film thickness t1.

FIG. 27B shows an ink film thickness after ink is scraped by the ink scraper blade (a film thickness after removing) when switching the print job from the job A to the job B. In this case, since the ink scraper blade 15 scrapes the ink evenly in the roller width direction, the influence of the unevenness of the ink film thickness caused by the difference in the image area ratio in the area corresponding to the ink fountain keys cannot be eliminated. In addition, the ink is removed while cutting into the reference ink film thickness t1. For this reason, even when the opening amounts of the ink fountain keys are set to opening amounts corresponding to the image of the printing plate of the job B, an ink film thickness including the image film thickness t2 of the job B superimposed on the reference ink film thickness t1 cannot be obtained.

RELATED ART LITERATURE

Patent Literature

Patent Literature 1: Japanese Patent Laid-Open No. 10-16193

Patent Literature 2: Japanese Patent Laid-Open No. 11-188844

Patent Literature 3: Japanese Patent Laid-Open No. 11-188849

Patent Literature 4: Japanese Patent Laid-Open No. 3-97564

Patent Literature 5: Japanese Patent Laid-Open No. 58-201008

Patent Literature 6: Japanese Patent Laid-Open No. 58-201010

DISCLOSURE OF INVENTION

Problem to be Solved by the Invention

The present invention has been made to solve the above-described problem, and has as its object to provide an ink supply method and ink supply device capable of, when forming an ink film thickness distribution corresponding to the image of a printing plate to be used to print a next print job (the image of the printing plate of the next print job), correcting an ink film thickness distribution formed on an ink roller group in a short time without performing blank sheet printing or ink return and also without being affected by the image of the printing plate of a preceding print job.

Means of Solution to the Problem

In order to achieve the object, according to the present invention, there is provided an ink supply method comprising the steps of decreasing ink in an ink roller group by scraping and removing the ink by an ink scraping member after an end of a print job, calculating the opening amount of the ink fountain key corresponding to an image of a printing plate of a next print job, obtaining, as a correction value of the opening amount of the ink fountain key, a correction value according to an index value representing an ink supply amount corresponding to an image in an area of a printing plate of a preceding print job corresponding to the ink fountain key, correcting the calculated opening amount of the ink fountain key corresponding to the image of the printing plate of the next print job by the obtained correction value of the opening amount of the ink fountain key, setting the opening amount of the ink fountain key to the corrected opening amount, and forming, on the ink roller group, an ink film thickness distribution corresponding to the image of the printing plate of the next print job by performing the feed operation of the ink ductor roller a predetermined number of times in a state in which the ink in the ink roller group is decreased and in a state in which the opening amount of the ink fountain key is set to the corrected opening amount.

In the present invention, after the end of a print job, the ink in the ink roller group is decreased by scraping and removing it by the ink scraping member. A correction value according to an index value representing an ink supply amount corresponding to the image in an area of the printing plate of a preceding print job corresponding to the ink fountain key is obtained as the correction value of the opening amount of the ink fountain key. The opening amount of the ink fountain key corresponding to the image of the printing plate of the next print job is corrected by the correction value of the opening amount of the ink fountain key. An ink film thickness distribution corresponding to the image of the printing plate of the next print job is formed on the ink roller group in a state in which the ink in the ink roller group is decreased and in a state in which the opening amount of the ink fountain key has been set to the corrected opening amount. This makes it possible to directly start printing of the next print job without performing blank sheet printing or ink return and also without being affected by the image of the printing plate of the preceding print job.

Effect of the Invention

According to the present invention, after the end of a print job, the ink in the ink roller group is decreased by scraping and removing it by the ink scraping member. A correction value according to an index value representing an ink supply amount corresponding to the image in an area of the printing plate of a preceding print job corresponding to the ink fountain key is obtained as the correction value of the opening amount of the ink fountain key. The opening amount of the ink fountain key corresponding to the image of the printing plate of the next print job is corrected by the correction value of the opening amount of the ink fountain key. An ink film thickness distribution corresponding to the image of the printing plate of the next print job is formed on the ink roller group in a state in which the ink in the ink roller group is decreased and in a state in which the opening amount of the ink fountain key has been set to the corrected opening amount. Hence, when switching the print job, it is possible to correct the ink film thickness distribution formed on the ink roller group in a short time without performing blank sheet printing or ink return and also without being affected by the image of the printing plate of a preceding print job.

BEST MODE FOR CARRYING OUT THE INVENTION

An embodiment of the present invention will now be described in detail with reference to the accompanying drawings.

[First Embodiment: Example in Which Image Area Ratio of Printing Plate of Preceding Print Job is used as Index Value Representing Ink Supply Amount Corresponding to Image in Range of Printing Plate of Preceding Print Job Corresponding to Ink Fountain Key]

Figure 1:
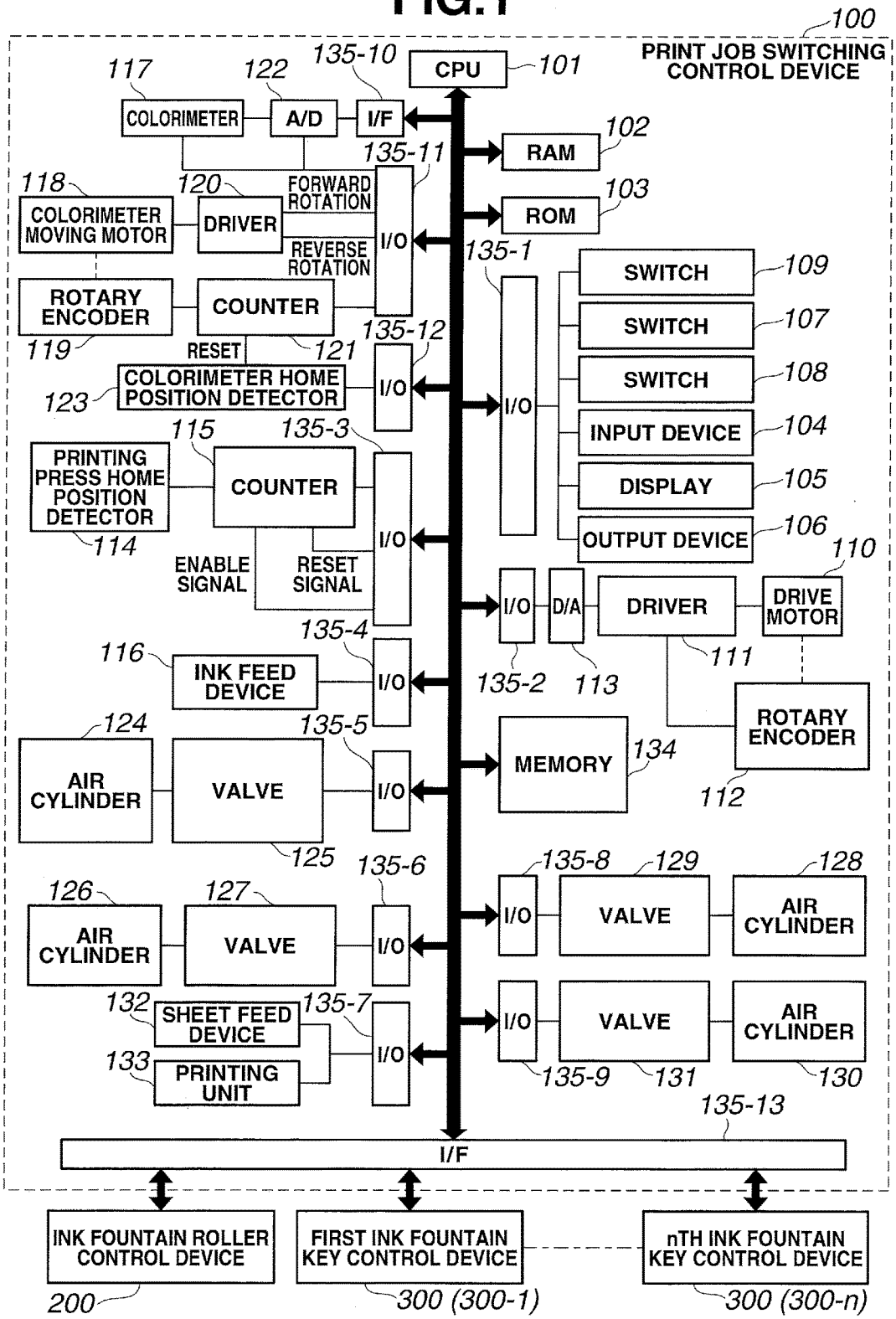
FIG. 1 is a block diagram showing an embodiment (first embodiment) of a print job switching control device used to execute an ink supply method according to the present invention.

FIG. 1 is a block diagram showing an embodiment (first embodiment) of a print job switching control device used to execute an ink supply method according to the present invention.

A print job switching control device 100 includes a CPU (Central Processing Unit) 101, a RAM (Random Access Memory) 102, a ROM (Read Only Memory) 103, an input device 104, a display 105, an output device (printer or the like) 106, a printing stop switch 107, a print job switching start switch 108, a density measurement switch 109, a printing press drive motor 110, a drive motor driver 111, a rotary encoder 112 for drive motor, a D/A converter 113, a printing press home position detector 114, a printing press rotation counter 115, and an ink feed device 116.

The print job switching control device 100 also includes a colorimeter 117, a colorimeter moving motor 118, a rotary encoder 119 for colorimeter moving motor, a colorimeter moving motor driver 120, a current colorimeter position detection counter 121, an A/D converter 122, a colorimeter home position detector 123, a roller group dividing/connecting air cylinder 124, a valve 125 for roller group dividing/connecting air cylinder, a dampening form roller on/off air cylinder 126, a valve 127 for damping form roller on/off air cylinder, an ink form roller on/off air cylinder 128, a valve 129 for ink form roller on/off air cylinder, an ink scraper blade on/off air cylinder 130, a valve 131 for ink scraper blade on/off air cylinder, a sheet feed device 132, a printing unit 133, a memory 134, and input/output interfaces (I/Os and an I/Fs) 135-1 to 135-13.

Figure 2:
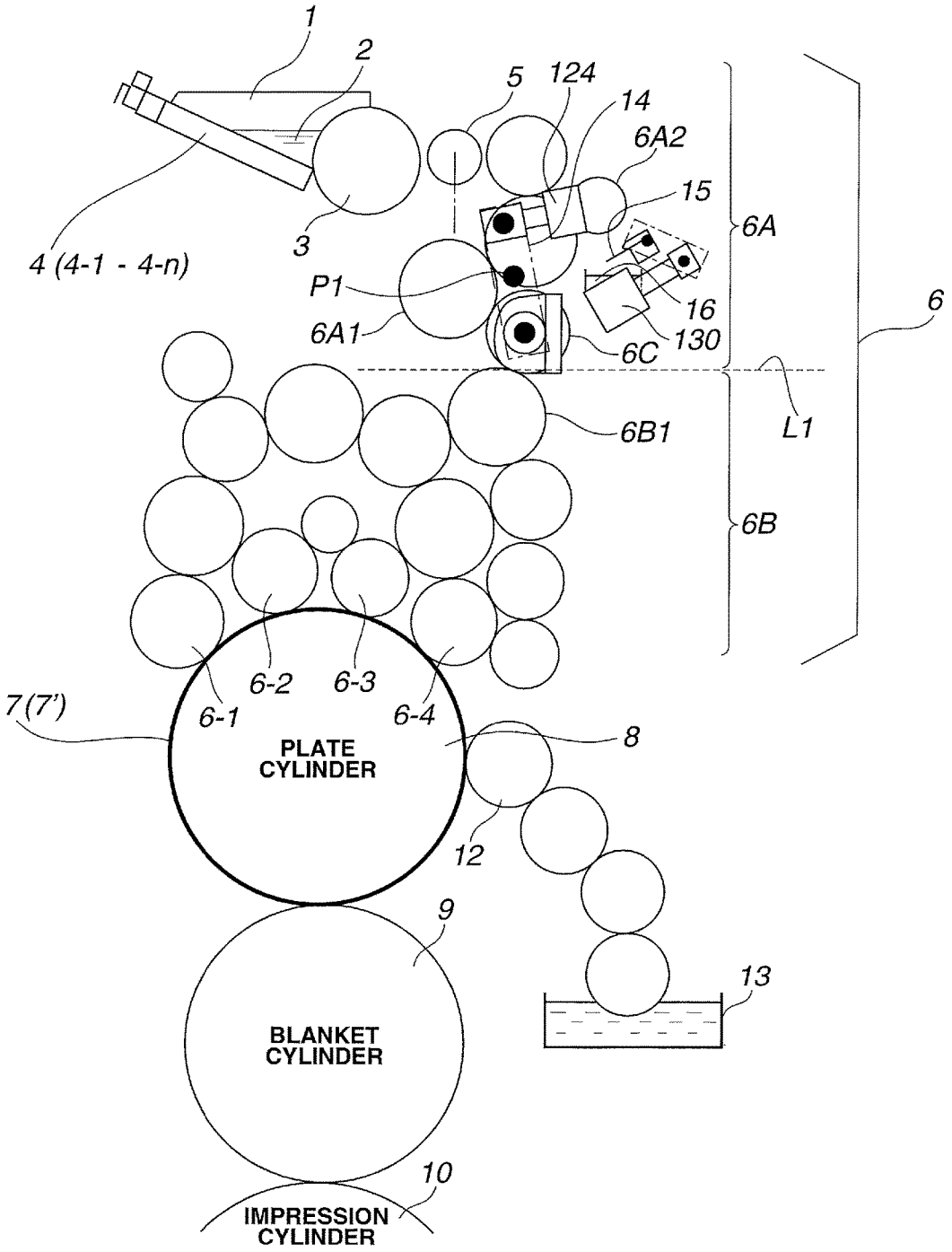
FIG. 2 is a view showing the main part of an ink supply device in a printing unit controlled by the print job switching control device (a state in which an ink roller group is connected (a state before the ink roller group is divided))
Figure 23:
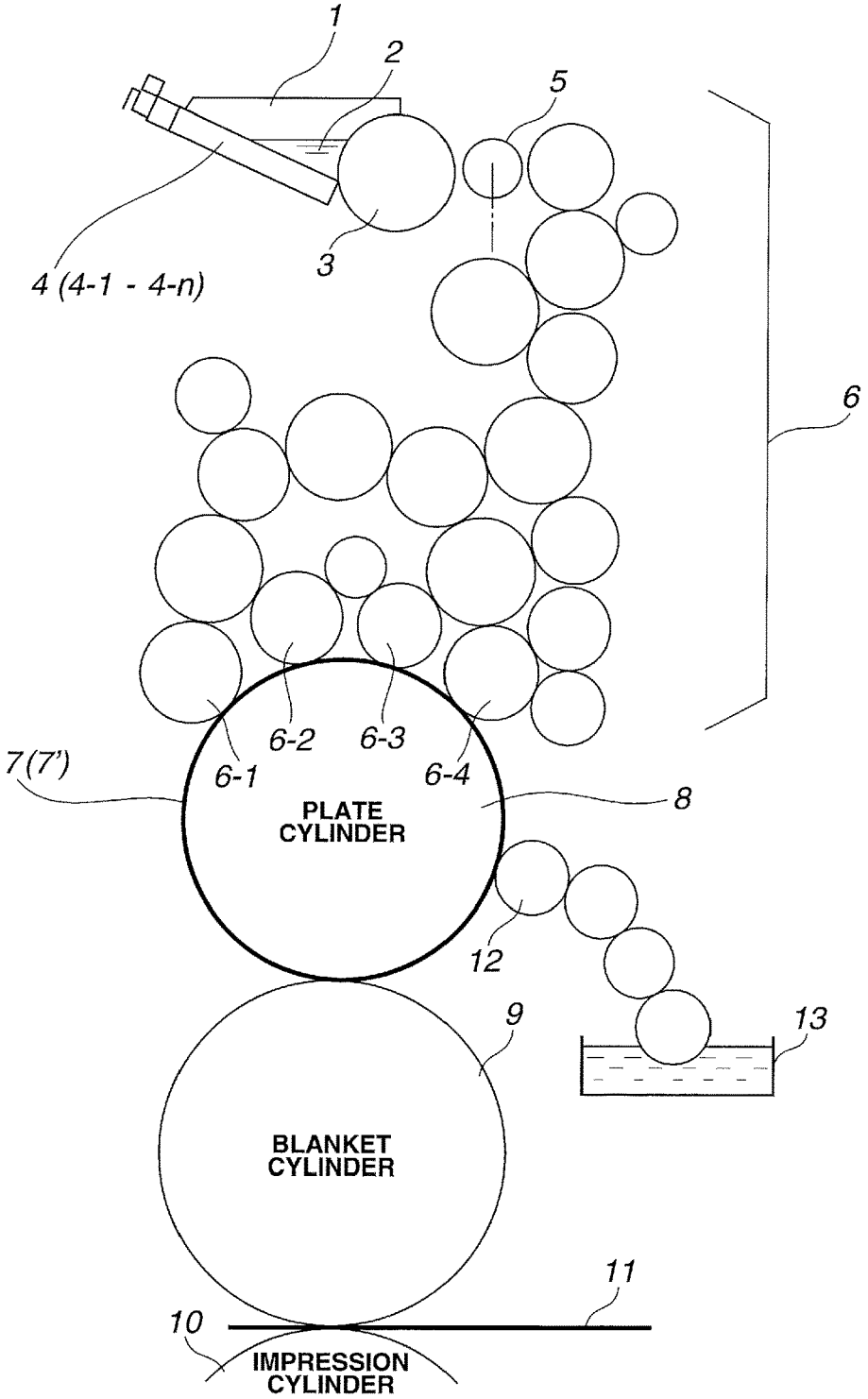
FIG. 23 is a view showing the main part of an ink supply device in a printing unit of each color of a printing press.
Figure 24A:
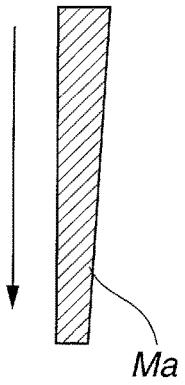
FIGS. 24A and 24B are views each showing an ink film thickness distribution formed on the ink roller group of the ink supply device.
Figure 24B:
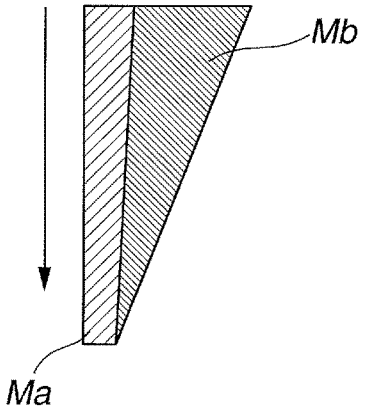
Figure 25:
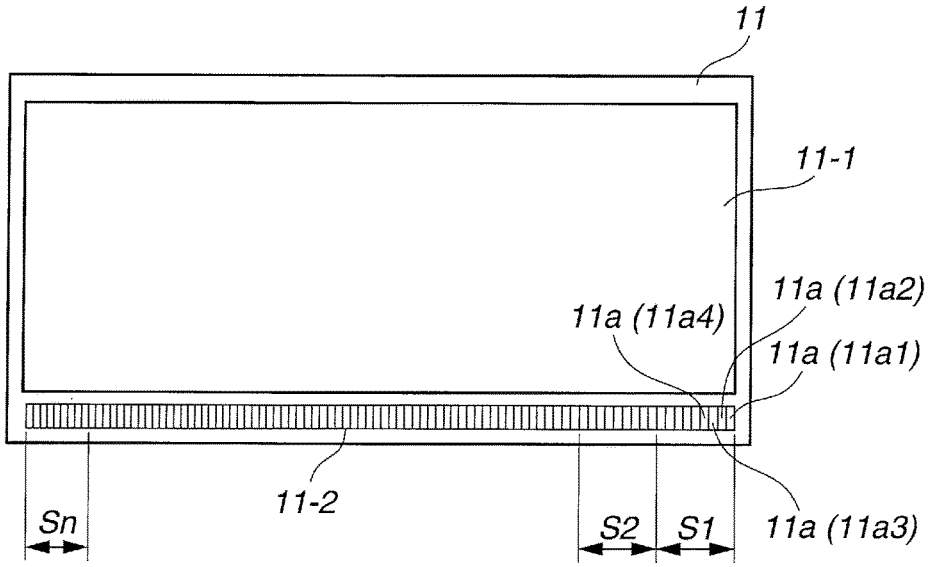
FIG. 25 is a plan view showing the outline of a printed product printed by a printing press.
Figure 26:
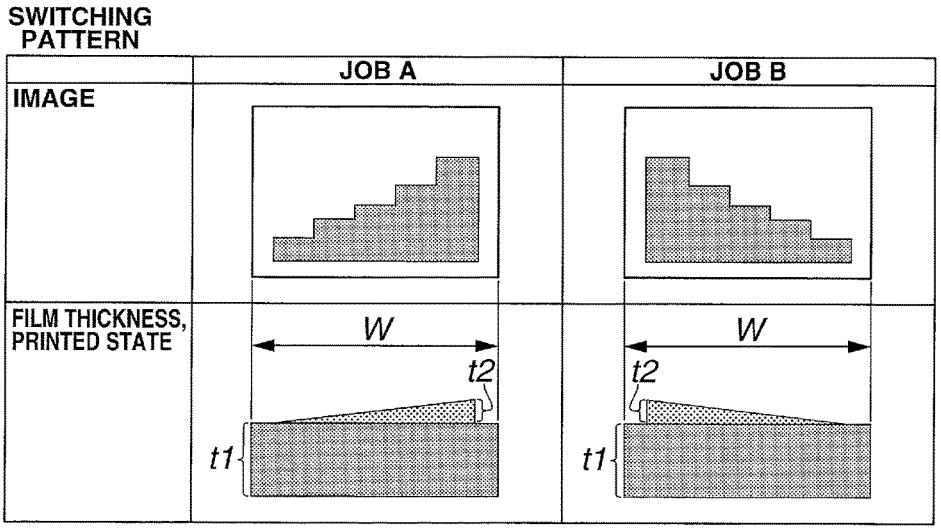
FIG. 26 is a view showing the images of printing plates of a preceding print job (job A) and a current print job (job B) and ink film thicknesses (printed states) in an ink supply device corresponding to the images.
Figure 27A:
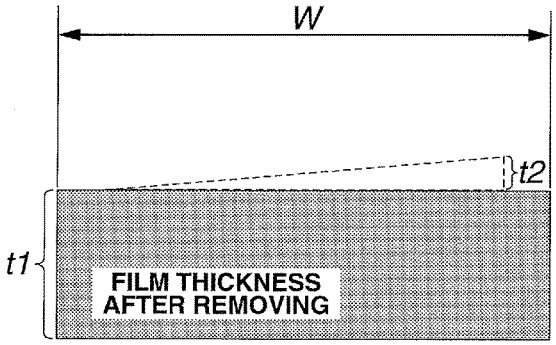
FIG. 27A is a view showing an ink film thickness after ink is decreased by blank sheet printing (a film thickness after removing) when switching the print job from the job A to the job B.
Figure 27B:
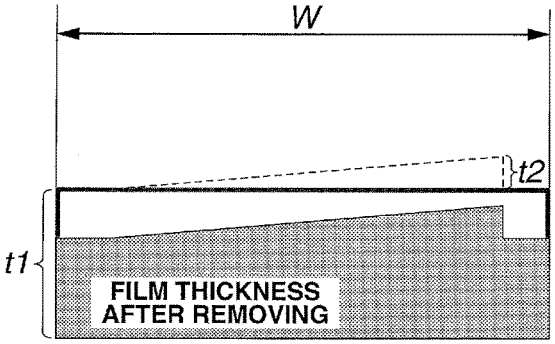
FIG. 27B is a view showing an ink film thickness after ink is scraped by an ink scraper blade (a film thickness after removing) when switching the print job from the job A to the job B.

FIG. 2 is a view showing the main part of an ink supply device in each printing unit controlled by the print job switching control device 100. Referring to FIG. 2, the same reference numerals as in FIG. 23 denote the same or similar constituent elements as those described with reference to FIG. 23, and a description thereof will be omitted. In this ink supply device, an ink roller group 6 can be divided into a roller subgroup 6A on the upstream side and a roller subgroup 6B on the downstream side with respect to by a line L1 indicated by a dotted line in FIG. 2.

More specifically, a roller 6C located between the roller subgroup 6A on the upstream side and the roller subgroup 6B on the downstream side is axially supported by one end of a swing arm 14 that swings with respect to a fulcrum P1 as a pivot center. The roller group dividing/connecting air cylinder 124 is connected to the other end of the swing arm 14. Note that the swing arm 14 is indicated by an alternate long and short dashed line so as to be distinguished from other constituent elements.

In this structure, when the roller group dividing/connecting air cylinder 124 is extended (see FIG. 3), the swing arm 14 swings in the direction of an arrow A with respect to the fulcrum P1 as the pivot center. According to this swing, the outer surface of the roller 6C separates from the outer surface of a roller 6A1 located at the lowermost position of the ink flow path of the roller subgroup 6A on the upstream side. In addition, the outer surface of the roller 6C separates from the outer surface of a roller 6B1 located at the uppermost position of the ink flow path of the roller subgroup 6B on the downstream side. The ink roller group 6 is thus divided into the roller subgroup 6A on the upstream side and the roller subgroup 6B on the downstream side.

When the roller group dividing/connecting air cylinder 124 is retraced from this state, the swing arm 14 swings in the direction of an arrow B with respect to the fulcrum P1 as the pivot center. According to this swing, the outer surface of the roller 6C comes into contact with the outer surface of the roller 6A1 located at the lowermost position of the ink flow path of the roller subgroup 6A on the upstream side. In addition, the outer surface of the roller 6C comes into contact with the outer surface of the roller 6B1 located at the uppermost position of the ink flow path of the roller subgroup 6B on the downstream side (see FIG. 2). The roller subgroup 6A on the upstream side and the roller subgroup 6B on the downstream side are thus connected and returned to one ink roller group 6.

The ink roller group 6 is provided with an ink scraper blade 15 that comes into contact with the outer surface of a roller 6A2 of the roller subgroup 6A on the upstream side and scrapes ink in the roller subgroup 6A on the upstream side and an ink receiver 16 that collects the ink scraped by the ink scraper blade 15. The ink scraper blade 15 is provided with the ink scraper blade on/off air cylinder 130. When scraping ink, the ink scraper blade on/off air cylinder 130 is retracted to bring the ink scraper blade 15 into contact with the outer surface of the roller 6A2 (see FIG. 4). When the ink scraper blade on/off air cylinder 130 is extended, the ink scraper blade 15 separates from the outer surface of the roller 6A2.

In the print job switching control device 100, the CPU 101 obtains various kinds of information given via the interfaces 135-1 to 135-13 and operates in accordance with a program stored in the ROM 103 while accessing the RAM 102 or the memory 134.

The rotary encoder 112 for drive motor generates a rotation pulse for each predetermined rotation angle of the printing press drive motor 110, and outputs it to the drive motor driver 111. The printing press home position detector 114 detects the home position in every rotation of the printing press, generates a home position detection signal, and outputs it to the printing press rotation counter 115.

The ink feed device 116 is provided for an ink ductor roller 5. When the ink feed device 116 is turned on, the feed operation of the ink ductor roller 5 starts. When the ink feed device 116 is turned off, the feed operation of the ink ductor roller 5 stops.

The dampening form roller on/off air cylinder 126 is provided for a dampening form roller 12. When the dampening form roller on/off air cylinder 126 is extended, the dampening form roller 12 transits to a throw-on state (a state in which the dampening form roller 12 is in contact with a printing plate 7 (7')). When the dampening form roller on/off air cylinder 126 is retracted, the dampening form roller 12 transits to a throw-off state (a state in which the dampening form roller 12 is apart from the printing plate 7 (7')).

The ink form roller on/off air cylinder 128 is provided for ink form rollers 6-1 to 6-4. When the ink form roller on/off air cylinder 128 is extended, the ink form rollers 6-1 to 6-4 transit to a throw-on state (a state in which the ink form rollers 6-1 to 6-4 are in contact with the printing plate 7 (7')). When the ink form roller on/off air cylinder 128 is retracted, the ink form rollers 6-1 to 6-4 transit to a throw-off state (a state in which the ink form rollers 6-1 to 6-4 are apart from the printing plate 7 (7')).

Figure 5A:
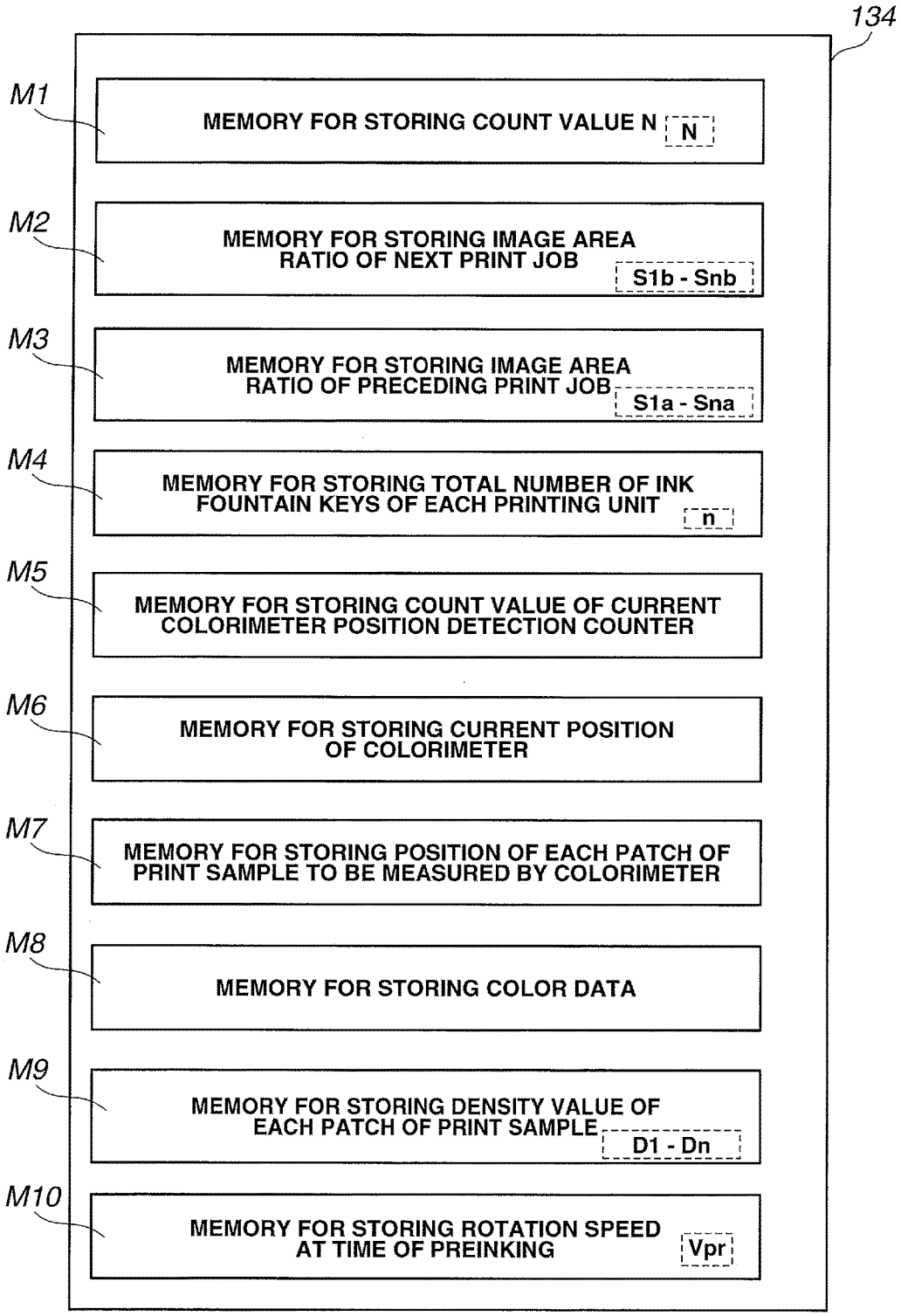
FIGS. 5A to 5C are views showing the contents of a memory in the print job switching control device.
Figure 5B:
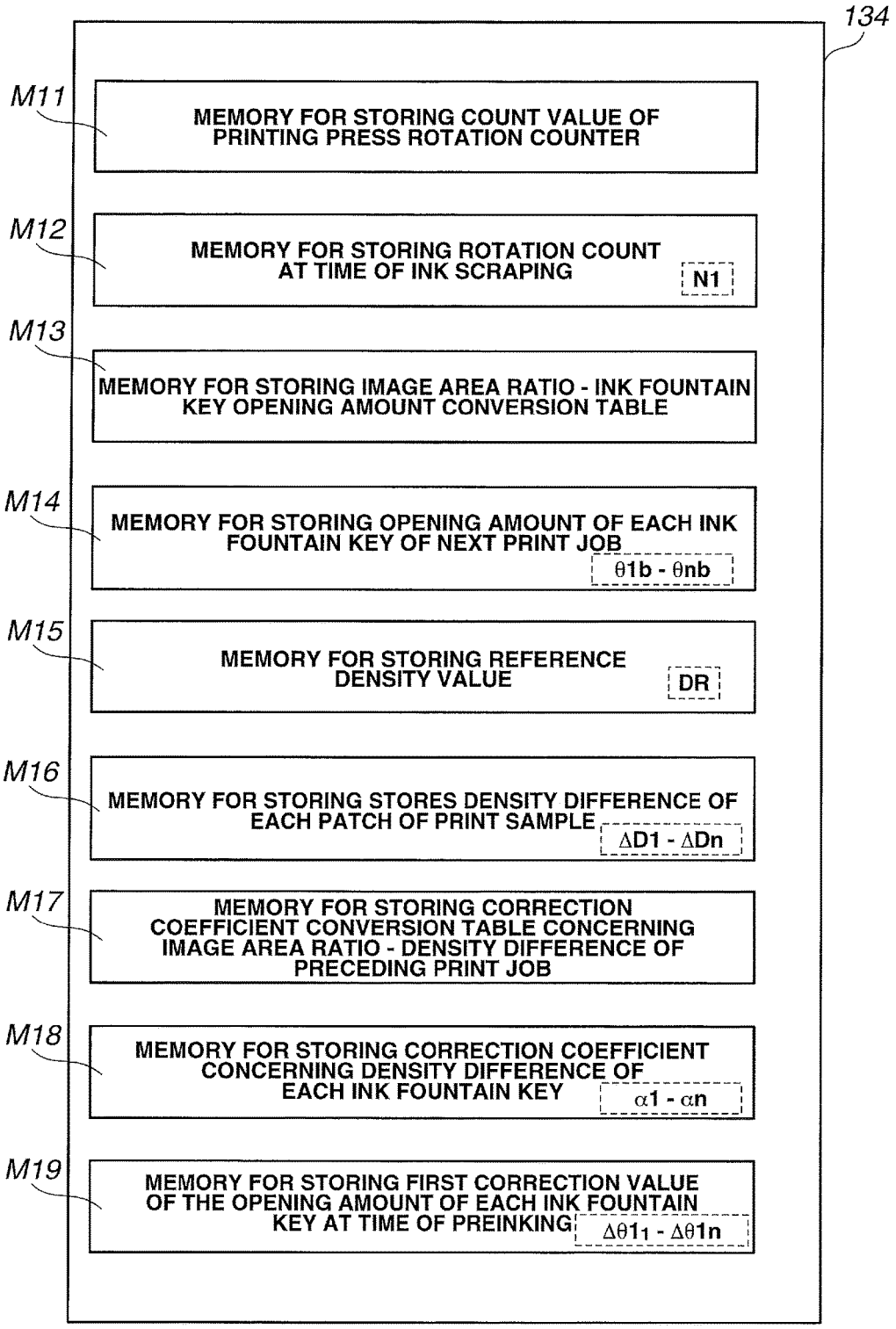
Figure 5C:
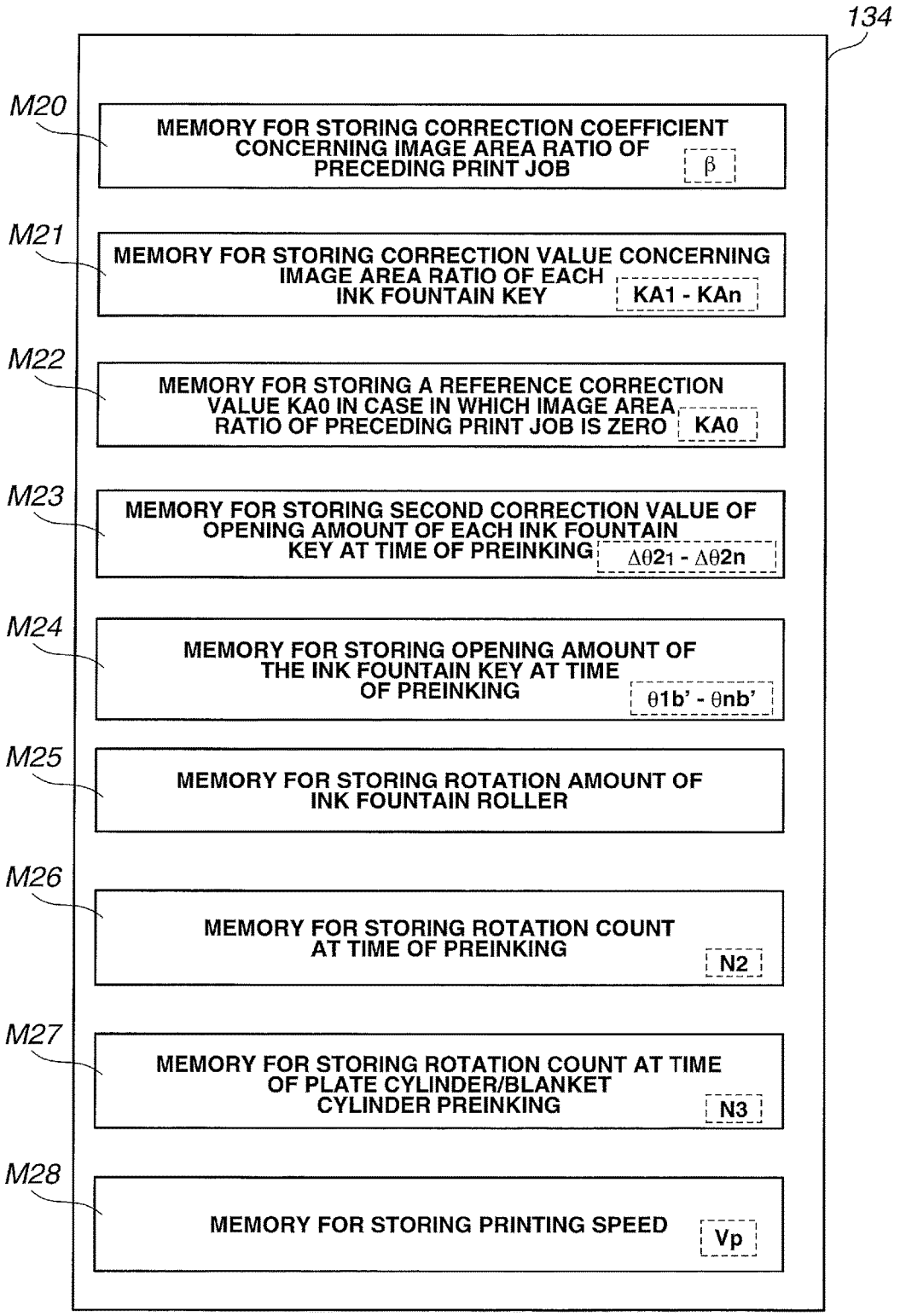

FIGS. 5A to 5C divisionally show the contents of the memory 134. The memory 134 is provided with memories M1 to M28. The memory M1 stores a count value N. The memory M2 stores image area ratios S1*b* to Snb in the areas of the printing plate of the next print job corresponding to the ink fountain keys 4-1 to 4-n. The memory M3 stores image area ratios S1*a* to Sna in ranges of the printing plate of the preceding print job corresponding to the ink fountain keys 4-1 to 4-n. The memory M4 stores the total number n of the ink fountain keys of each printing unit. The memory M5 stores the count value of the current colorimeter position detection counter 121 of the colorimeter. The memory M6 stores the current position of the colorimeter 117. The memory M7 stores the positions of the patches of a print sample to be measured by the colorimeter 117. The memory M8 stores color data from the colorimeter 117. The memory M9 stores density values D1 to Dn of the patches of the print sample. The memory M10 stores a rotation speed Vpr at the time of preinking.

The memory M11 stores the count value of the printing press rotation counter 115. The memory M12 stores a rotation count N1 of the printing press at the time of ink scraping. The memory M13 stores an image area ratio—ink fountain key opening amount conversion table. The memory M14 stores opening amounts θ1*b* to θnb of the ink fountain keys 4-1 to 4-n corresponding to the image of the printing plate of the next print job. The memory M15 stores a reference density value DR. The memory M16 stores differences (density differences) ΔD1 to ΔDn between the reference density value DR and the density values D1 to Dn of the patches of the print sample. The memory M17 stores a correction coefficient conversion table concerning image area ratio—density difference of the preceding print job. The memory M18 stores correction coefficients α1 to αn concerning the density differences of the ink fountain keys 4-1 to 4-n. The memory M19 stores first correction values $\Delta\theta 1_1$ to $\Delta\theta 1_n$, of the opening amounts of the ink fountain keys 4-1 to 4-n at the time of preinking.

The memory M20 stores a correction coefficient β concerning the image area ratio of the preceding print job. The memory M21 stores correction values KA1 to KAn of the opening amounts of the ink fountain keys 4-1 to 4-n concerning the image area ratio of the preceding print job. The memory M22 stores a reference correction value KA0 in a case in which the image area ratio of the preceding print job is zero. The memory M23 stores second correction values $\Delta\theta 2_1$ to $\Delta\theta 2_n$ of the opening amounts of the ink fountain keys 4-1 to 4-n t the time of preinking. The memory M24 stores opening amounts θ1*b'* to θnb' of the ink fountain keys 4-1 to 4-n at the time of preinking. The memory M25 stores the rotation amount of the ink fountain roller. The memory M26 stores a rotation count N2 of the printing press at the time of preinking. The memory M27 stores a rotation count N3 of the printing press at the time of plate cylinder/blanket cylinder preinking. The memory M28 stores a printing speed Vp.

Figure 6:
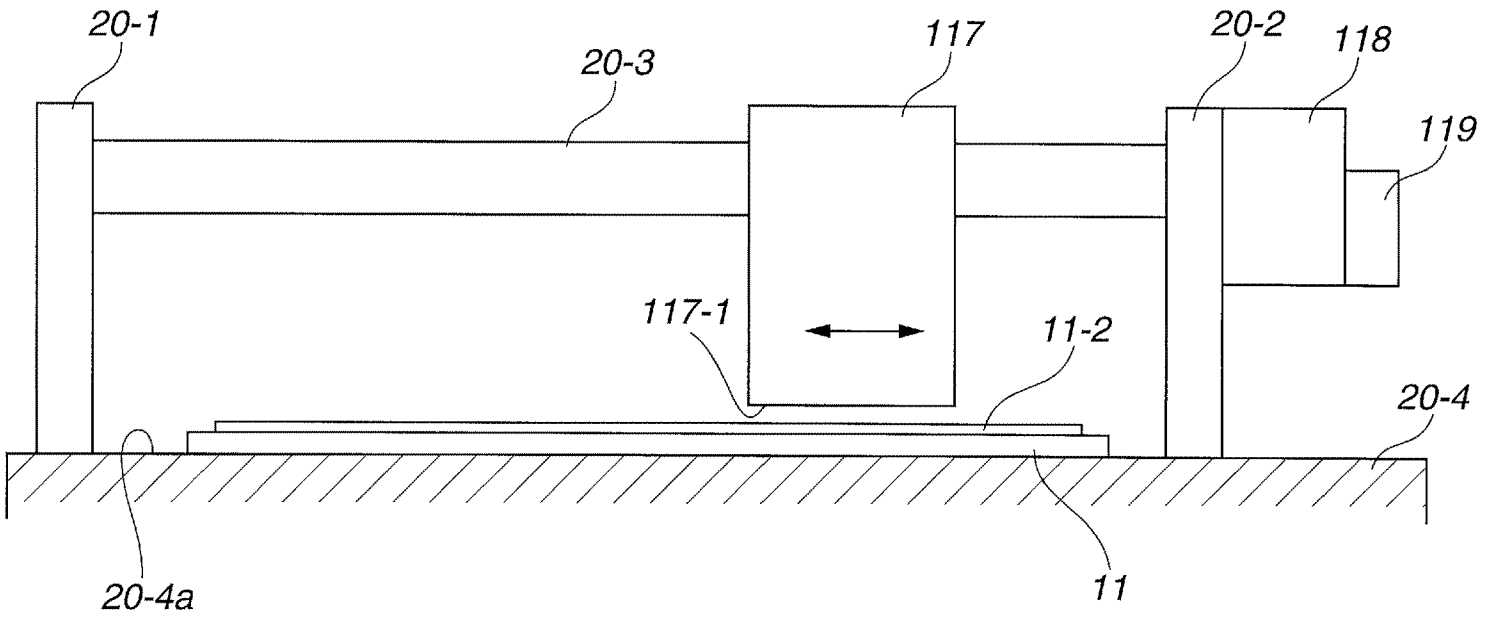
FIG. 6 is a side view showing the placement state of a colorimeter.

As shown in FIG. 6, the colorimeter 117 is attached to a ball screw (feed screw) 20-3 provided between columns 20-1 and 20-2. The ball screw 20-3 is rotated in the forward/reverse direction by the colorimeter moving motor 118. By the forward/reverse rotation of the ball screw 20-3, the colorimeter 117 moves between the columns 20-1 and 20-2 while being guided by the ball screw 20-3. The head portion 117-1 of the colorimeter 117 faces a surface 20-4*a* of a measurement table 20-4 on which a measurement target is placed.

Note that referring to FIG. 1, reference numeral 200 denotes an ink fountain roller control device that drives an ink fountain roller 3 in the ink supply device; 300-1 to 300-*n*, ink fountain key control devices that control the opening amounts of the ink fountain keys 4-1 to 4-nin the ink supply device. The ink fountain roller control device 200 and the ink fountain key control devices 300-1 to 300-nare provided for the ink supply device of each color. In this embodiment, one ink supply device will be exemplified for the sake of simplicity. That is, the operation of one representative ink supply device will be described.

[Schematic Operation of Print Job Switching Control Device]

Before a description of the detailed operation of the print job switching control device 100, a schematic operation will be explained for easy understanding.

(1) Sheet feed is stopped, and simultaneously, printing using the printing plate 7 is stopped (a preceding print job is ended). When printing is stopped, impression-off is performed to separate a blanket cylinder 9 from a plate cylinder 8 and an impression cylinder 10. At the same time, the ink form rollers 6-1 to 6-4 are thrown off, and the dampening form roller 12 is thrown off so that they are separated from the plate cylinder 8 (see FIG. 3). In this case, an ink film thickness distribution Mc corresponding to the image of the printing plate 7 is left on the ink roller group 6, as indicated by step S1 in FIG. 7. That is, the ink film thickness distribution Mc of the preceding print job is left.

Figure 7:
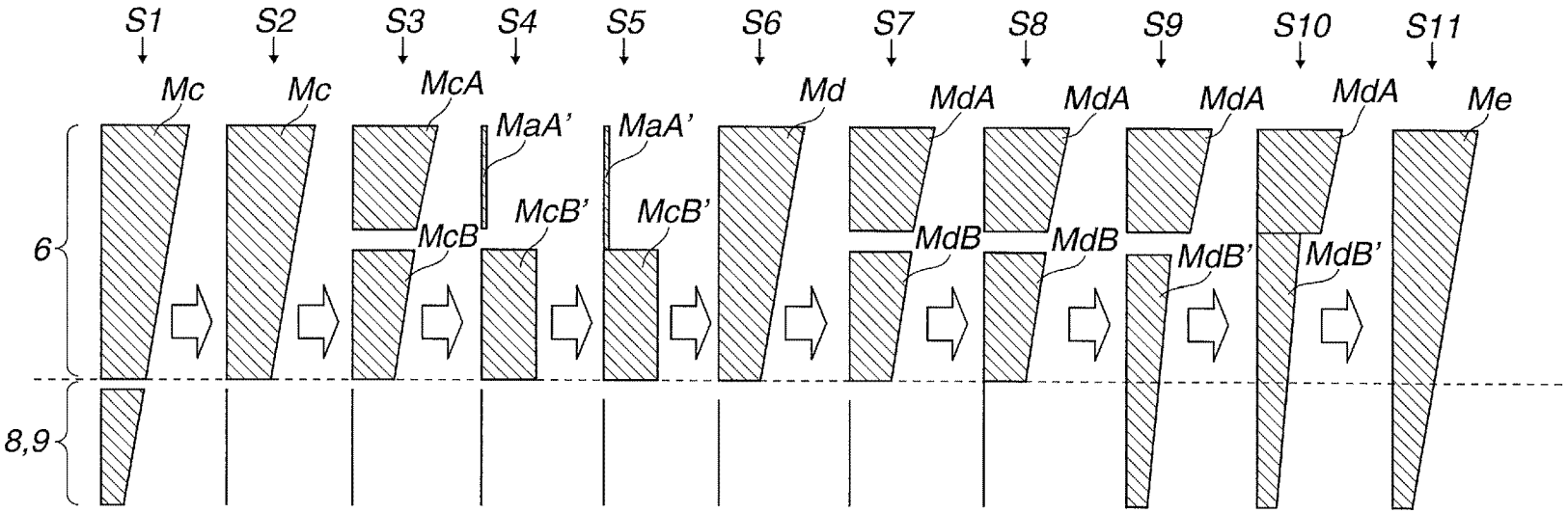
FIG. 7 is a view showing the process of forming an ink film thickness distribution for a next print job on the ink roller group, a plate cylinder, and a blanket cylinder at the time of print job switching using the print job switching control device.

(2) In the printing press stop state, the printing plate 7 mounted on the plate cylinder 8 is exchanged with the printing plate 7' of the next print job, and the blanket cylinder 9 is cleaned (FIG. 7: step S2).

(3) The ink roller group 6 is divided into the roller subgroup 6A on the upstream side and the roller subgroup 6B on the downstream side (division at the time of removing). Accordingly, the ink film thickness distribution Mc on the ink roller group 6 is divided into an ink film thickness distribution McA on the roller subgroup 6A on the upstream side and an ink film thickness distribution McB on the roller subgroup 6B on the downstream side, as indicated by step S3 in FIG. 7.

(4) The rotation speed of the printing press is increased up to the rotation speed Vpr at the time of preinking. The ink scraper blade 15 is thrown on to the roller 6A2 in the roller subgroup 6A on the upstream side. In this state, the printing press is rotated constantly (the rotation count N1 at the time of ink scraping) to scrape and decrease the ink in the roller subgroup 6A on the upstream side (see FIG. 4). That is, the ink in the roller subgroup 6A on the upstream side is removed. Accordingly, an ink film thickness distribution MaA' after removing is left on the roller subgroup 6A on the upstream side, as indicated by step S4 in FIG. 7. At this time, the ink film thickness distribution on the roller subgroup 6B on the downstream side is evened by the rotation count N1 at the time of ink scraping and changes to a flat ink film thickness distribution McB'.

In step S4, ink scraping is executed assuming that the printed product of the preceding print job is printed at the reference density, as in the ink film thickness control method described in patent literature 1 or 2. For this reason, if the printed product of the preceding print job is not printed at the reference density, an excess or deficiency occurs in the ink left on the roller subgroup 6A on the upstream side.

That is, in actual printing, printing is performed in a tone that is the same as much as possible as in a proofing print approved by a customer. Hence, in many cases, the density of each color of the printed product of the actual printing is different from the reference density (standard density), and the ink film thickness distribution on the ink roller group at the end of printing of the preceding print job is different from that in a case in which printing is performed at the reference density (standard density).

In the ink film thickness control method (ink decrease+preinking 2) described in patent literature 1 or the ink film thickness control method (ink return+preinking 1) described in patent literature 2, ink decrease or ink return is executed assuming only a standard state (a printed state at the reference density). For this reason, an excess or deficiency occurs in the ink left on the ink roller group. After an ink film thickness distribution is superimposed on the ink film thickness distribution left on the ink roller group by preinking 2 or preinking 1, the ink supply amount needs to be manually adjusted while performing test printing. This increases the burden on the operator. In addition, the preparation time prolongs to lower the operation rate of the printing press, and printing materials are wasted.

In step S4 described above, ink scraping is executed assuming that the printed product of the preceding print job is printed at the reference density, as in the ink film thickness control method described in patent literature 1 or 2. For this reason, if the printed product of the preceding print job is not printed at the reference density, an excess or deficiency occurs in the ink left on the roller subgroup 6A on the upstream side (problem 1).

In the ink film thickness control method described in patent literature 3, when "the feed operation of the ink ductor roller is stopped in a state in which the printing plate of the preceding print job is kept mounted on the plate cylinder, and the ink amount in the ink supply device is decreased by printing a predetermined number of sheets in the state", the number of printed sheets is changed in accordance with the density of the printed product printed in the preceding print job. However, this operation has no effect in actuality because the density changes in the area of each ink fountain key.

Additionally, in step S4, since the ink scraper blade 15 scrapes the ink evenly in the roller width direction, the ink film thickness distribution MaA' after removing which is left on the roller subgroup 6A on the upstream side is an ink film thickness distribution affected by the unevenness of the ink film thickness caused by the difference in the image area ratio in the area corresponding to the ink fountain keys 4-1 to 4-n or an ink film thickness distribution formed by removing the ink while cutting into the reference ink film thickness distribution corresponding to a portion where the image area ratio is zero (problem 2).

Figure 8:
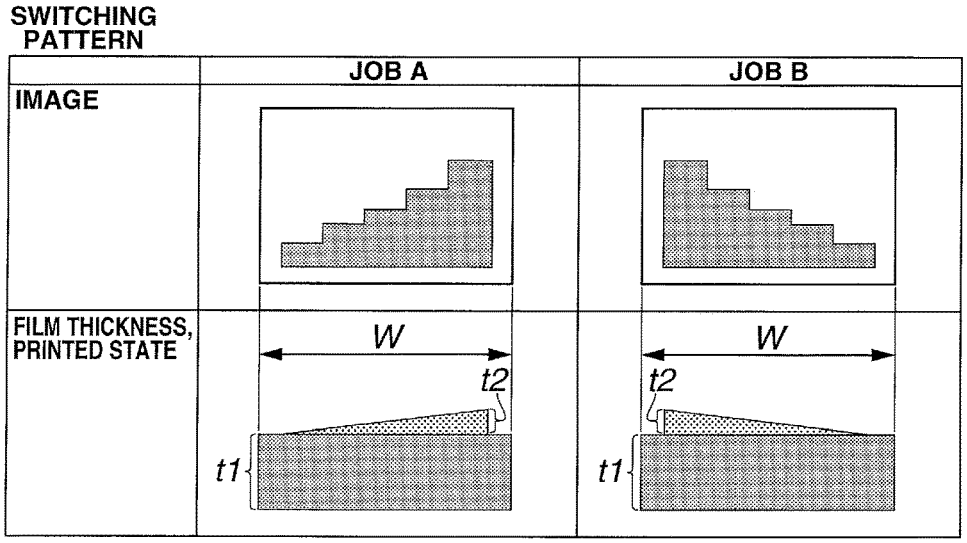
FIG. 8 is a view showing the images of printing plates of a preceding print job (job A) and a current print job (job B) and ink film thicknesses (printed states) in the ink supply device corresponding to the images.

FIG. 8 shows the images of printing plates of a preceding print job (job A) and a current print job (job B) and ink film thicknesses (printed states) in the ink supply device corresponding to the images. The view on the upper side of FIG. 8 shows the images of the printing plates of the jobs A and B, and the view on the lower side shows the ink film thicknesses in the ink supply device corresponding to the images of the printing plates of the jobs A and B.

In the job A, the image area ratio in the area corresponding to the ink fountain keys increases (the ink film thickness increases) from left to right. In the job B, the image area ratio in the area corresponding to the ink fountain keys increases (the ink film thickness increases) from right to left, contrary to the job A. Note that t1 is the reference ink film thickness, t2 is the image film thickness, and W is the width of the printing plate. Each of the reference ink film thickness t1 and the image film thickness t2 indicates the average value of ink film thicknesses that decrease from the upstream side to the downstream side on the ink roller group 6.

Figure 9A:
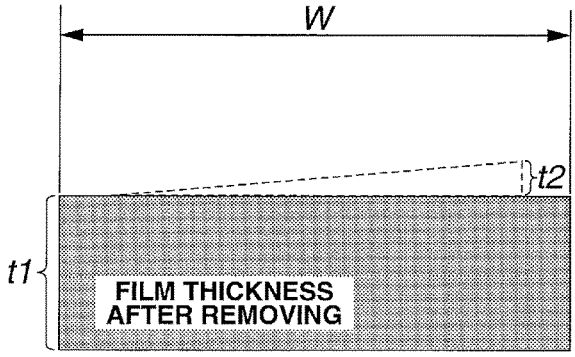
FIG. 9A is a view showing an ink film thickness after ink is decreased by blank sheet printing (a film thickness after removing) when switching the print job from the job A to the job B.

FIG. 9A shows an ink film thickness after ink is decreased by the method (blank sheet printing) described in patent literature 1 (a film thickness after removing) when switching the print job from the job A to the job B. In this case, since the ink is decreased by blank sheet printing, the image film thickness t2 of the printing plate of the job A is removed, and only the reference ink film thickness t1 is left. Hence, when the opening amounts of the ink fountain keys are set to opening amounts corresponding to the image of the printing plate of the job B, the image film thickness t2 of the job B is superimposed on the reference ink film thickness t1.

Figure 9B:
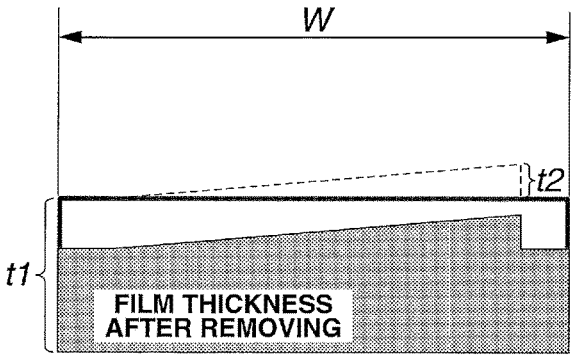
FIG. 9B is a view showing an ink film thickness after ink is scraped by an ink scraper blade (a film thickness after removing) when switching the print job from the job A to the job B.

FIG. 9B shows an ink film thickness after ink is scraped by the ink scraper blade 15 (a film thickness after removing) when switching the print job from the job A to the job B. In this case, since the ink scraper blade 15 scrapes the ink evenly in the roller width direction, the influence of the unevenness of the ink film thickness caused by the difference in the image area ratio in the area corresponding to the ink fountain keys 4-1 to 4-n cannot be eliminated. In addition, the ink is removed while cutting into the reference ink film thickness t1. For this reason, even when the opening amounts of the ink fountain keys 4-1 to 4-n are set to opening amounts corresponding to the image of the printing plate of the job B, an ink film thickness including the image film thickness t2 of the job B superimposed on the reference ink film thickness t1 cannot be obtained.

Figure 10A:
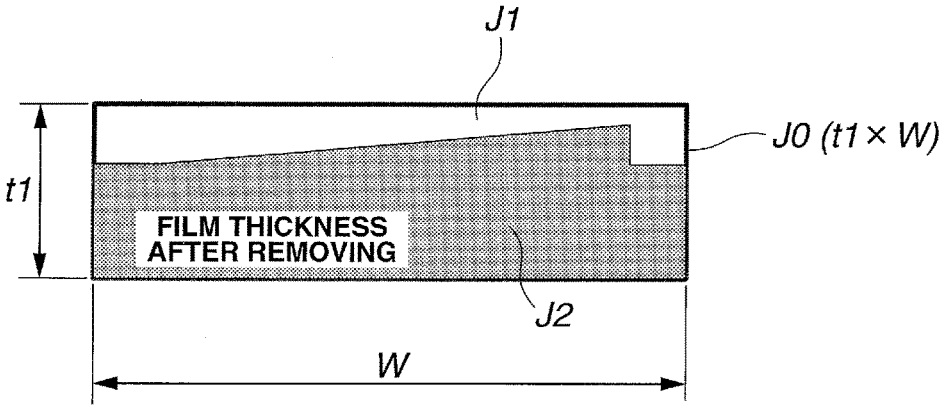
FIG. 10A is a view showing an ink film thickness component J2 after removing.

That is, as indicated in FIG. 10A by "film thickness after removing" upon switching the print job from the job A to the job B in FIG. 9B, when the area of a rectangle represented by reference ink film thickness t1×W (printing plate width) in FIG. 10A is defined as a reference film thickness component J0, a component (a portion indicated by black) J2 except a key-shaped ink removal component (a portion indicated by white) J1 cut into the reference film thickness component J0 is the ink film thickness component after removing. For this reason, even when the opening amounts of the ink fountain keys 4-1 to 4-n are set to opening amounts corresponding to the image of the printing plate of the job B, an ink film thickness including the image film thickness t2 of the job B superimposed on the reference ink film thickness t1 cannot be obtained.

(5) In this embodiment, for problem 1 described above, correction values (correction values according to the densities in the areas of the printed product printed by the preceding print job corresponding to the ink fountain keys 4-1 to 4-n) corresponding to correction components (the correction components will be referred to as JX hereinafter) according to the density of the printed product printed by the preceding print job are obtained as the first correction values of the opening amounts of the ink fountain keys 4-1 to 4-n. For problem 2 described above, as shown in FIG. 10B, correction values (correction values according to the image area ratios in the areas of the printing plate 7 of the preceding print job corresponding to the ink fountain keys 4-1 to 4-n) corresponding to a reference film thickness compensation component JY are obtained as the second correction values of the opening amounts of the ink fountain keys 4-1 to 4-n such that the image film thickness component JB of the job B and the reference film thickness compensation component JY corresponding to the ink removal component J1 are added to the ink film thickness component J2 after removing. The opening amounts of the ink fountain keys 4-1 to 4-n corresponding to the image of the printing plate 7' of the next print job are corrected by the first correction values and the second correction values, and the opening amounts of the ink fountain keys 4-1 to 4-n are set to the corrected opening amounts. In addition, the roller subgroup 6A on the upstream side and the roller subgroup 6B on the downstream side are connected and returned to one ink roller group 6 (FIG. 7: step S5).

(6) In the state in which the rotation speed of the printing press is the rotation speed Vpr at the time of preinking, the ink ductor roller 5 is caused to perform the feed operation as many times as the rotation count N2 at the time of preinking to add the image film thickness component of the next print job, the correction component according to the density of the printed product printed by the preceding print job, and the reference film thickness compensation component to the ink film thickness component left on the ink roller group 6 after removing and form an ink film thickness distribution Md corresponding to the image of the printing plate 7' of the next print job on the ink roller group 6 (FIG. 7: step S6).

(7) The feed operation of the ink ductor roller 5 is stopped, and the ink roller group 6 is redivided into the roller subgroup 6A on the upstream side and the roller subgroup 6B on the downstream side (division at the start of printing). Accordingly, the ink film thickness distribution Md on the ink roller group 6 is divided into an ink film thickness distribution MdA on the roller subgroup 6A on the upstream side and an ink film thickness distribution MdB on the roller subgroup 6B on the downstream side, as indicated by step S7 in FIG. 7.

(8) The ink form rollers 6-1 to 6-4 and the dampening form roller 12 are thrown on, and only the plate cylinder 8 and the blanket cylinder 9 are set in the throw-on state. That is, the ink form rollers 6-1 to 6-4 and the dampening form roller 12 are brought into contact with the plate surface of the printing plate 7', and the blanket cylinder 9 is thrown on to only the plate cylinder 8 (the feed operation is kept stopped). Accordingly, the roller subgroup 6B on the downstream side, the dampening form roller 12, the plate cylinder 8, and the blanket cylinder 9 are set in the throw-on state (FIG. 7: step S8).

(9) In this state, the printing press is rotated as many times as the rotation count N3 at the time of plate cylinder/blanket cylinder preinking, and the ink in the roller subgroup 6B on the downstream side is supplied to the blanket cylinder 9 and the printing plate 7' mounted on the plate cylinder 8 (FIG. 7: step S9). In this case, only the ink of the relatively thin ink film thickness distribution MdB in the roller subgroup 6B on the downstream side is supplied to the printing plate 7' and the blanket cylinder 9. This prevents the ink film thickness distribution on the printing plate 7' and the blanket cylinder 9 from becoming too thick.

Figure 11:
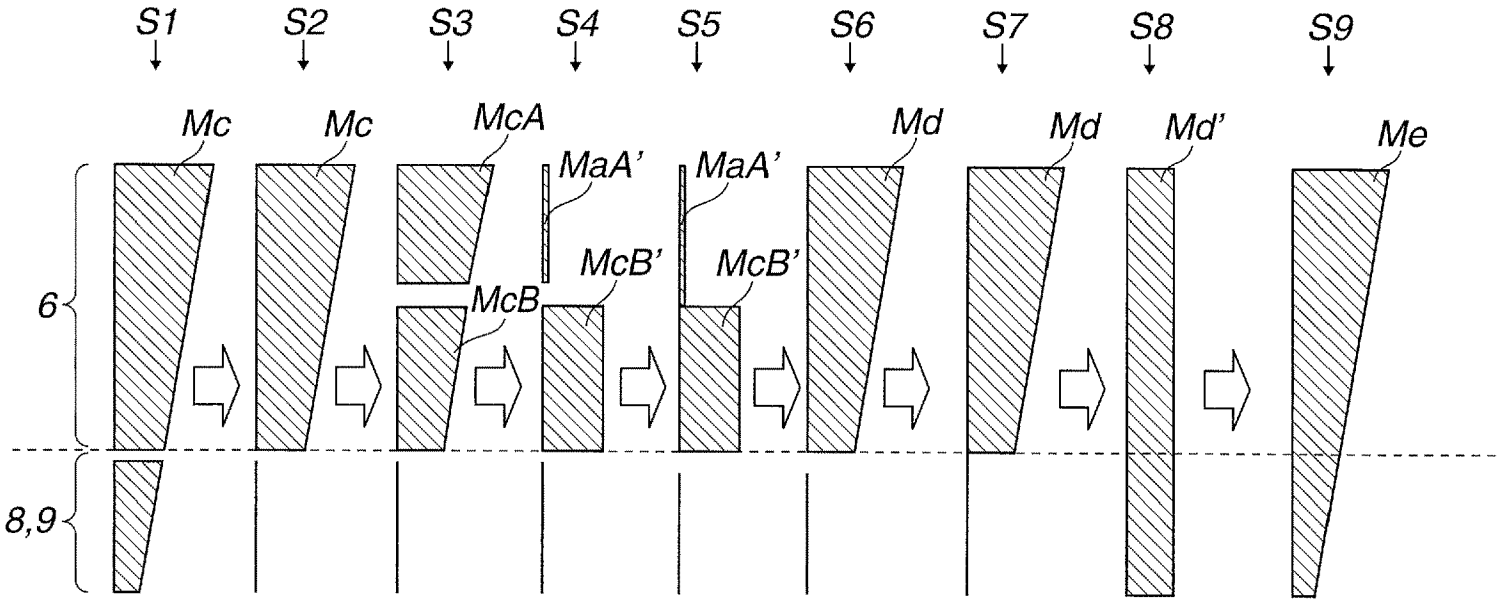
FIG. 11 is a view showing the process of forming an ink film thickness distribution corresponding to FIG. 7 in a case in which the ink film thickness distribution for the next print job is formed without dividing the ink roller group after preinking in the inking device.

That is, as shown in FIG. 11, after step S6 in FIG. 11 corresponding to step S6 in FIG. 7, the ink form rollers 6-1 to 6-4, the dampening form roller 12, the plate cylinder 8, and the blanket cylinder 9 may be set in the throw-on state without dividing the ink roller group 6 (FIG. 11: step S7), and the printing press may be rotated a predetermined number of times to supply the ink to the plate cylinder 8 and the blanket cylinder 9. In this case, all ink in the ink supply device is evened in the ink roller group 6, the plate cylinder 8, and the blanket cylinder 9. For this reason, an excessive amount of ink is supplied to the plate cylinder 8 and the blanket cylinder 9, and the ink film thickness distribution on the plate cylinder 8 and the blanket cylinder 9 becomes too thick (FIG. 11: step S8).

On the other hand, when the ink roller group 6 is divided into the roller subgroup 6A on the upstream side and the roller subgroup 6B on the downstream side after step S6 in FIG. 7 (FIG. 7: step S7), only the ink of the relatively thin ink film thickness distribution MdB in the roller subgroup 6B on the downstream side is supplied to the printing plate 7' and the blanket cylinder 9 (FIG. 7: step S9). This prevents the ink film thickness distribution on the printing plate 7' and the blanket cylinder 9 from becoming too thick.

(10) After that, the roller subgroup 6A on the upstream side and the roller subgroup 6B on the downstream side are thus reconnected and returned to one ink roller group 6 (FIG. 7: step S10). The feed operation of the ink ductor roller 5 is performed. The blanket cylinder 9 is set in the throw-on state with respect to the impression cylinder 10 as well. That is, an impression-on state in which the plate cylinder 8, the blanket cylinder 9, and the impression cylinder 10 are in contact is obtained (see FIG. 2). Printing of the next print job is started using the printing plate 7' mounted on the plate cylinder 8.

In this case, the ink film thickness distribution (the ink film thickness distribution in final printing) at the time of printing of the next print job is created during printing. At this time, since an ink film thickness distribution MdB' in the roller subgroup 6B on the downstream side, the plate cylinder 8, and the blanket cylinder 9 is thin, the ink quickly flows from the upstream side to the downstream side, and an ink film thickness distribution Me during final printing is quickly formed on the ink roller group 6, the plate cylinder 8, and the blanket cylinder 9 (FIG. 7: step S11).

In the method shown in FIG. 11, the ink film thickness distribution on the plate cylinder 8 and the blanket cylinder 9 becomes too thick (FIG. 11: step S8). Hence, time is taken to form the ink film thickness distribution Me during final printing (FIG. 11: step S9), and much waste paper is generated. On the other hand, in this embodiment, since the ink film thickness distribution formed on the plate cylinder 8 and the blanket cylinder 9 is prevented from becoming too thick, the ink quickly flows from the upstream side to the downstream side, and the ink film thickness distribution during final printing is quickly formed on the ink roller group 6, the plate cylinder 8, and the blanket cylinder 9. Hence, after the exchange to the printing plate 7' and the start of printing of the next print job, a normal printed product is obtained in a short time.

Figure 12:
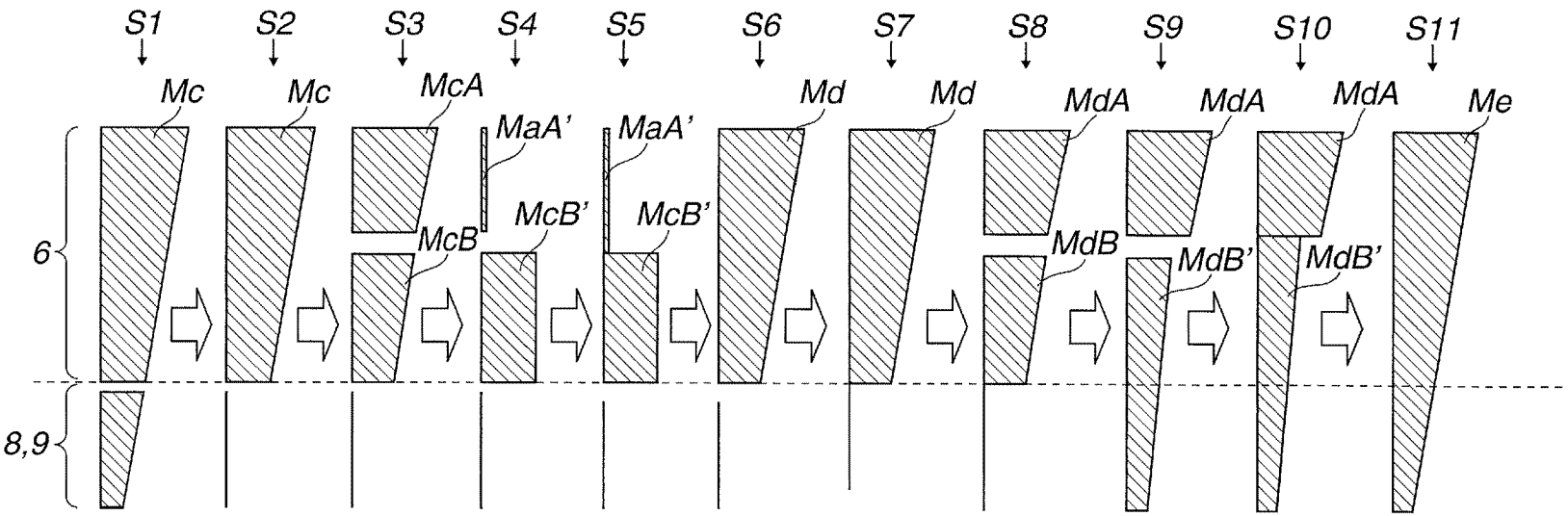
FIG. 12 is a view showing the process of forming an ink film thickness distribution corresponding to FIG. 7 in a case in which a roller subgroup on the downstream side, the plate cylinder, and the blanket cylinder are set in a throw-on state before dividing the ink roller group.

Note that in the schematic operation described with reference to FIG. 7, after the ink roller group 6 is divided into to the roller subgroup 6A on the upstream side and the roller subgroup 6B on the downstream side (FIG. 7: step S7), the roller subgroup 6B on the downstream side is set in the throw-on state with respect to the plate cylinder 8 (FIG. 7: step S8). However, as shown in FIG. 12, the roller subgroup 6B on the downstream side may be set in the throw-on state with respect to the plate cylinder 8 before the ink roller group 6 is divided into to the roller subgroup 6A on the upstream side and the roller subgroup 6B on the downstream side (FIG. 12: step S7). After that, the ink roller group 6 may be divided into the roller subgroup 6A on the upstream side and the roller subgroup 6B on the downstream side (FIG. 12: step S8).

[Detailed Operation of Print Job Switching Control Device]

Figure 13A:
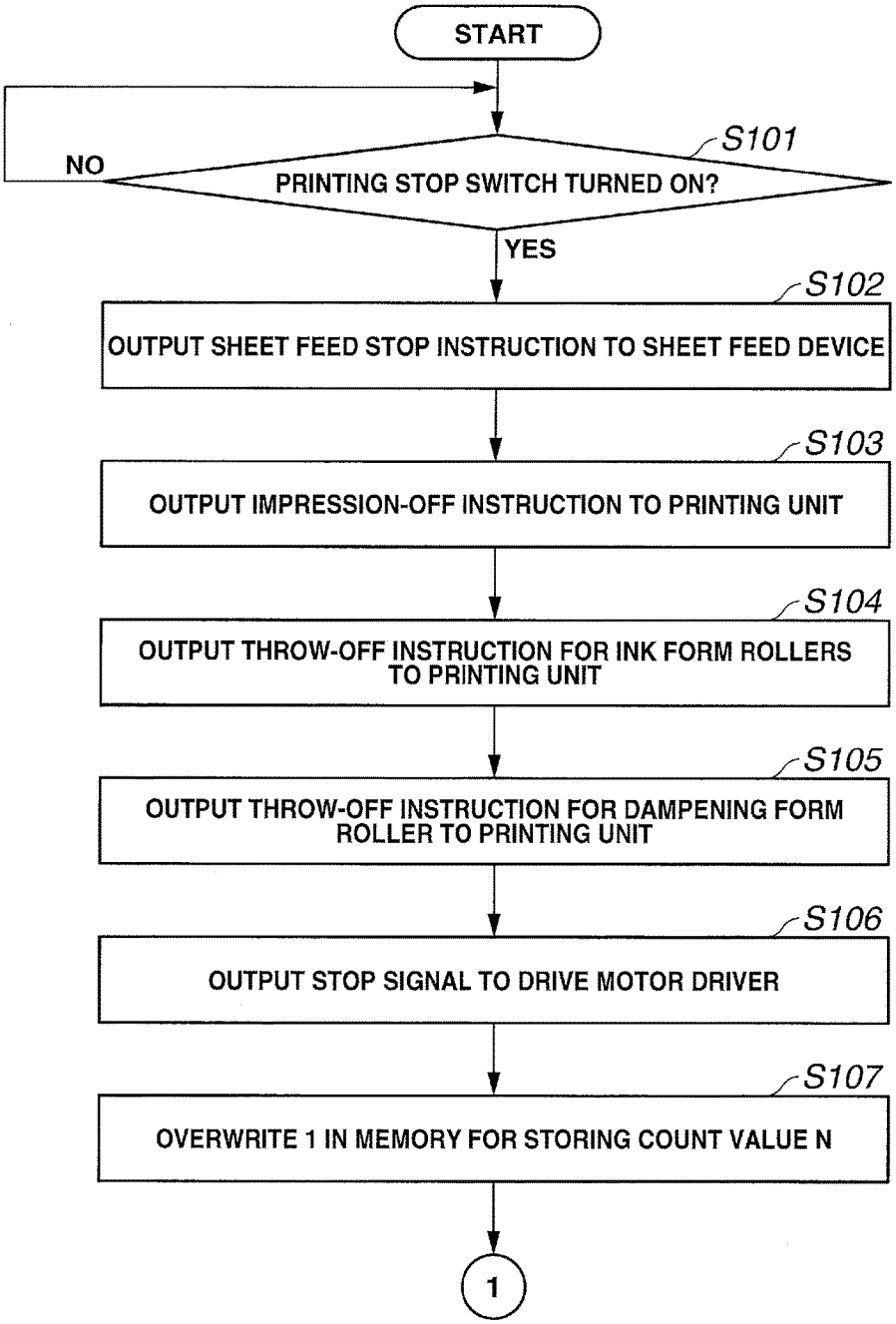
FIGS. 13A to 13S are flowcharts for explaining a detailed operation of the print job switching control device.

When switching a print job, the operator turns on the printing stop switch 107. Then, the CPU 101 confirms that the printing stop switch 107 is turned on (FIG. 13A: YES in step S101), outputs a sheet feed stop instruction to the sheet feed device 132 to stop sheet feed to the printing press (step S102), and outputs an impression-off instruction, a throw-off instruction for the ink form rollers, and a throw-off instruction for the dampening form roller to the printing unit 133 (steps S103, S104, and S105).

That is, the blanket cylinder 9 is thrown off from the plate cylinder 8 and the impression cylinder 10 based on the impression-off instruction. The ink form rollers 6-1 to 6-4 are thrown off and separated from the printing plate 7 based on the throw-off instruction for the ink form rollers. Additionally, the dampening form roller 12 is thrown off and separated from the printing plate 7 based on the throw-off instruction for the dampening form roller. The CPU 101 also outputs a stop signal to the drive motor driver 111 (step S106) to stop the drive motor 110. Accordingly, the printing press stops (FIG. 7: step S1).

[Transfer of Image Area Ratio of Printing Plate of Preceding Print Job]

Figure 13B:
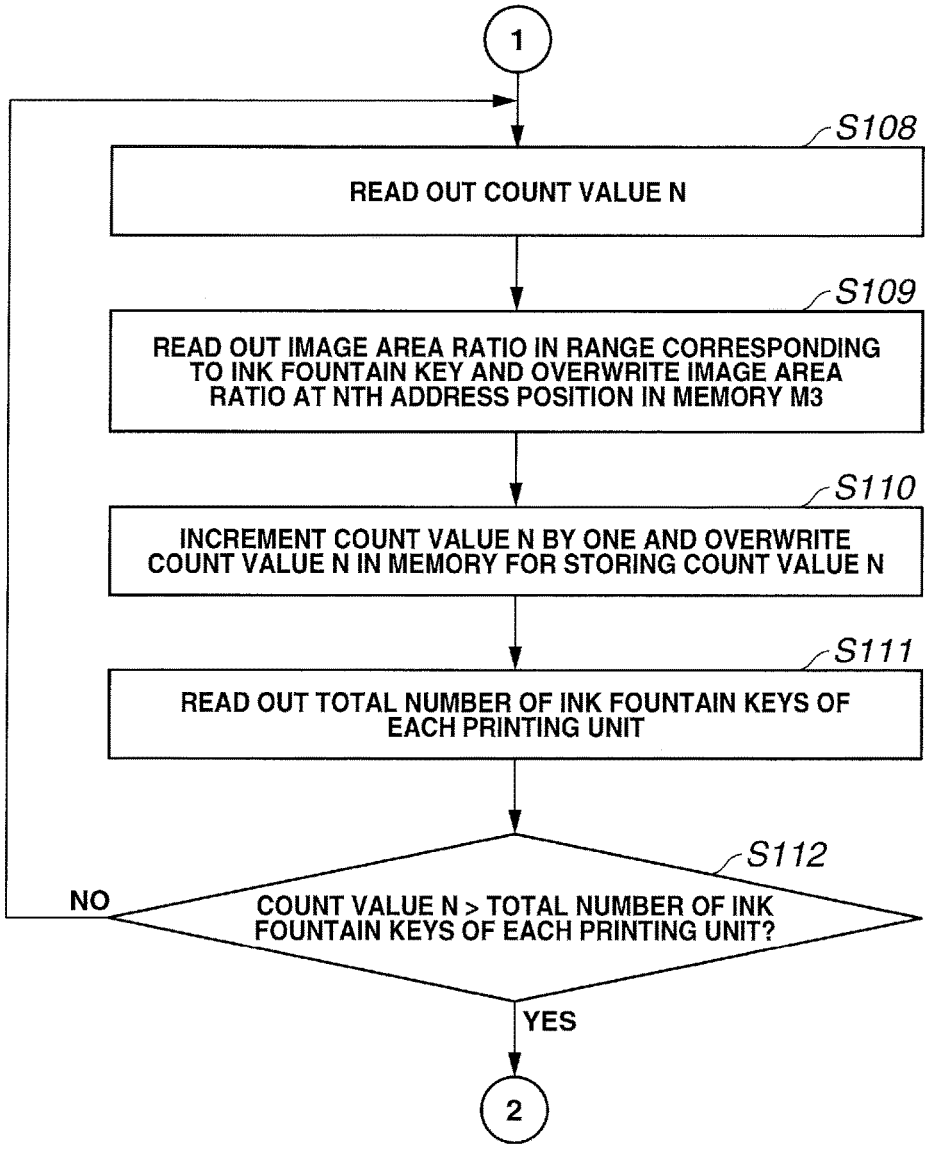

The CPU 101 sets the count value N in the memory M1 to 1 (step S107), reads out the count value N from the memory M1 (FIG. 13B: step S108), reads out the image area ratio (the image area ratio in the area of the printing plate 7 used in the preceding print job corresponding to the Nth ink fountain key) at the Nth address position in the memory M2, and writes the image area ratio at the Nth address position in the memory M3 as the image area ratio in the area of the preceding print job corresponding to the Nth ink fountain key (step S109).

The count value N in the memory M1 is incremented by one (step S110), the total number n of ink fountain keys is read out from the memory M4 (step S111), and the processing operation in steps S108 to S112 is repeated until the count value N exceeds the total number n of ink fountain keys (YES in step S112). The image area ratios S1*b* to Snb in the areas of the printing plate 7 used in the preceding print job corresponding to the ink fountain keys 4-1 to 4-n are thus read out from the memory M2 and stored in the memory M3 as the image area ratios S1*a* to Sna in the areas of preceding print job corresponding to the ink fountain keys 4-1 to 4-n.

[Density Measurement]

Figure 13C:
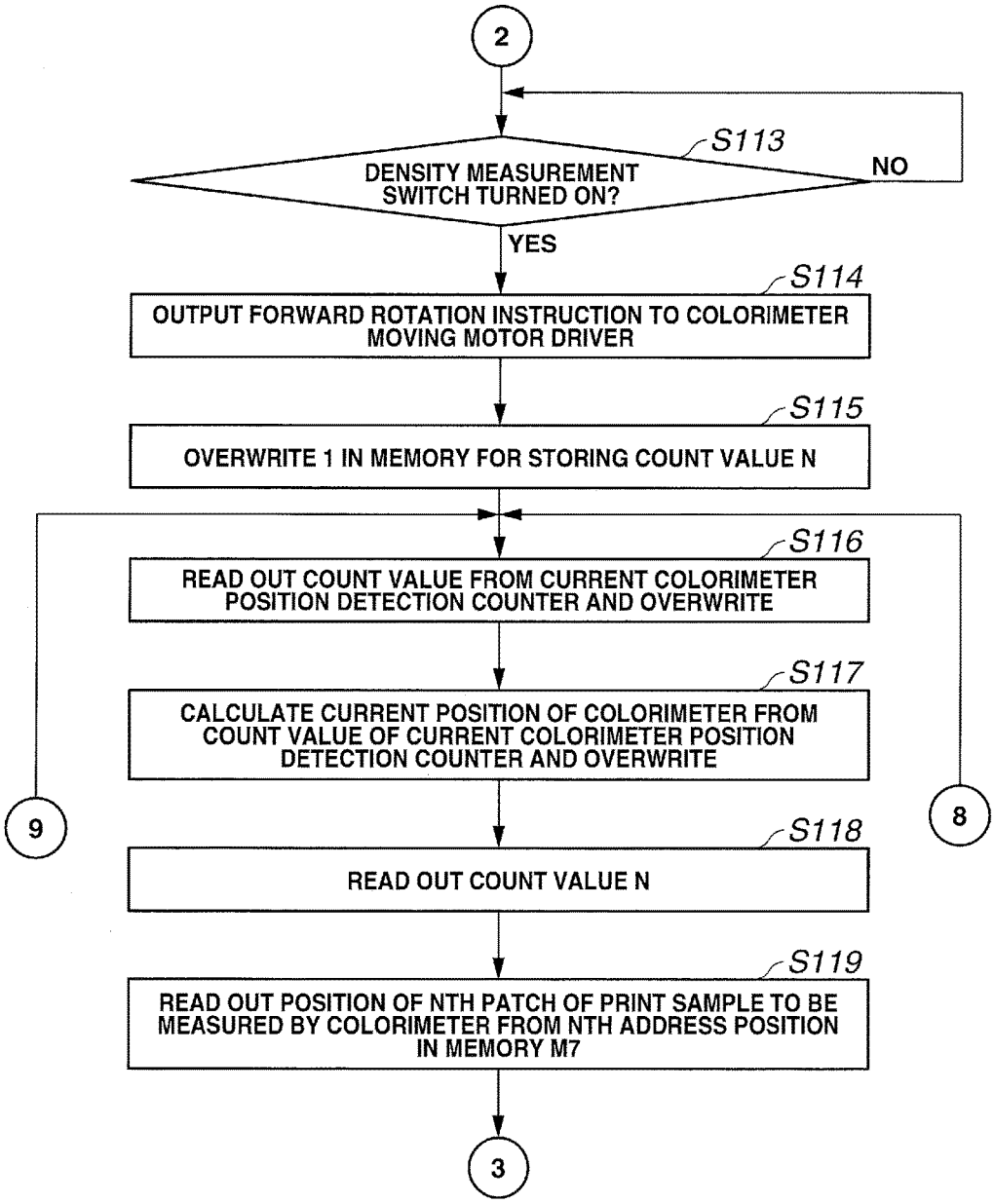

The operator extracts one sheet out of the printed product printed by the preceding print job and sets it on the measurement table 20-4 (FIG. 6) as the print sample 11. In this set state, a color bar 11-2 of the print sample 11 is located under the head portion 117-1 of the colorimeter 117. In this state, the operator turns on the density measurement switch 109. When the density measurement switch 109 is turned on (FIG. 13C: YES in step S113), the CPU 101 starts density measurement processing.

[Color Data Extraction]

In the density measurement processing, the CPU 101 outputs a forward rotation signal to the colorimeter moving motor driver 120 to rotate the colorimeter moving motor 118 in the forward direction (step S114). By the forward rotation of the colorimeter moving motor 118, the ball screw 20-3 rotates in the forward direction, and the colorimeter 117 moves from the home position where it is in contact with the column 20-1 toward the column 20-2 while being guided by the ball screw 20-3.

Figure 13D:
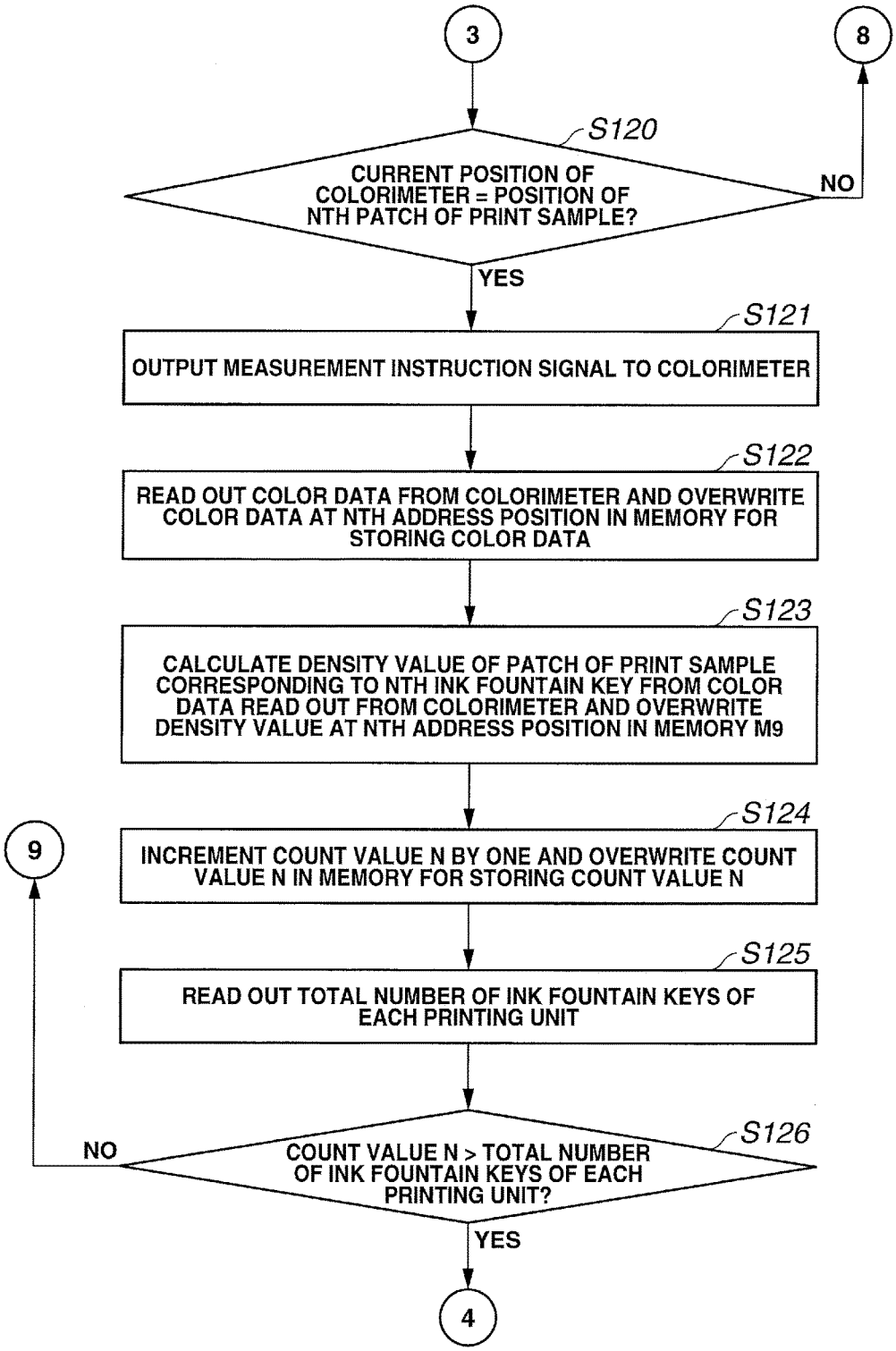

The CPU 101 sets the count value N in the memory M1 to N=1 (step S115), reads out the count value from the current colorimeter position detection counter 121 and stores count value in the memory M5 (step S116), calculates the current position of the colorimeter 117 from the readout count value and stores the current position in the memory M6 (step S117), reads out the count value N in the memory M1 (step S118), and reads out the position of the Nth patch of the print sample to be measured in the memory M7 (step S119). When the current position of the colorimeter 117 reaches the readout position of the Nth patch (FIG. 13D: YES in step S120), the CPU 101 outputs a measurement instruction signal to the colorimeter 117 (step S121), causes the colorimeter 117 to extract the color data of a patch 11*a* of the print sample 11 located at that position via the A/D converter 122, and stores the extracted color data at the Nth address position in the memory M8 (step S122).

Next, the CPU 101 calculates a density value DN of a patch of the print sample 11 corresponding to the Nth ink fountain key from the color data extracted in step S122, and stores the density value DN at the Nth address position in the memory M9 (step S123). The count value N in the memory M1 is incremented by one (step S124), the total number n of ink fountain keys is read out from the memory M4 (step S125), and the processing operation in steps S116 to S126 is repeated until the count value N exceeds the total number n of ink fountain keys (YES in step S126). Accordingly, every time the colorimeter reaches the position of the Nth patch stored in the memory M7, the color data of the patch 11*a* of the print sample 11 located at that position is extracted by the colorimeter 117, and the extracted color data is stored in the memory M8. In addition, the density values D1 to Dn calculated from the color data are stored in the memory M9.

Figure 13E:
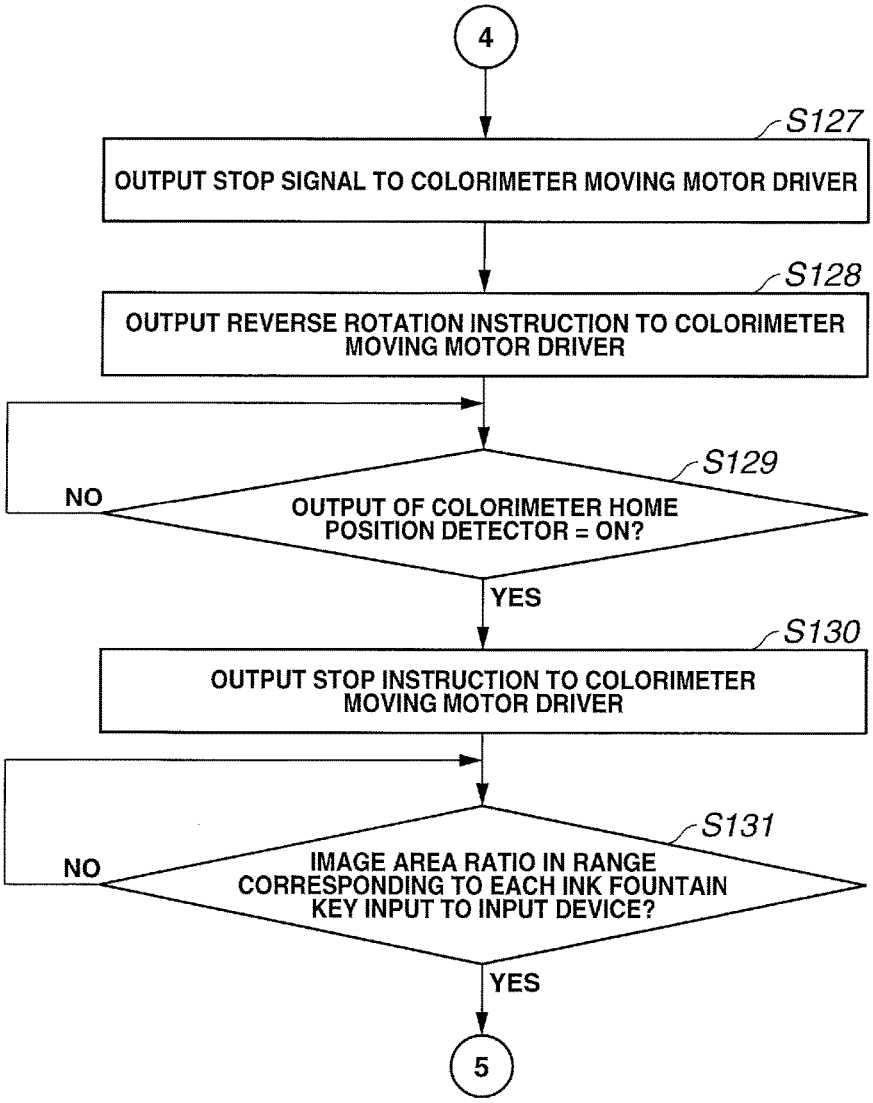

When color data extraction from the print sample 11 is completed (YES in step S126), the CPU 101 stops the forward rotation of the colorimeter moving motor 118 (FIG. 13E: step S127). The CPU 101 rotates the colorimeter moving motor 118 in the reverse direction (step S128). After the output of the colorimeter home position detector 123 changes to ON (YES in step S129), and the colorimeter 117 returns to the home position, the CPU 101 stops the reverse rotation of the colorimeter moving motor 118 (step S130).

[Input of Image Area Ratio of Printing Plate of Next Print Job]

Next, the CPU 101 stores, in the memory M2, the image area ratios in ranges of the printing plate 7' corresponding to the ink fountain keys 4-1 to 4-n, which are input from the input device 104. Note that in this embodiment, to measure the image area ratios in the areas of the printing plate 7' corresponding to the ink fountain keys 4-1 to 4-n, an "image area ratio measuring device" as described in patent literature 5 or 6 by the present applicant is used. An image area ratio measured using the "image area ratio measuring device" is written in a portable memory, and the portable memory with the image area ratio written in it is set in the input device 104, thereby inputting the image area ratio in the area of the printing plate 7' corresponding to each of the ink fountain keys 4-1 to 4-n. Note that the CPU 101 and the "image area ratio measuring device" may be connected online, and the image area ratios in the areas of the printing plate 7' corresponding to the ink fountain keys 4-1 to 4-n may directly be loaded from the "image area ratio measuring device".

Figure 13F:
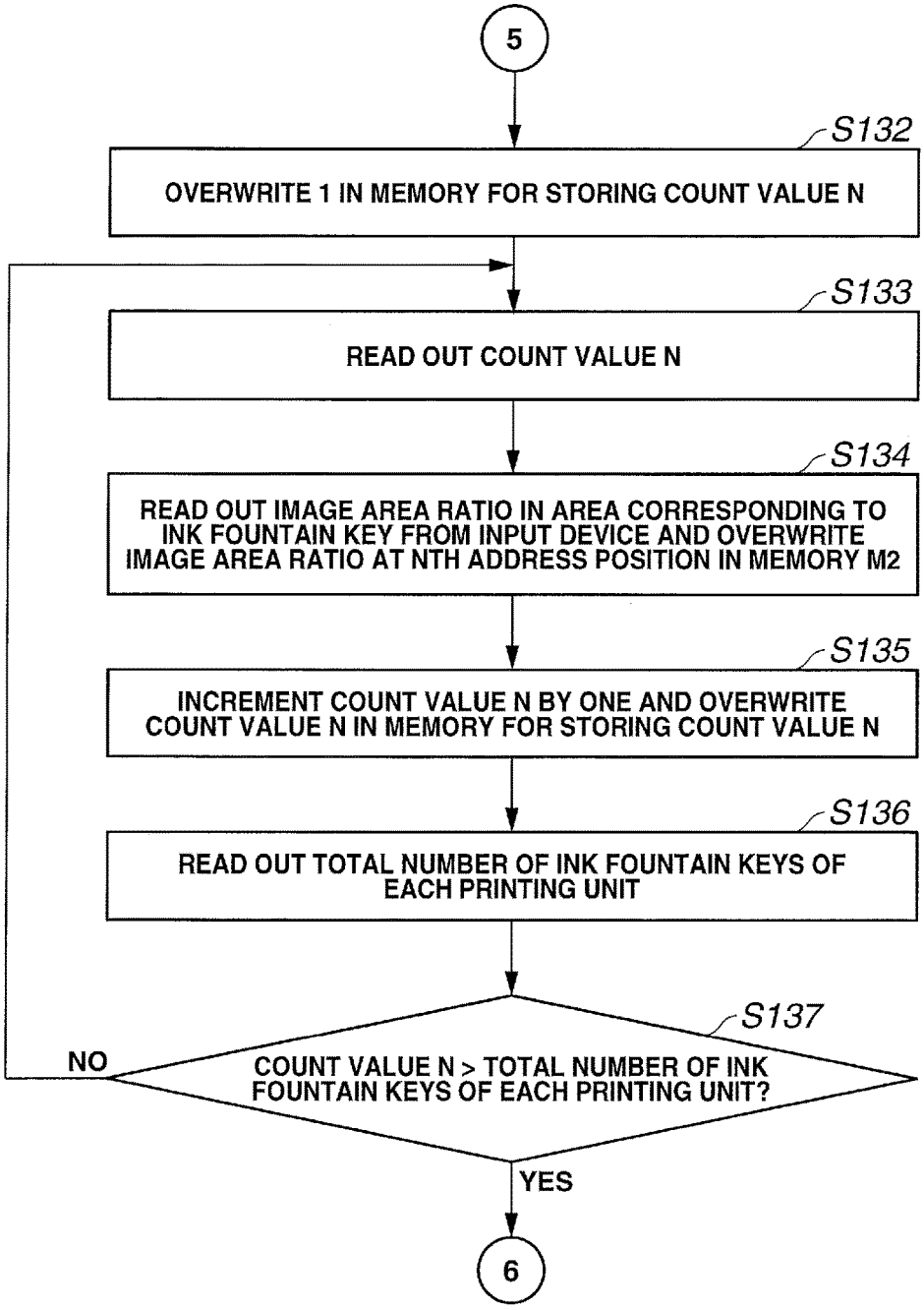

When the portable memory is set in the input device 104, that is, when the image area ratio in the area of the printing plate 7' corresponding to one of the ink fountain keys 4-1 to 4-n is input (YES in step S131), the CPU 101 sets the count value N in the memory M1 to 1 (FIG. 13F: step S132), reads out the count value N from the memory M1 (step S133), reads out the image area ratio in the area of the printing plate 7' corresponding to the Nth ink fountain key from the portable memory, and stores it at the Nth address position in the memory M2 (step S134).

The count value N in the memory M1 is incremented by one (step S135), the total number n of ink fountain keys is read out from the memory M4 (step S136), and the processing operation in steps S133 to S137 is repeated until the count value N exceeds the total number n of ink fountain keys (YES in step S137). The image area ratios in the areas of the printing plate 7' corresponding to the ink fountain keys 4-1 to 4-n are thus read out from the portable memory and stored in the memory M2 as the image area ratios S1*b* to Snb in the areas of the next print job corresponding to the ink fountain keys 4-1 to 4-n.

[Plate Exchange/Cleaning]

On the other hand, in the state in which the printing press is stopped, and the ink form rollers 6-1 to 6-4 and the dampening form roller 12 are thrown off (FIG. 7: step S1), the operator exchanges the printing plate 7 mounted on the plate cylinder 8 with the printing plate 7' of the next print job, and cleans the blanket cylinder 9 (FIG. 7: step S2).

[Division of Ink Roller Group]

Figure 13G:
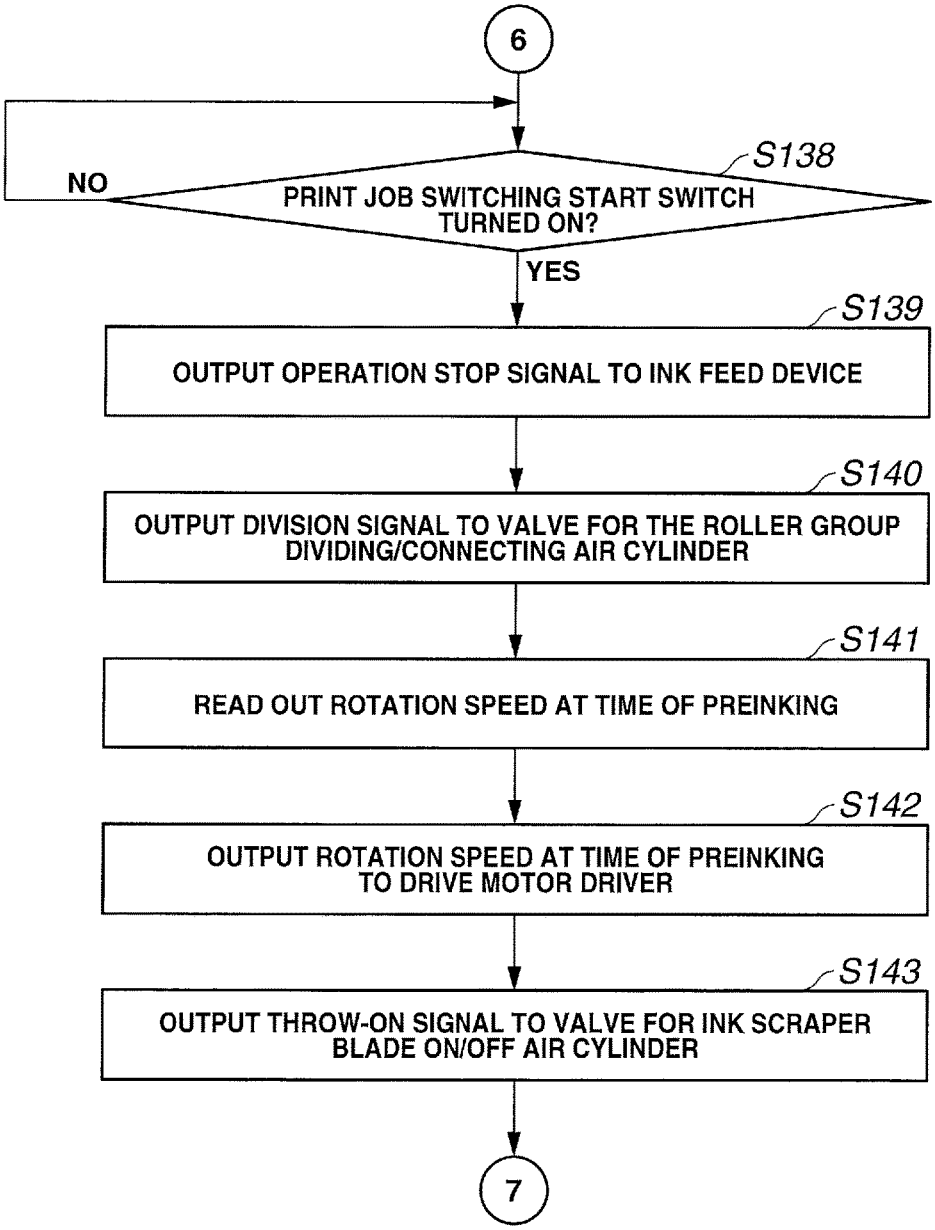

When the print job switching start switch 108 is turned on (FIG. 13G: YES in step S138), the CPU 101 outputs an operation stop signal to the ink feed device 116 (step S139) to stop the feed operation of the ink ductor roller 5. The CPU 101 outputs a division signal to the valve 125 for roller group dividing/connecting air cylinder (step S140) to divide the ink roller group 6 into the roller subgroup 6A on the upstream side and the roller subgroup 6B on the downstream side (see FIG. 3).

The ink film thickness distribution Mc on the ink roller group 6 is thus divided into the ink film thickness distribution McA on the roller subgroup 6A on the upstream side and the ink film thickness distribution McB on the roller subgroup 6B on the downstream side, as indicated by step S3 in FIG. 7.

[Ink Scraping in Roller Subgroup on Upstream Side]

Next, the CPU 101 reads out the rotation speed Vpr at the time of preinking from the memory M10 (step S141), and outputs the rotation speed Vpr at the time of preinking to the drive motor driver 111 via the D/A converter 113 (step S142). Accordingly, the printing press starts rotating, and its speed increases up to the rotation speed Vpr at the time of preinking.

Figure 4:
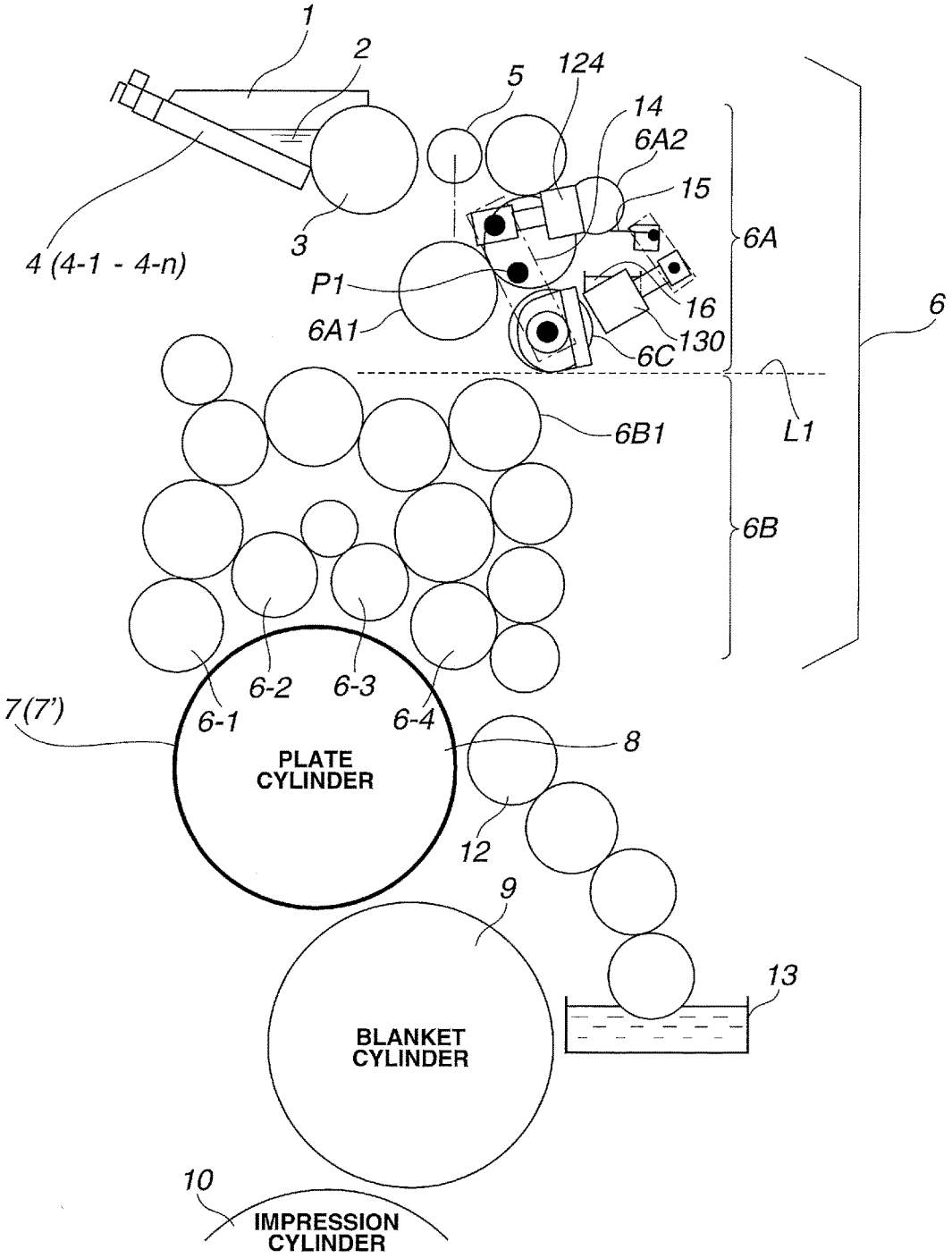
FIG. 4 is a view showing the main part of the ink supply device in the printing unit controlled by the print job switching control device (a state in which the ink roller group is divided, and ink in a roller subgroup on the upstream side is scraped by a blade)

The CPU 101 outputs a throw-on signal to the valve 131 for ink scraper blade on/off air cylinder (step S143). Accordingly, the ink scraper blade on/off air cylinder 130 retracts to bring the ink scraper blade 15 into contact with the outer surface of the roller 6A2, as shown in FIG. 4, and scraping of the ink (removal of the ink) in the roller subgroup 6A on the upstream side starts.

Figure 13H:
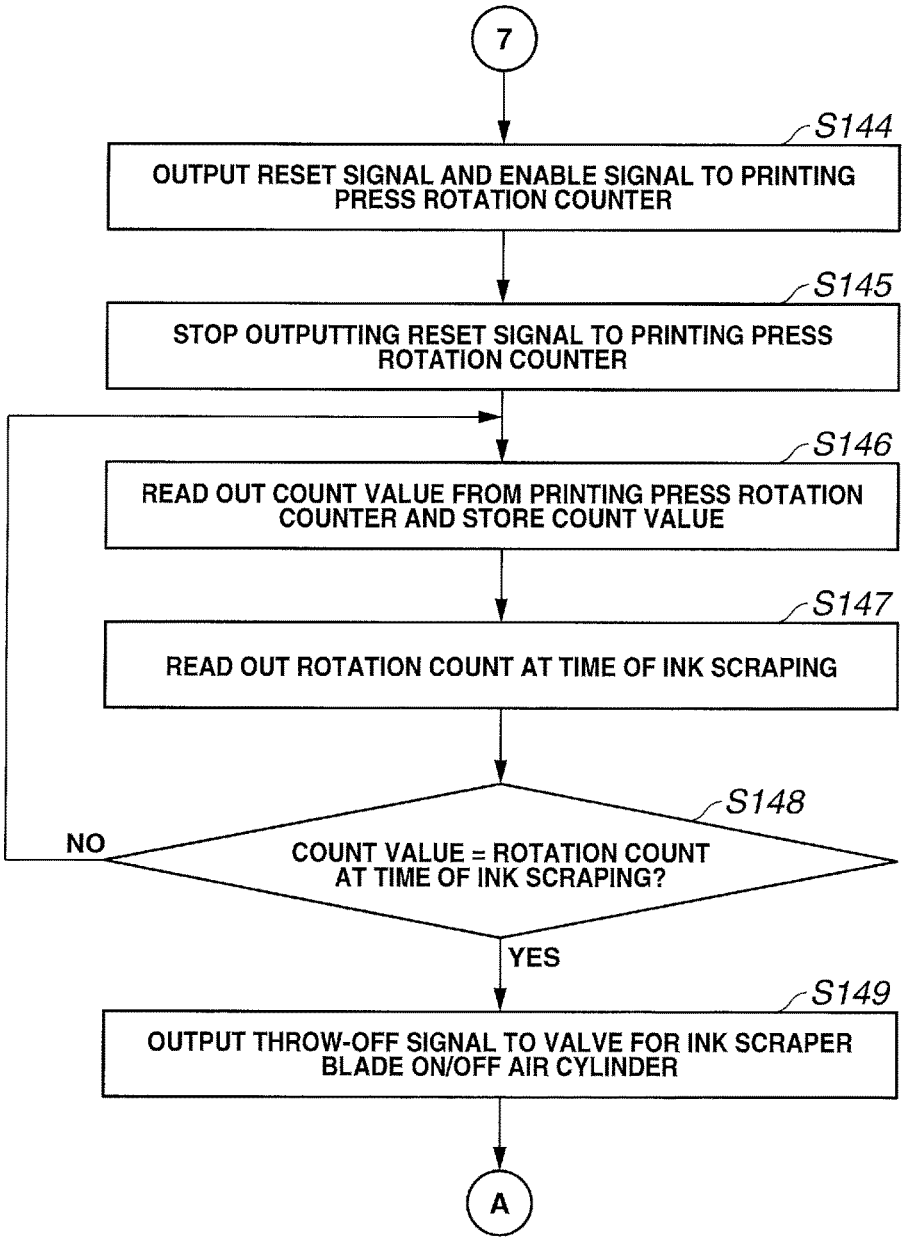

The CPU 101 continues the removal of the ink in the roller subgroup 6A on the upstream side until the rotation count of the printing press reaches the rotation count N1 at the time of ink scraping in the memory M12. That is, after outputting the throw-on signal to the valve 131 for ink scraper blade on/off air cylinder (step S143), the CPU 101 outputs a reset signal and an enable signal to the printing press rotation counter 115 (FIG. 13H: step S144), stops outputting the reset signal to the printing press rotation counter 115 (step S145), and causes the printing press rotation counter 115 to start the count operation from zero. The CPU 101 reads out the count value from the printing press rotation counter 115 and stores it in the memory M11 (step S146), reads out the rotation count N1 at the time of ink scraping in the memory M12 (step S147), and repeats the processing operation in steps S146 to S148 until the count value of the printing press rotation counter 115 reaches the rotation count N1 at the time of ink scraping (YES in step S148).

When the count value of the printing press rotation counter 115 reaches the rotation count N1 at the time of ink scraping (YES in step S148), the CPU 101 outputs a throw-off signal to the valve 131 for ink scraper blade on/off air cylinder (step S149), thereby completing the removal of the ink in the roller subgroup 6A on the upstream side.

Accordingly, the ink film thickness distribution McA on the roller subgroup 6A on the upstream side becomes almost zero, as indicated by step S4 in FIG. 7. At this time, the ink film thickness distribution on the roller subgroup 6B on the downstream side is evened by the rotation count N1 at the time of ink scraping and changes to the flat ink film thickness distribution McB'.

In step S4, ink scraping is executed assuming that the printed product of the preceding print job is printed at the reference density. For this reason, if the printed product of the preceding print job is not printed at the reference density, an excess or deficiency occurs in the ink left on the roller subgroup 6A on the upstream side. Additionally, since the ink scraper blade 15 scrapes the ink evenly in the roller width direction, the ink film thickness distribution MaA' after removing is an ink film thickness distribution affected by the unevenness of the ink film thickness caused by the difference in the image area ratio in the area corresponding to the ink fountain keys 4-1 to 4-n an ink film thickness distribution formed by removing the ink while cutting into the reference ink film thickness distribution corresponding to a portion where the image area ratio is zero.

[Setting of Corrected Opening Amounts of Ink Fountain Keys Corresponding to Image on Printing Plate of Next Print Job (Setting of Opening Amounts of Ink Fountain Keys in Preinking)]

Figure 13I:
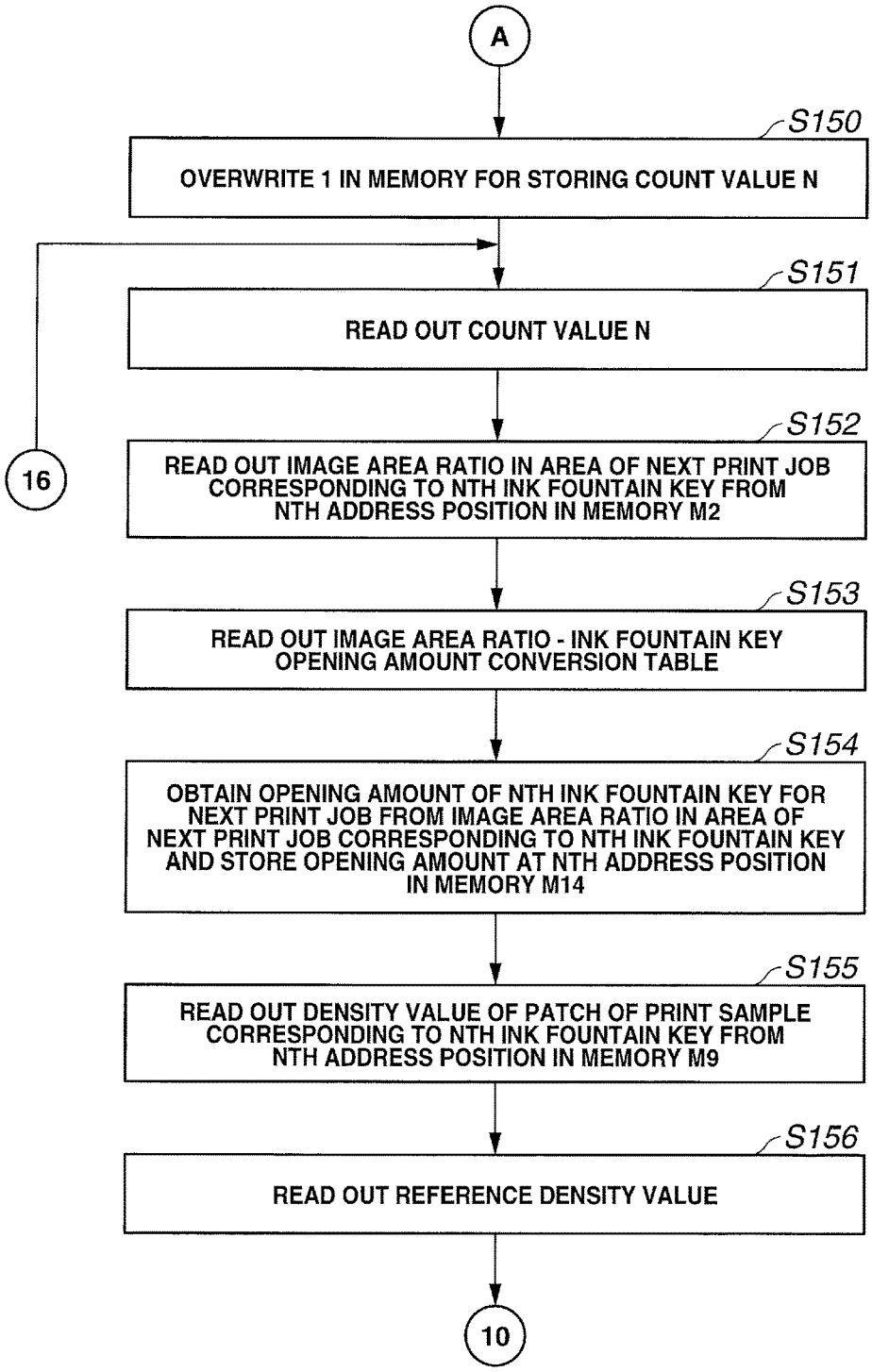

Next, the CPU 101 sets the count value N in the memory M1 to 1 (FIG. 13I: step S150), reads out the count value N from the memory M1 (step S151), and reads out an image area ratio SNb in the area of the next print job corresponding to the Nth ink fountain key from the Nth address position in the memory M2 (step S152).

The CPU 101 then reads out the image area ratio—ink fountain key opening amount conversion table in the memory M13 (step S153). Using the image area ratio—ink fountain key opening amount conversion table, the CPU 101 obtains an opening amount θNb of the Nth ink fountain key for the next print job (the opening amount of the Nth ink fountain key corresponding to the image of the printing plate 7' of the next print job) from the image area ratio SNb in the area of the next print job corresponding to the Nth ink fountain key, and stores the obtained opening amount θNb of the Nth ink fountain key for the next print job at the Nth address position in the memory M14 (step S154).

Figure 13J:
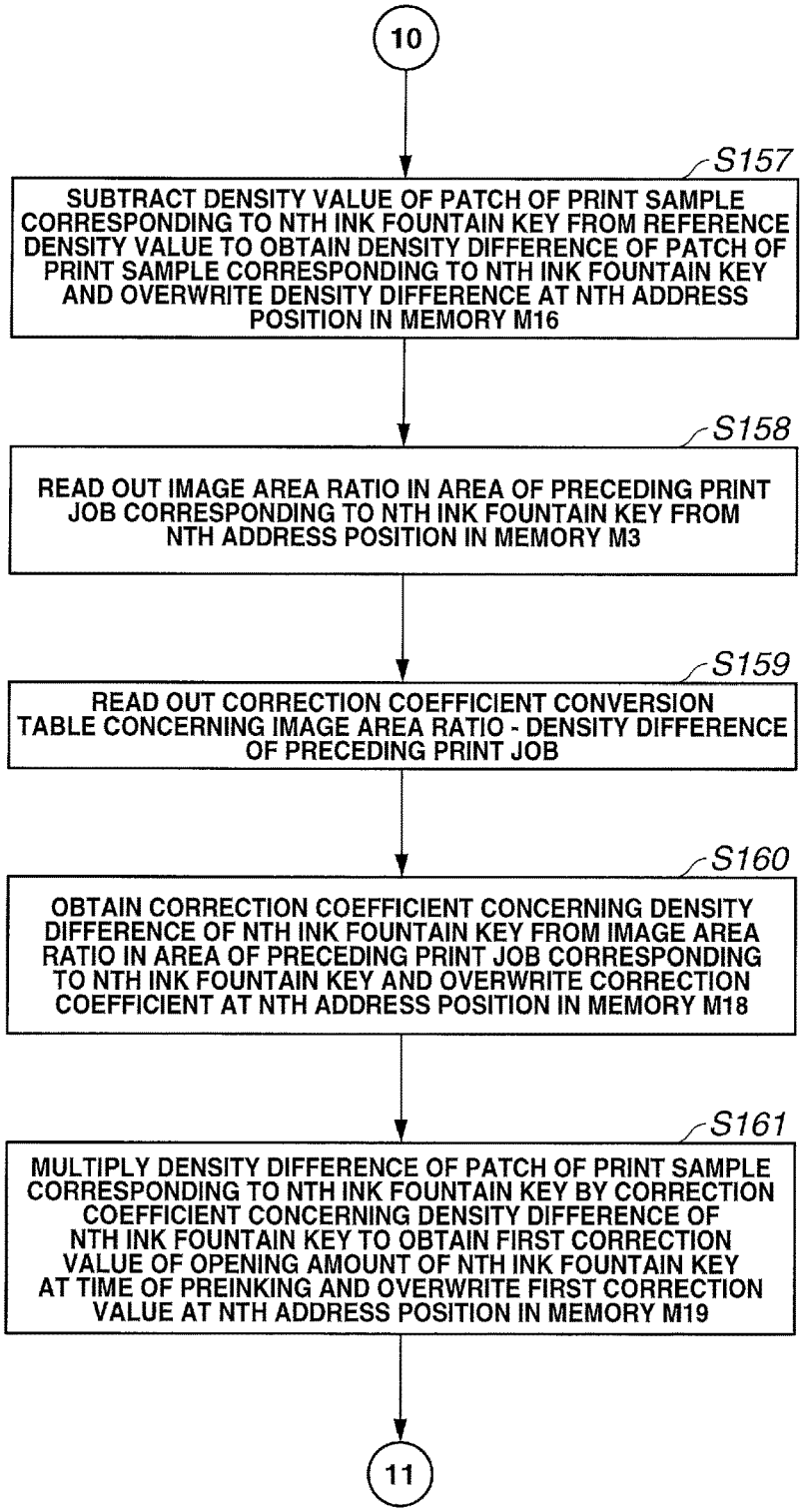

Next, the CPU 101 reads out the density value DN of the patch of the print sample corresponding to the Nth ink fountain key from the Nth address position in the memory M9 (step S155), reads out the reference density value DR from the memory M15 (step S156), subtracts the density value DN of the patch of the print sample corresponding to the Nth ink fountain key from the reference density value DR to obtain the density difference ΔDN of the patch of the print sample corresponding to the Nth ink fountain key, and stores the density difference at the Nth address position in the memory M16 (FIG. 13J: step S157).

The CPU 101 then reads out an image area ratio SNa in the area of the preceding print job corresponding to the Nth ink fountain key from the Nth address position in the memory M3 (step S158), reads out the correction coefficient conversion table concerning image area ratio—density difference of the preceding print job in the memory M17 (step S159), obtains a correction coefficient αN concerning the density difference of the Nth ink fountain key from the image area ratio SNa in the area of the preceding print job corresponding to the Nth ink fountain key using the correction coefficient conversion table concerning image area ratio—density difference of the preceding print job, and stores the correction coefficient at the Nth address position in the memory M18 (step S160).

The CPU 101 multiplies the density difference ΔDN of the patch of the print sample corresponding to the Nth ink fountain key obtained in step S157 by the correction coefficient αN concerning the density difference of the Nth ink fountain key obtained in step S160 to obtain a first correction value Δθ1N of the opening amount of the Nth ink fountain key at the time of preinking, and stores the first correction value at the Nth address position in the memory M19 (step S161).

Figure 13K:
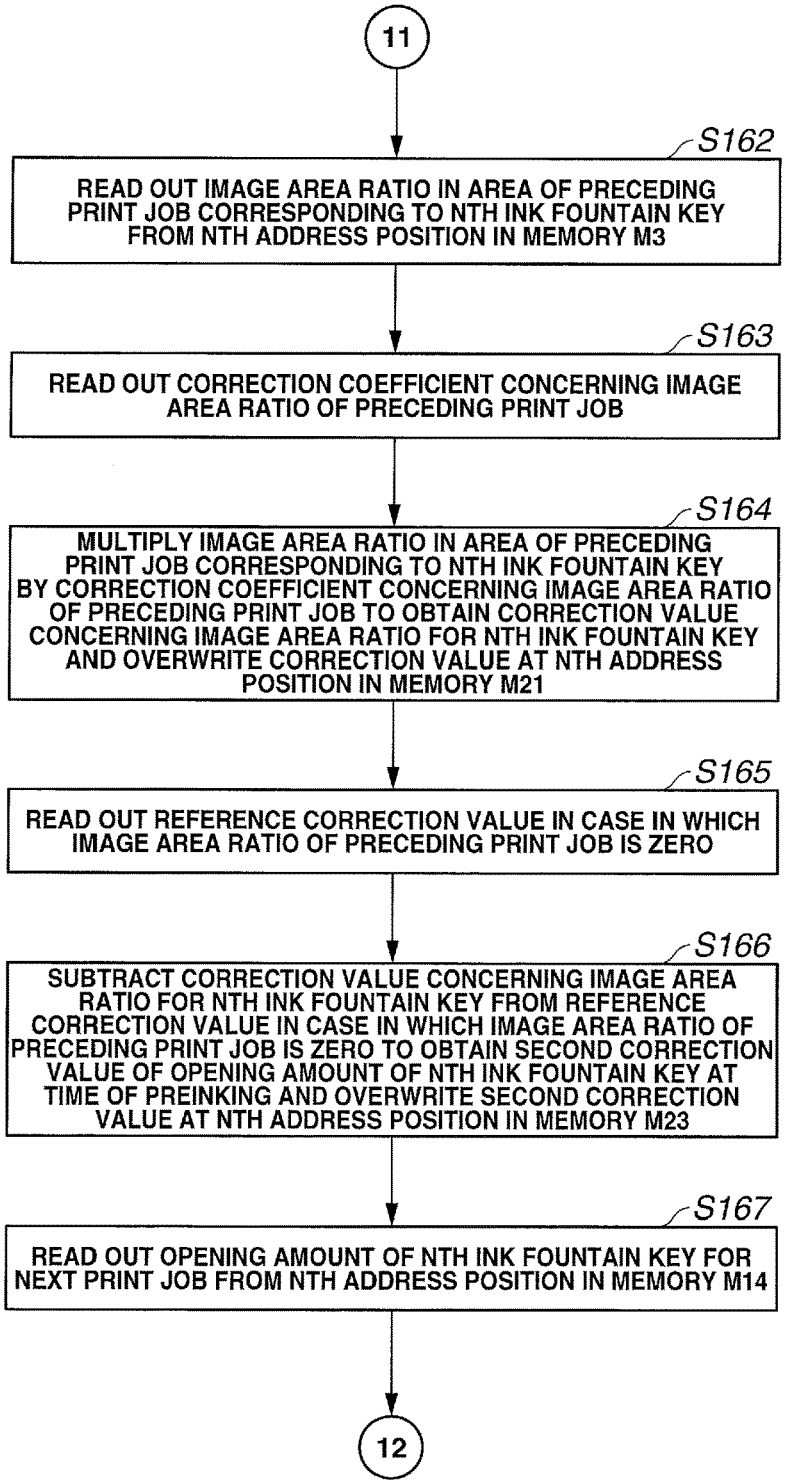

Next, the CPU 101 then reads out the image area ratio SNa in the area of the preceding print job corresponding to the Nth ink fountain key from the Nth address position in the memory M3 (FIG. 13K: step S162), reads out a correction coefficient β concerning the image area ratio of the preceding print job from the memory M20 (step S163), multiplies the image area ratio SNa in the area of the preceding print job corresponding to the Nth ink fountain key by the correction coefficient β concerning the image area ratio of the preceding print job to obtain a correction value KAN of the opening amount of the Nth ink fountain key concerning the image area ratio of the preceding print job, and stores the correction value at the Nth address position in the memory M21 (step S164).

The CPU 101 reads out the reference correction value KA0 in a case in which the image area ratio of the preceding print job is zero from the memory M22 (step S165), subtracts the correction value KAN of the opening amount of the Nth ink fountain key concerning the image area ratio of the preceding print job from the reference correction value KA0 in the case in which the image area ratio of the preceding print job is zero to obtain a second correction value Δθ2N of the opening amount of the Nth ink fountain key at the time of preinking, and stores the second correction value at the Nth address position in the memory M23 (step S166).

Figure 13L:
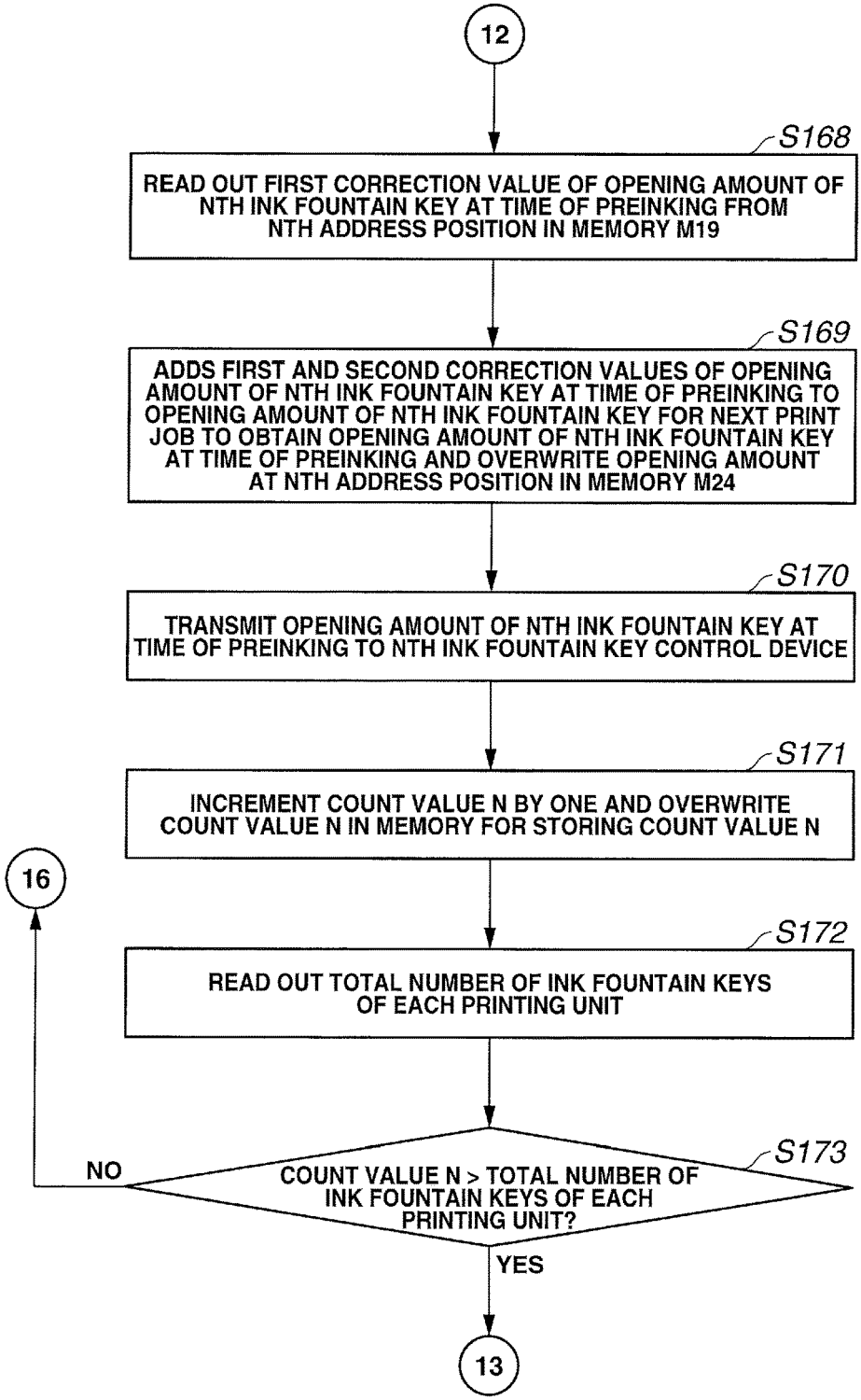

The CPU 101 then reads out the opening amount θNb of the Nth ink fountain key for the next print job from the Nth address position in the memory M14 (step S167), reads out the first correction value Δθ1N of the opening amount of the Nth ink fountain key at the time of preinking from the Nth address position in the memory M19 (FIG. 13L: step S168), adds the readout first correction value Δθ1N of the opening amount of the Nth ink fountain key at the time of preinking and the second correction value Δθ2N of the opening amount of the Nth ink fountain key at the time of preinking obtained in step S166 to the opening amount θNb of the Nth ink fountain key for the next print job to obtain an opening amount θNb' (θNb'=θNb+Δθ1N+Δθ2N) of the Nth ink fountain key at the time of preinking, stores the opening amount θNb' at the Nth address position in the memory M24 (step S169), and also transmits it to the Nth ink fountain key control device 300 (step S170).

Figure 10B:
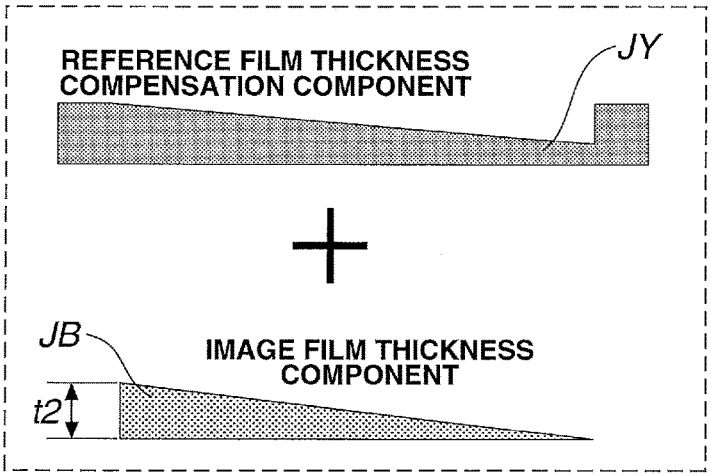
FIG. 10B is a view showing an image film thickness component JB of the job B and a reference film thickness compensation component JY corresponding to an ink removal component J1.

The opening amount θNb of the Nth ink fountain key for the next print job corresponds to the image film thickness component JB of the job B described with reference to FIG. 10B, the first correction value Δθ1N of the opening amount of the Nth ink fountain key at the time of preinking corresponds to the correction component JX according to the density of the printed product printed by the preceding print job, and the second correction value Δθ2N of the opening amount of the Nth ink fountain key at the time of preinking corresponds to the reference film thickness compensation component JY described with reference to FIG. 10B. Hence, the opening amount θNb' (θNb'=θNb+Δθ1N+Δθ2N) of the Nth ink fountain key at the time of preinking corresponds to a film thickness component "JB+JX+JY" generated by adding the image film thickness component JB of the job B, the correction component JX according to the density of the printed product printed by the preceding print job, and the reference film thickness compensation component JY.

Then, the CPU 101 increments the count value N in the memory M1 by one (step S171), reads out the total number n of ink fountain keys from the memory M4 (step S172), and repeats the processing operation in steps S151 to S173 until the count value N exceeds the total number n of ink fountain keys (YES in step S173).

The opening amounts θ1*b* to θnb of the ink fountain keys 4-1 to 4-n corresponding to the image in the areas of the printing plate 7' corresponding to the ink fountain keys 4-1 to 4-n are thus corrected by the first correction values $\Delta\theta 1_1$ to $\Delta\theta 1_n$ and the second correction values $\Delta\theta 2_1$ to $\Delta\theta 2_n$ of the opening amounts of the ink fountain keys at the time of preinking to obtain the opening amounts θ1*b*' to θnb' of the ink fountain keys at the time of preinking. The opening amounts θ1*b*' to θnb' of the ink fountain keys at the time of preinking are stored in the memory M24 and transmitted to the ink fountain key control devices 300-1 to 300-n.

[Confirmation of Completion of Setting of Opening Amounts of Ink Fountain Keys]

Figure 13M:
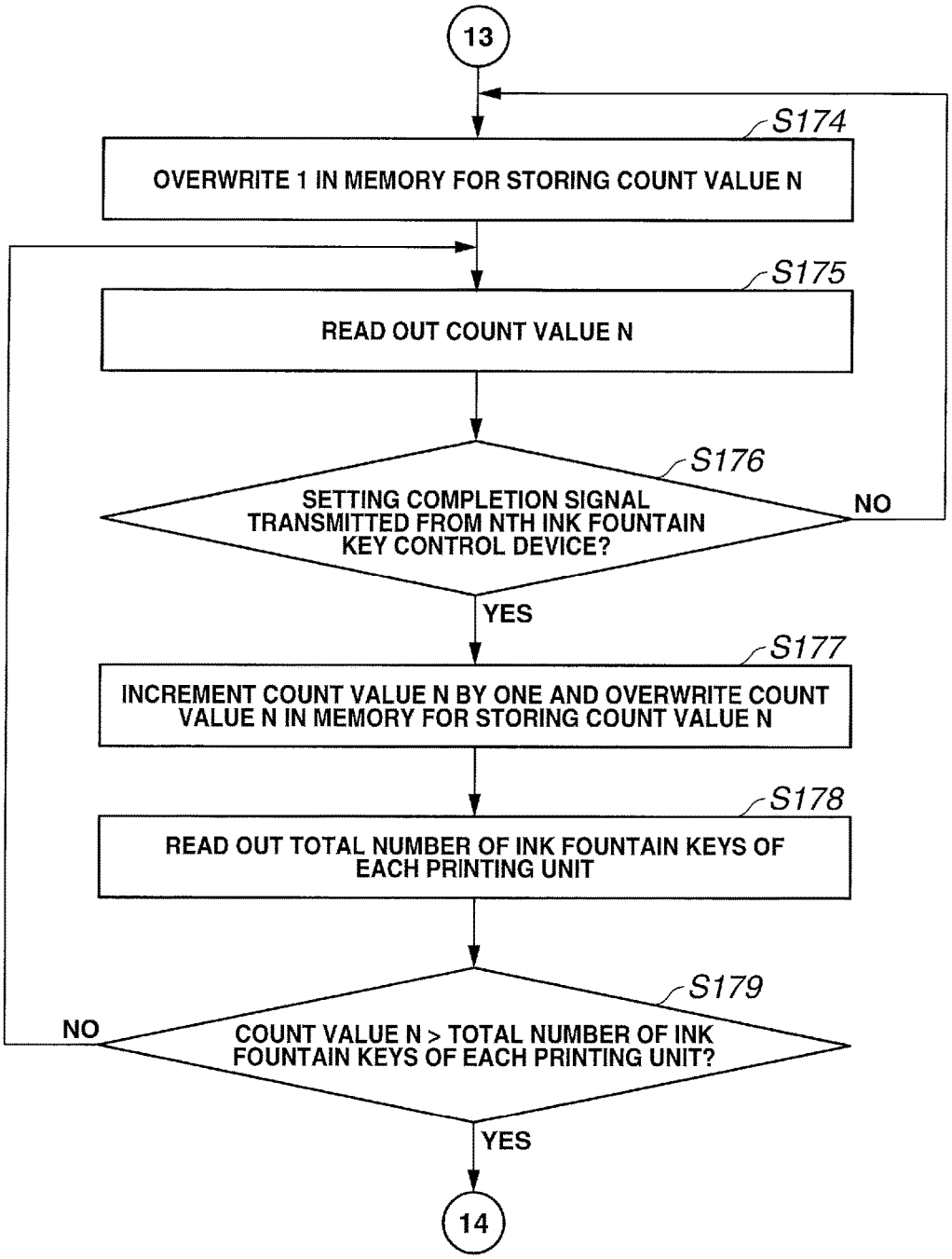

Next, the CPU 101 sets the count value N in the memory M1 to 1 (FIG. 13M: step S174), reads out the count value N from the memory M1 (step S175), and confirms the presence/absence of an ink fountain key opening amount setting completion signal from the Nth ink fountain key control device 300 (step S176).

If the ink fountain key opening amount setting completion signal is not transmitted from the Nth ink fountain key control device 300 (NO in step S176), the process returns to step S174 to set the count value N in the memory M1 to 1, and steps S175 and S176 are repeated.

If the ink fountain key opening amount setting completion signal is transmitted from the Nth ink fountain key control device 300 (YES in step S176), the CPU 101 increments the count value N in the memory M1 by one (step S177), reads out the total number n of ink fountain keys from the memory M4 (step S178), and compares the count value N with the total number n of ink fountain keys (step S179).

Figure 13N:
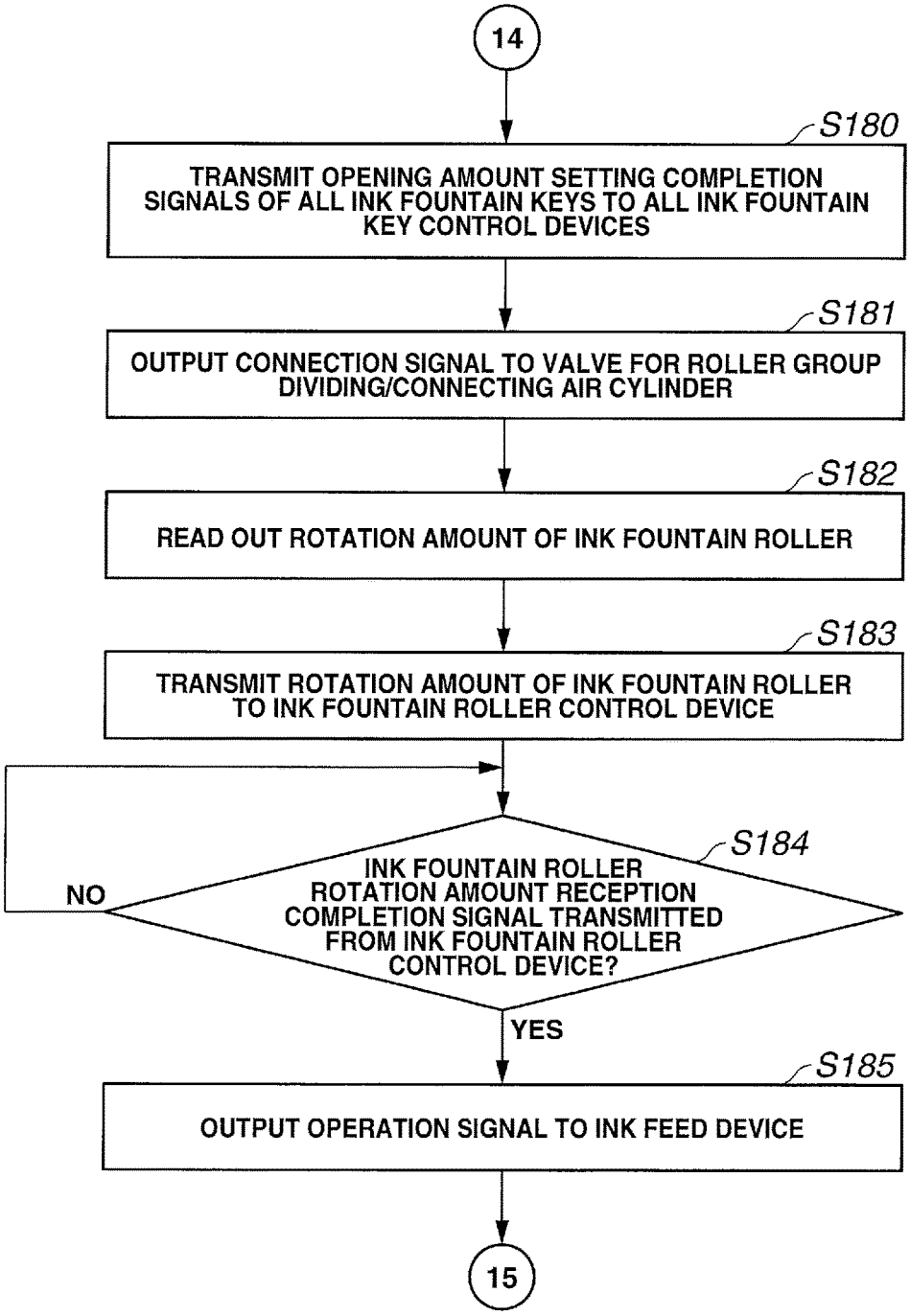

The CPU 101 repeats the processing operation in steps S175 to S179 until the count value N matches the total number n of ink fountain keys. If the count value N exceeds the total number n of ink fountain keys (YES in step S179), that is, upon confirming that the setting completion signals are transmitted from all the ink fountain key control devices 300, the CPU 101 determines that the setting of the opening amounts of the ink fountain keys is completed, and transmits the opening amount setting completion signals of all ink fountain keys to all the ink fountain key control devices 300 (300-1 to 300-n) (FIG. 13N: step S180).

[Connection of Ink Roller Group]

Next, the CPU 101 outputs a connection signal to the valve 125 for roller group dividing/connecting air cylinder (step S181) to connect the roller subgroup 6A on the upstream side and the roller subgroup 6B on the downstream side and return them to one ink roller group 6 (FIG. 7: step S5).

[Preinking (Formation of Ink Film Thickness Distribution)]

Next, the CPU 101 reads out the rotation amount of the ink fountain roller stored in the memory M25 (step S182), and transmits the readout rotation amount of the ink fountain roller to the ink fountain roller control device 200 (step S183).

Figure 13O:
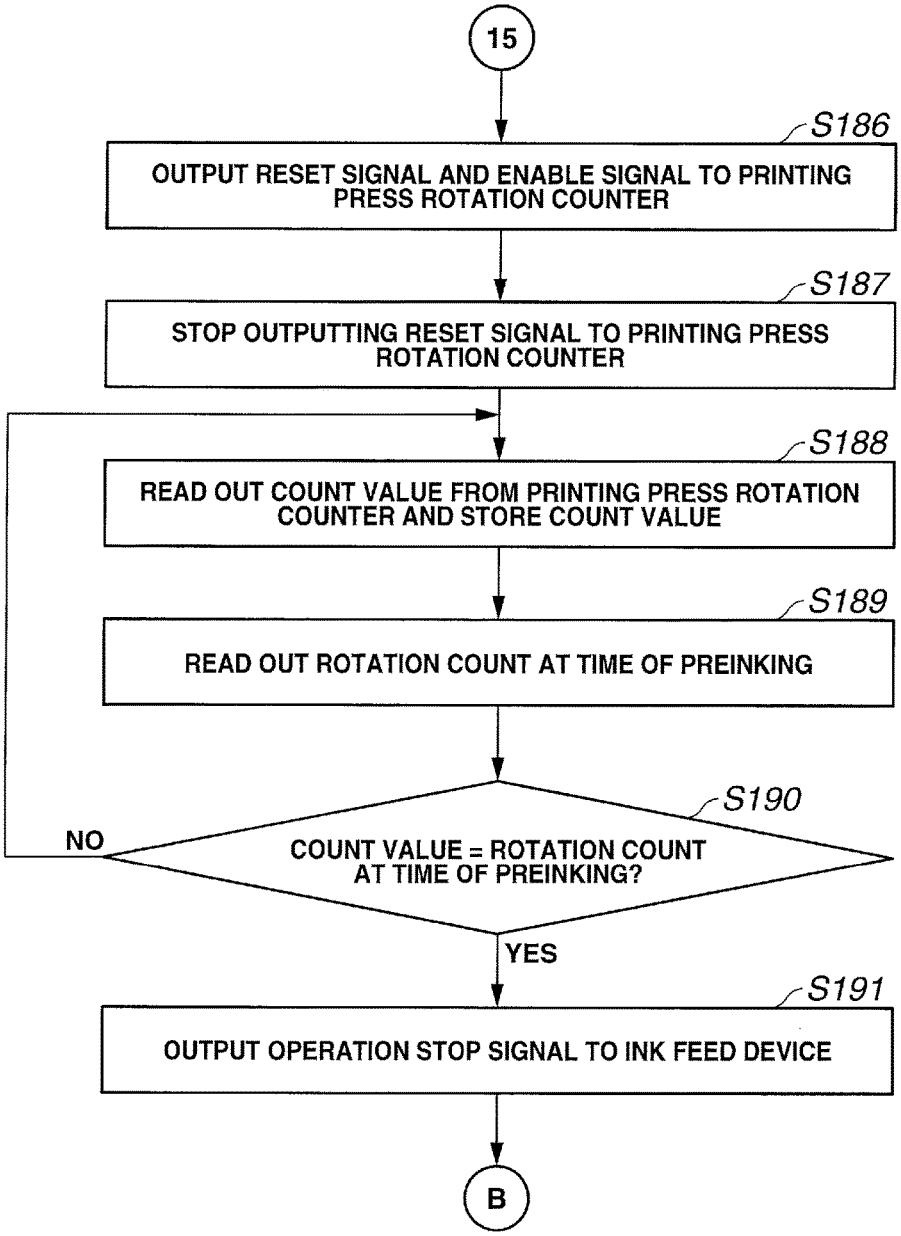

Upon receiving an ink fountain roller rotation amount reception completion signal from the ink fountain roller control device 200 (YES in step S184), the CPU 101 outputs an operation signal to the ink feed device 116 (step S185) to start the feed operation of the ink ductor roller 5. The CPU 101 continues the feed operation of the ink ductor roller 5 until the rotation count of the printing press reaches the rotation count N2 at the time of preinking in the memory M26 (steps S186 to S190 (FIG. 13O)).

That is, the CPU 101 outputs a reset signal and an enable signal to the printing press rotation counter 115 (step S186), stops outputting the reset signal to the printing press rotation counter 115 (step S187), and causes the printing press rotation counter 115 to start the count operation from zero. The CPU 101 reads out the count value from the printing press rotation counter 115 and stores it in the memory M11 (step S188), reads out the rotation count N2 at the time of preinking in the memory M26 (step S189), and repeats the processing operation in steps S188 to S190 until the count value of the printing press rotation counter 115 reaches the rotation count N2 at the time of preinking (YES in step S190).

Accordingly, the image film thickness component of the next print job, the correction component according to the density of the printed product printed by the preceding print job, and the reference film thickness compensation component are added to the ink film thickness component left on the ink roller group 6 after removing, and the ink film thickness distribution Md corresponding to the image of h printing plate 7' of the next print job is formed on the ink roller group 6 (FIG. 7: step S6).

When the count value of the printing press rotation counter 115 reaches the rotation count N2 at the time of preinking (YES in step S190), the CPU 101 outputs an operation stop signal to the ink feed device 116 to stop the feed operation of the ink ductor roller 5 (step S191).

[Setting to Opening Amounts of Ink Fountain Keys Corresponding to Image on Printing Plate of Next Print Job]

Figure 13P:
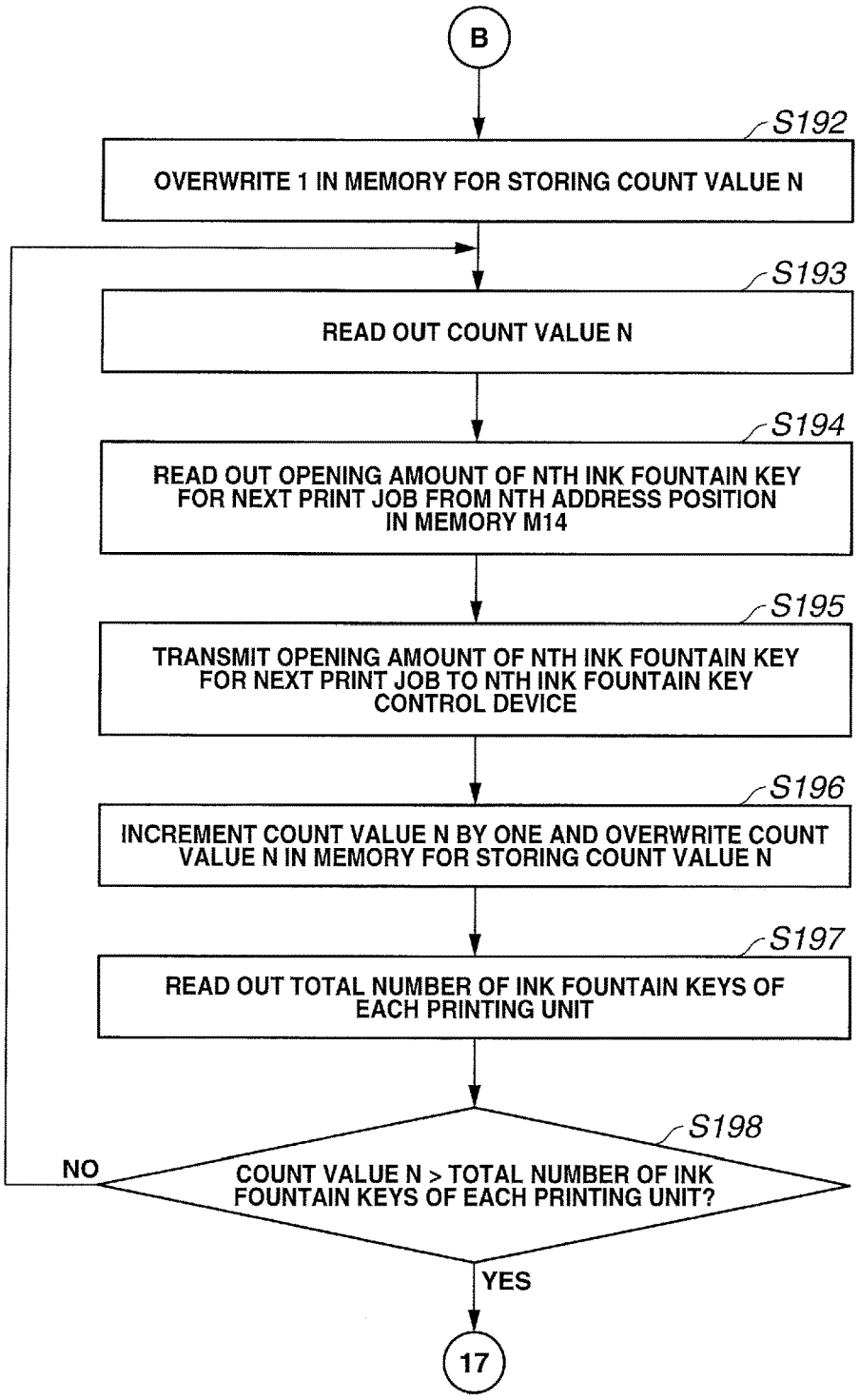

Next, the CPU 101 sets the count value N in the memory M1 to 1 (FIG. 13P: step S192), reads out the count value N from the memory M1 (step S193), reads out the opening amount θNb of the Nth ink fountain key for the next print job from the Nth address position in the memory M14 (step S194), and transmits it to the Nth ink fountain key control device 300 (step S195). The CPU 101 increments the count value N in the memory M1 by one (step S196), reads out the total number n of ink fountain keys from the memory M4 (step S197), and repeats the processing operation in steps S193 to S198 until the count value N exceeds the total number n of ink fountain keys (YES in step S198).

The opening amounts θ1*b* to θnb of the ink fountain keys 4-1 to 4-n corresponding to the image of the printing plate 7' of the next print job in the areas corresponding to the ink fountain keys 4-1 to 4-n are thus transmitted to the ink fountain key control devices 300-1 to 300-n.

[Confirmation of Completion of Setting of Opening Amounts of Ink Fountain Keys]

Figure 13Q:
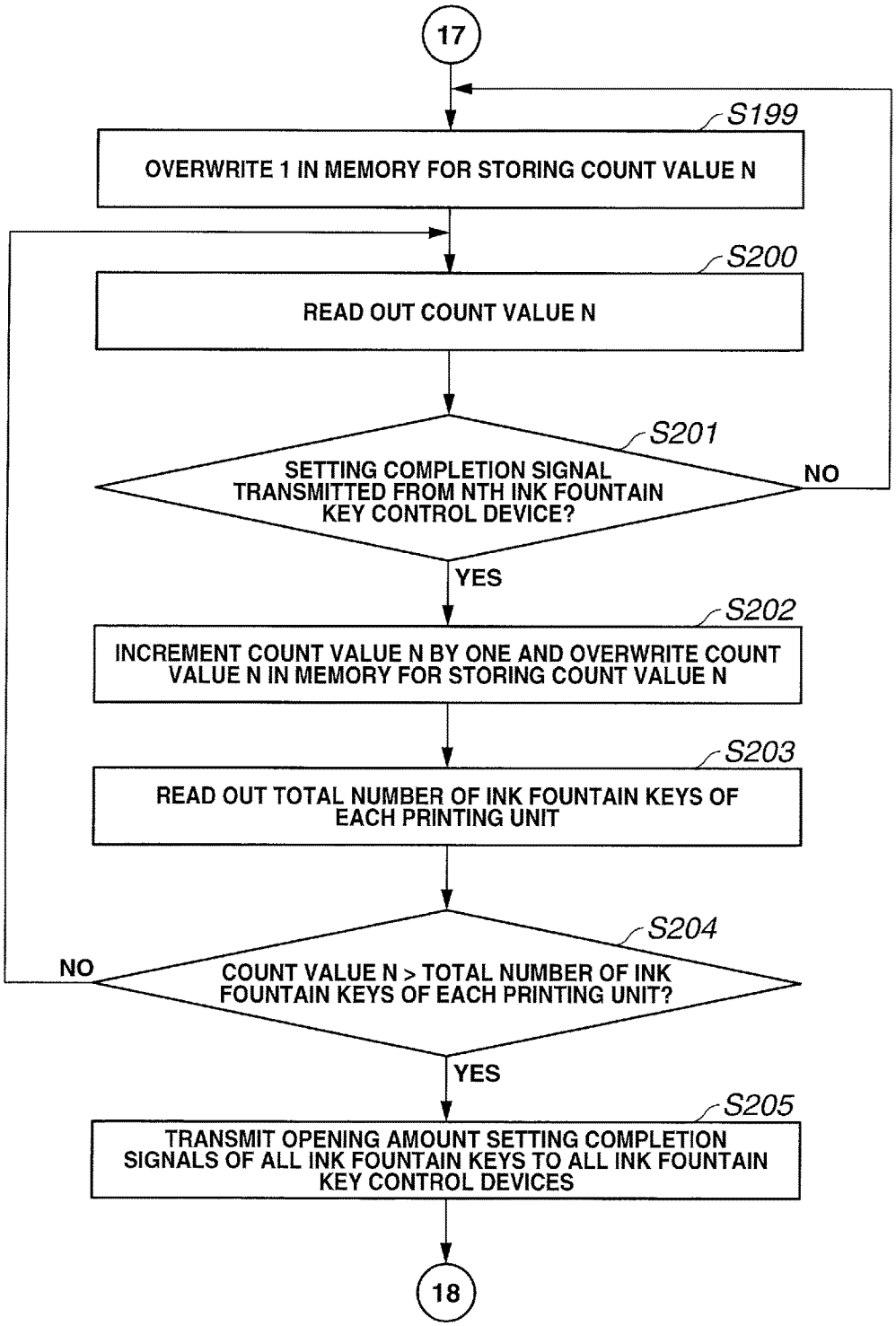

Next, the CPU 101 sets the count value N in the memory M1 to 1 (FIG. 13Q: step S199), reads out the count value N from the memory M1 (step S200), and confirms the presence/absence of an ink fountain key opening amount setting completion signal from the Nth ink fountain key control device 300 (step S201).

If the ink fountain key opening amount setting completion signal is not transmitted from the Nth ink fountain key control device 300 (NO in step S201), the process returns to step S199 to set the count value N in the memory M1 to 1, and steps S200 and S201 are repeated.

If the ink fountain key opening amount setting completion signal is transmitted from the Nth ink fountain key control device 300 (YES in step S201), the CPU 101 increments the count value N in the memory M1 by one (step S202), reads out the total number n of ink fountain keys from the memory M4 (step S203), and compares the count value N with the total number n of ink fountain keys (step S204).

The CPU 101 repeats the processing operation in steps S200 to S204 until the count value N matches the total number n of ink fountain keys. If the count value N exceeds the total number n of ink fountain keys (YES in step S204), that is, upon confirming that the setting completion signals are transmitted from all the ink fountain key control devices 300, the CPU 101 determines that the setting of the opening amounts of the ink fountain keys is completed, and transmits the opening amount setting completion signals of all ink fountain keys to all the ink fountain key control devices 300 (300-1 to 300-n) (step S205).

[Division of Ink Roller Group (Roller Group Redivision) ]

Figure 3:
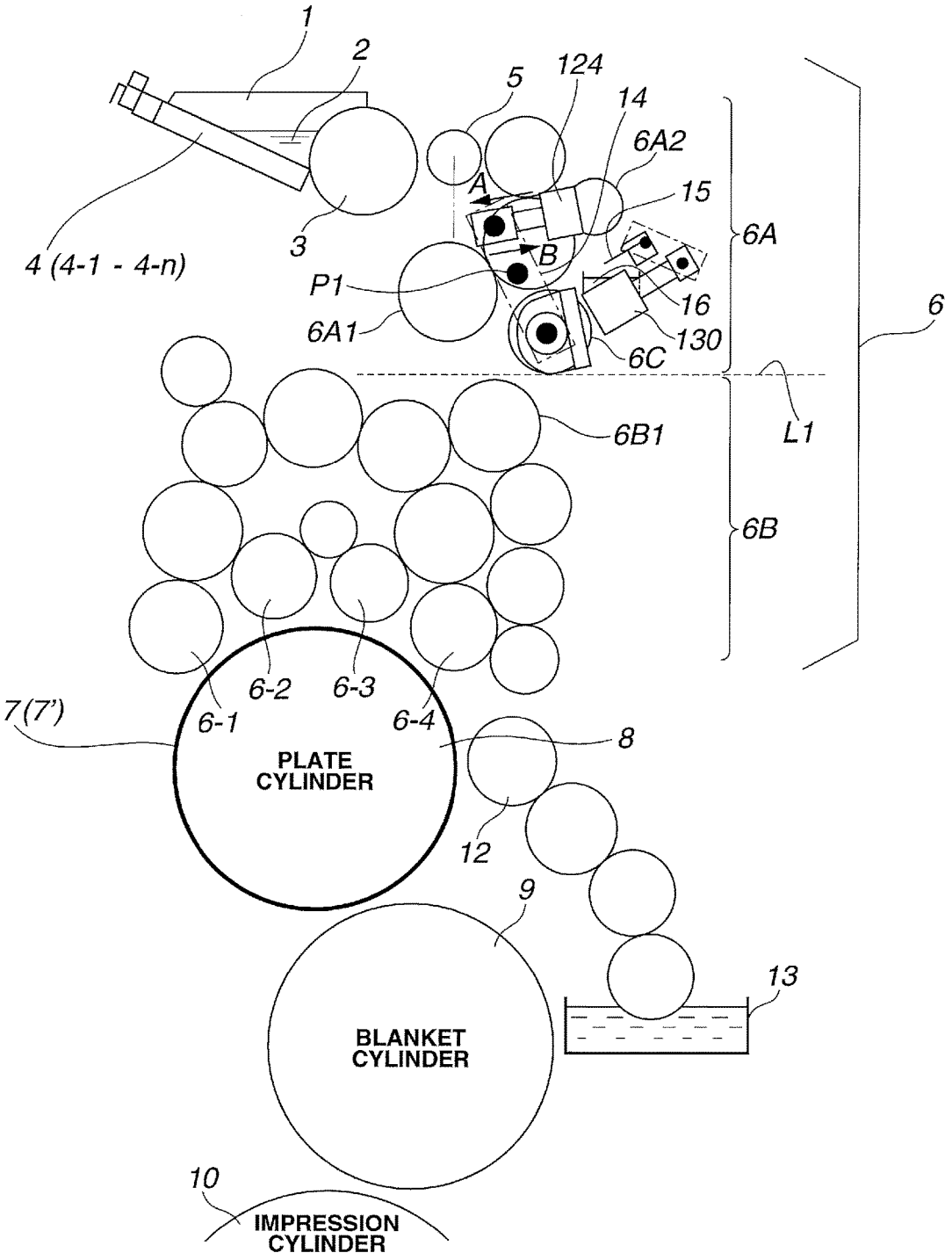
FIG. 3 is a view showing the main part of the ink supply device in the printing unit controlled by the print job switching control device (a state in which the ink roller group is divided)
Figure 13R:
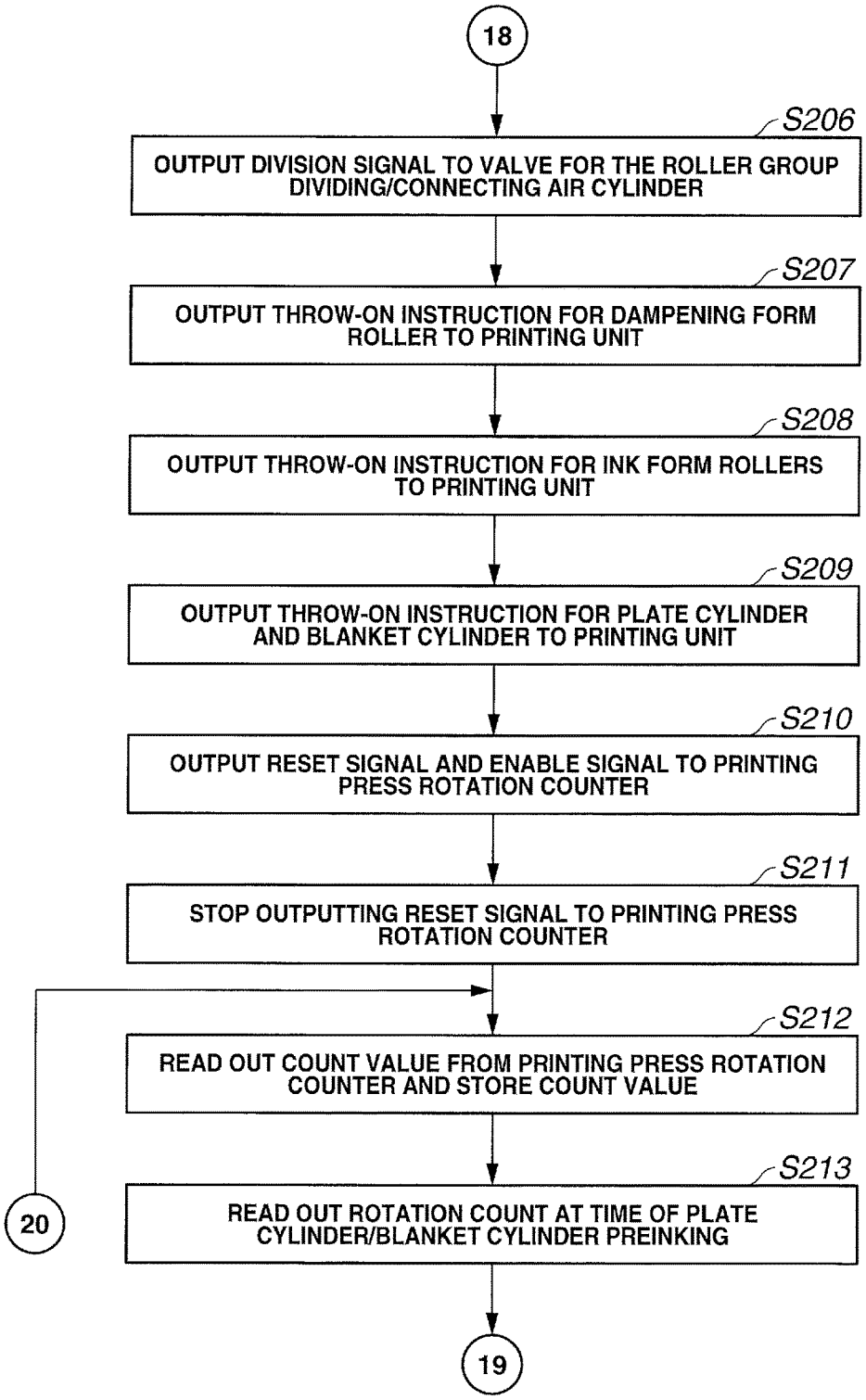

Then, the CPU 101 outputs a division signal to the valve 125 for roller group dividing/connecting air cylinder (FIG. 13R: step S206) to redivide the ink roller group 6 into the roller subgroup 6A on the upstream side and the roller subgroup 6B on the downstream side (see FIG. 3).

The ink film thickness distribution Md on the ink roller group 6 is thus divided into the ink film thickness distribution MdA on the roller subgroup 6A on the upstream side and the ink film thickness distribution MdB on the roller subgroup 6B on the downstream side, as indicated by step S7 in FIG. 7.

[Setting of Roller Subgroup on Downstream Side, Plate Cylinder, and Blanket Cylinder in Throw-On State]

Next, the CPU 101 outputs a throw-on instruction for the dampening form roller, a throw-on instruction for the ink form rollers, and a throw-on instruction for the plate cylinder and the blanket cylinder to the printing unit 133 (steps S207, S208, and S209). That is, the dampening form roller 12 is thrown on and brought into contact with the printing plate 7' based on the throw-on instruction for the dampening form roller. The ink form rollers 6-1 to 6-4 are thrown on and brought into contact with the printing plate 7' based on the throw-on instruction for the ink form rollers. Additionally, only the plate cylinder 8 and the blanket cylinder 9 are set in the throw-on state based on the throw-on instruction for the plate cylinder and the blanket cylinder. That is, the blanket cylinder 9 is thrown on to only the plate cylinder 8. The roller subgroup 6B on the downstream side, the plate cylinder 8, and the blanket cylinder 9 are thus set in the throw-on state (FIG. 7: step S8).

[Plate Cylinder/Blanket Cylinder Preinking (Supply of Ink to Plate Cylinder/Blanket Cylinder) ]

Figure 13S:
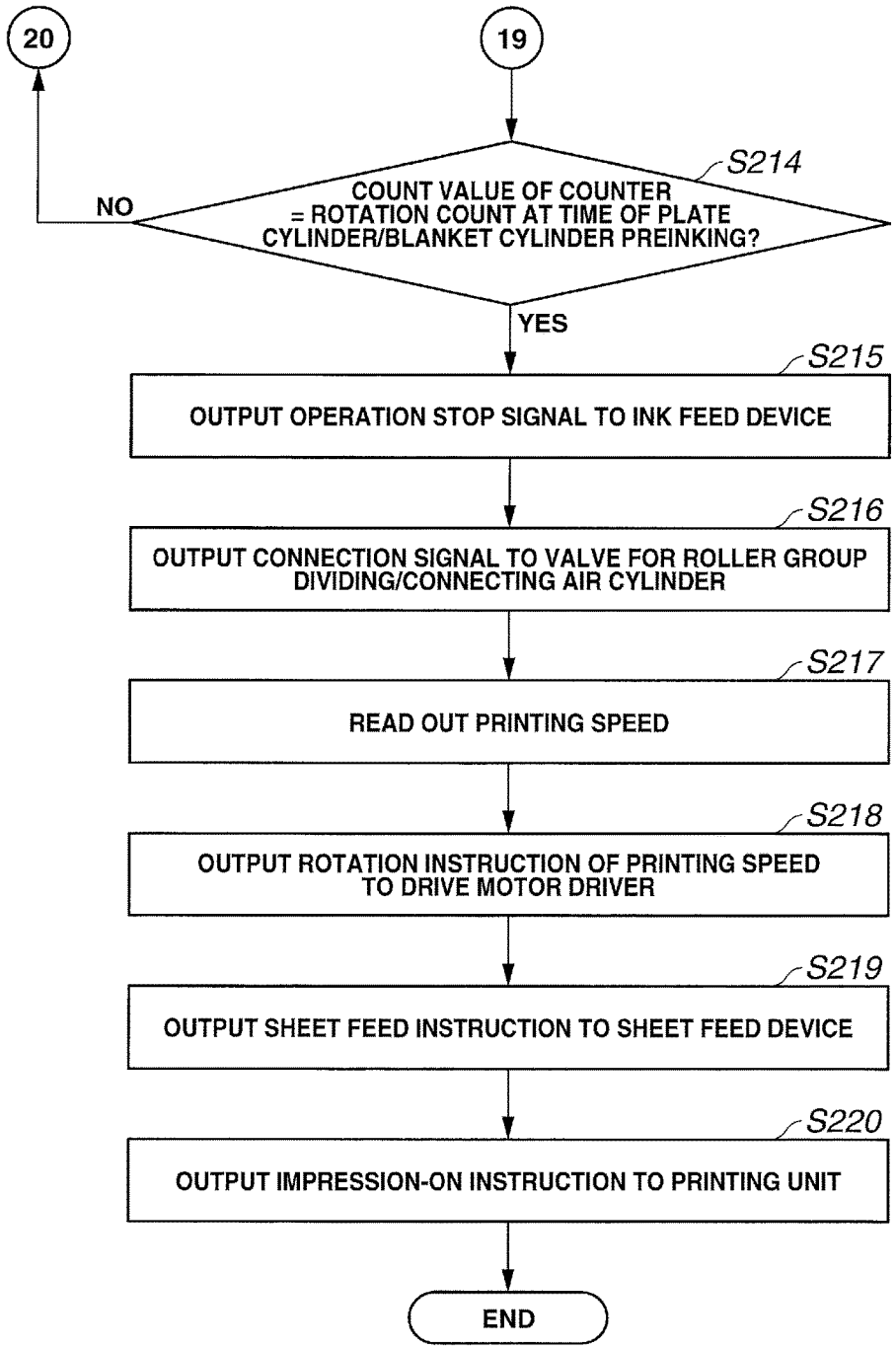

In this state, the CPU 101 rotates the printing press until the rotation count of the printing press reaches the rotation count N3 at the time of plate cylinder/blanket cylinder preinking in the memory M27 (steps S210 to S214 (FIG. 13S).

That is, the CPU 101 outputs a reset signal and an enable signal to the printing press rotation counter 115 (step S210), stops outputting the reset signal to the printing press rotation counter 115 (step S211), and causes the printing press rotation counter 115 to start the count operation from zero. The CPU 101 reads out the count value from the printing press rotation counter 115 and stores it in the memory M11 (step S212), reads out the rotation count N3 at the time of plate cylinder/blanket cylinder preinking in the memory M27 (step S213), and repeats the processing operation in steps S212 to S214 until the count value of the printing press rotation counter 115 reaches the rotation count N3 at the time of plate cylinder/blanket cylinder preinking (FIG. 13S: YES in step S214).

The ink in the roller subgroup 6B on the downstream side is thus supplied to the printing plate 7' mounded on the plate cylinder 8 and the blanket cylinder 9 (FIG. 7: step S9). In this case, only the ink of the relatively thin ink film thickness distribution MdB in the roller subgroup 6B on the downstream side is supplied to the printing plate 7' and the blanket cylinder 9. This prevents the ink film thickness distribution on the printing plate 7' and the blanket cylinder 9 from becoming too thick.

[Printing of Next Print Job (Printing Start) ]

[Connection of Ink Roller Group]

When the count value of the printing press rotation counter 115 reaches the rotation count N3 at the time of plate cylinder/blanket cylinder preinking (YES in step S214), the CPU 101 outputs an operation signal to the ink feed device 116 (step S215) to start the feed operation of the ink ductor roller 5.

The CPU 101 outputs a connection signal to the valve 125 for roller group dividing/connecting air cylinder (step S216) to connect the roller subgroup 6A on the upstream side and the roller subgroup 6B on the downstream side (see FIG. 2) and return them to one ink roller group 6 (FIG. 7: step S10).

[Sheet Feed & Impression-On]

Then, the CPU 101 reads out the printing speed Vp from the memory M28 (step S217), and outputs a rotation instruction of the printing speed to the drive motor driver 111 via the D/A converter 113 (step S218) to set the speed of the printing press to the printing speed Vp. The CPU 101 outputs a sheet feed instruction to the sheet feed device 132 (step S219) to start sheet feed to the printing press. The CPU 101 outputs an impression-on instruction (a throw-on instruction for the impression cylinder and the blanket cylinder) to the printing unit 133 (step S220) to set the blanket cylinder 9 in a throw-on state with respect to the impression cylinder 10 as well. That is, an impression-on state in which the plate cylinder 8, the blanket cylinder 9, and the impression cylinder 10 are in contact is obtained (see FIG. 2). Printing of the next print job using the printing plate 7' is thus started.

In this case, the ink film thickness distribution (the ink film thickness distribution in final printing) at the time of printing of the next print job is created during printing. At this time, since the ink film thickness distribution MdB' in the roller subgroup 6B on the downstream side, the plate cylinder 8, and the blanket cylinder 9 is thin, the ink quickly flows from the upstream side to the downstream side, and the ink film thickness distribution Me during final printing is quickly formed on the ink roller group 6, the plate cylinder 8, and the blanket cylinder 9 (FIG. 7: step S11).

As described above, in this embodiment, as the processing operation of the CPU 101, the step of, after the end of a print job, decreasing ink in the ink roller group 6 by scraping and removing it by the ink scraping member 15 (steps S143 to S149), the step of calculating the opening amounts of the ink fountain keys 4-1 to 4-n corresponding to the image of the printing plate 7' of the next print job (steps S150 to S154), the step of obtaining, as the correction values of the opening amounts of the ink fountain keys 4-1 to 4-n, correction values according to the image area ratios in the areas of the printing plate 7 of the preceding print job corresponding to the ink fountain keys 4-1 to 4-n (index values representing ink supply amounts corresponding to images in the areas of the printing plate of the preceding print job corresponding to ink fountain keys) (steps S162 to S166), the step of correcting the calculated opening amounts of the ink fountain keys 4-1 to 4-n corresponding to the image of the printing plate 7' of the next print job by the obtained correction values of the opening amounts of the ink fountain keys 4-1 to 4-n (steps S167 to S169), the step of setting the opening amounts of the ink fountain keys 4-1 to 4-n to the corrected opening amounts (steps S170 to S173), and the step of forming the ink film thickness distribution corresponding to the image of the printing plate 7' of the next print job on the ink roller group 6 by performing the feed operation of the ink ductor roller 5 a predetermined number of times in a state in which the ink in the ink roller group 6 is decreased and in a state in which the opening amounts of the ink fountain keys 4-1 to 4-n have been set to the corrected opening amounts (steps S183 to S191) are executed (steps S4 to S6 shown in FIG. 7). This makes it possible to directly start printing of the next print job without performing blank sheet printing or ink return and also without being affected by the image of the printing plate of the preceding print job.

In this embodiment, correction values according to the densities in the areas of the printed product printed by the preceding print job corresponding to the ink fountain keys 4-1 to 4-n are obtained as the correction values of the opening amounts of the ink fountain keys 4-1 to 4-n (steps S155 to S161). The opening amounts of the ink fountain keys 4-1 to 4-n corresponding to the image of the printing plate 7' of the next print job are corrected by the obtained correction values of the opening amounts of the ink fountain keys 4-1 to 4-n (steps S167 to S169). In a state in which the ink in the ink roller group 6 is decreased and in a state in which the opening amounts of the ink fountain keys 4-1 to 4-n have been set to the corrected opening amounts, the ink film thickness distribution corresponding to the image of the printing plate 7' of the next print job is formed on the ink roller group 6 (steps S183 to S191). This makes it possible to directly start printing of the next print job without being affected by the density in the area of the printed product printed by the preceding print job corresponding to each of the ink fountain keys 4-1 to 4-n.

In this embodiment, the ink in the ink roller group 6 is decreased by scraping and removing it by the ink scraping member 15 (steps S143 to S149). Correction values according to the densities in the areas of the printed product printed by the preceding print job corresponding to the ink fountain keys 4-1 to 4-n are obtained as the first correction values of the opening amounts of the ink fountain keys 4-1 to 4-n (steps S155 to S161). Correction values according to the image area ratios in the areas of the printing plate 7 of the preceding print job corresponding to the ink fountain keys 4-1 to 4-n (index values representing ink supply amounts corresponding to images in the areas of the printing plate of the preceding print job corresponding to ink fountain keys) are obtained as the second correction values of the opening amounts of the ink fountain keys 4-1 to 4-n (steps S162 to S166). The opening amounts of the ink fountain keys 4-1 to 4-n corresponding to the image of the printing plate 7' of the next print job are corrected by the first correction values and the second correction values of the opening amounts of the ink fountain keys 4-1 to 4-n (steps S167 to S169). This makes it possible to directly start printing of the next print job without performing blank sheet printing or ink return, without being affected by the image of the printing plate 7 of the preceding print job, and also without being affected by the density in the area of the printed product printed by the preceding print job corresponding to each ink fountain key.

In this embodiment, as the correction values according to the densities in the areas of the printed product printed by the preceding print job corresponding to the ink fountain keys 4-1 to 4-n, the correction values of the opening amounts of the ink fountain keys 4-1 to 4-n are obtained in accordance with the differences between the reference density and the densities in the areas of the printed product printed by the preceding print job corresponding to the ink fountain keys 4-1 to 4-n and the image area ratios in the areas of the printing plate 7' of the preceding print job corresponding to the ink fountain keys 4-1 to 4-n (steps S155 to S161). Additionally, in this embodiment, after the ink film thickness distribution corresponding to the image of the printing plate 7 of the next print job is formed on the ink roller group 6, the opening amounts of the ink fountain keys 4-1 to 4-n are set to the opening amounts corresponding to the image of the printing plate 7' of the next print job (steps S192 to S198).

In this embodiment, after the end of a print job, the printing press is stopped, and the ink form rollers 6-1 to 6-4 located at the end of the ink flow path of the ink roller group 6 are thrown off (steps S101 to S106). After that, the ink roller group 6 is divided into the roller subgroup 6A on the upstream side and the roller subgroup 6B on the downstream side (step S140), and ink in the roller subgroup 6A out of the divided roller subgroups 6A and 6B is decreased by scraping and removing it by the ink scraper blade 15 (steps S143 to S149).

Note that in this embodiment, the ink roller group 6 is divided into two subgroups, that is, the roller subgroup 6A on the upstream side and the roller subgroup 6B on the downstream side. However, the number of subgroups is not limited to two, and may be any number of two or more. That is, in the above-described embodiment, the ink roller group 6 is divided into two subgroups, that is, the roller subgroup 6A on the upstream side and the roller subgroup 6B on the downstream side (strictly speaking, three subgroups including the roller 6C). However, the ink roller group 6 may be divided into more subgroups, for example, three subgroups or four subgroups.

When the ink roller group 6 is divided into two or more roller subgroups, at least the roller subgroup on the most downstream side out of the divided roller subgroups, the plate cylinder 8 on which the printing plate 7' to be used to print the next print job is mounted, and the blanket cylinder 9 are set in the throw-on state. When the ink roller group 6 is divided into two or more roller subgroups, ink in one or some roller subgroups out of the plurality of divided roller subgroups is removed. Here, the some roller subgroups may include a plurality of roller subgroups. In addition, the member (ink scraping member) used to scrape the ink is not limited to a blade. The ink in one or some roller subgroups out of the plurality of divided roller subgroups is removed. The ink in the one or some roller subgroups out of the plurality of divided roller subgroups may be removed using a scraper or the like as the ink scraping member.

In this embodiment, the ink roller group 6 is divided into the roller subgroup 6A on the upstream side and the roller subgroup 6B on the downstream side (step S140). Ink in the roller subgroup 6A on the upstream side as one or some roller subgroups out of the divided roller subgroups 6A and 6B is removed (steps S143 to S149). In this case, since the feed operation of the ink ductor roller 5 is stopped, the ink in the roller subgroup 6A on the upstream side cannot be returned to the ink fountain. In addition, since the roller subgroup 6A on the upstream side is disconnected from the roller subgroup 6B on the downstream side, the ink cannot be removed by blank sheet printing. Hence, in this embodiment, the ink in the roller subgroup 6A on the upstream side is decreased not by ink return or blank sheet printing but by scraping it by the ink scraper blade 15.

In this embodiment, after the ink in the roller subgroup 6A is removed, in a state in which the divided roller subgroups 6A and 6B are connected and returned to one ink roller group 6 (step S181) and the ink roller groups are returned to one ink roller group 6 and in a state in which the opening amounts of the ink fountain keys 4-1 to 4-n have been set to the corrected opening amounts, the feed operation of the ink ductor roller 5 is performed a predetermined number of times, thereby forming the ink film thickness distribution corresponding to the image of the printing plate 7' of the next print job on the ink roller group 6 returned to one ink roller group (steps S183 to S191).

The ink roller group 6 on which the ink film thickness distribution corresponding to the image of the printing plate 7' of the next print job is formed is divided into the roller subgroup 6A on the upstream side and the roller subgroup 6B on the downstream side (step S206). The roller subgroup 6B on the most downstream side out of the divided roller subgroups 6A and 6B and the plate cylinder 8 on which the printing plate 7' to be used in the next print job is mounted are set in the throw-on state, and the plate cylinder 8 and the blanket cylinder 9 are set in the throw-on state (steps S207 to S209). The plate cylinder 8, the roller subgroup 6B, and the blanket cylinder 9, which are in the throw-on state, are rotated predetermined number of times, thereby supplying the ink in the roller subgroup 6B to the blanket cylinder 9 and the printing plate 7' mounted on the plate cylinder 8 (steps S210 to S214). In this case, only the ink of the relatively thin ink film thickness distribution in the roller subgroup 6B on the downstream side is supplied to the printing plate 7' and the blanket cylinder 9. This prevents the ink film thickness distribution on the plate cylinder 8 and the blanket cylinder 9 from becoming too thick.

Note that in the ink film thickness control method described in patent literature 1 (ink decrease+preinking 2) or the ink film thickness control method described in patent literature 2 (ink return+preinking 1), after the ink film thickness distribution corresponding to the image of the printing plate of the next print job is superimposed on the minimum ink film thickness distribution formed on the ink roller group and needed during printing, the ink form rollers are thrown on, and the ink in the ink roller group is supplied to the exchanged printing plate of the next print job and the cleaned blanket cylinder to start printing. For this reason, printing of the next print job starts from a state in which no ink exists on the plate cylinder and the blanket cylinder at all. It is impossible to obtain a normal printed product until an ink film thickness distribution for final printing is formed on the plate cylinder, the blanket cylinder, and the ink roller group during printing. Hence, much waste paper is generated, and printing materials are wasted.

In addition, after the ink film thickness distribution corresponding to the image of the printing plate of the next print job is superimposed on the minimum ink film thickness distribution formed on the ink roller group and needed during printing, before the start of printing of the next print job, the ink form rollers, the dampening form roller, the plate cylinder, and the blanket cylinder may be brought into contact, and the printing press may be rotated a predetermined number of times to supply the ink to the plate cylinder and the blanket cylinder as well (see, for example, patent literature 4). In this case, however, since all ink in the ink supply device is evened in the ink roller group, the plate cylinder, and the blanket cylinder, an excessive amount of ink is supplied to the plate cylinder and the blanket cylinder, and the ink film thickness distribution on the plate cylinder and the blanket cylinder becomes too thick. Hence, much waste paper is generated until the excessively supplied ink is consumed. On the other hand, in this embodiment, since only the ink of the relatively thin ink film thickness distribution in the roller subgroup 6B on the downstream side is supplied to the printing plate 7', the above-described problem does to arise.

In this embodiment, after the ink in the roller subgroup 6B is supplied to the blanket cylinder 9 and the printing plate 7' mounted on the plate cylinder 8, the divided roller subgroups 6A and 6B are connected and returned to one ink roller group 6 (step S216). Then, printing of the next print job is started using the printing plate 7' mounted on the plate cylinder 8 (steps S217 to S220). Accordingly, after the ink in the roller subgroup 6B on the downstream side is supplied to form an ink film thickness distribution on the plate cylinder 8 and the blanket cylinder 9, printing of the next print job is started in a state in which the roller subgroup 6A on the upstream side and the roller subgroup 6B on the downstream side are connected and returned to one ink roller group 6. In this case, the ink film thickness distribution (the ink film thickness distribution in final printing) at the time of printing of the next print job is created during printing. At this time, since the ink film thickness distribution in the roller subgroup 6B on the downstream side, the plate cylinder 8, and the blanket cylinder 9 is thin, the ink quickly flows from the upstream side to the downstream side, and the ink film thickness distribution during final printing is quickly formed on the ink roller group 6, the plate cylinder 8, and the blanket cylinder 9.

[Second Embodiment: Example in which Opening Amount of Ink Fountain Key Corresponding to Image of Printing Plate of Preceding Print Job is used as Index Value Representing Ink Supply Amount Corresponding to Image in Range of Printing Plate of Preceding Print Job Corresponding to Ink Fountain Key]

In the first embodiment, the image area ratio of the printing plate of a preceding print job is used as an index value representing an ink supply amount corresponding to the image in the area of the printing plate of the preceding print job corresponding to an ink fountain key. In the second embodiment, the opening amount of an ink fountain key corresponding to the image of the printing plate of a preceding print job is used.

Figure 14A:
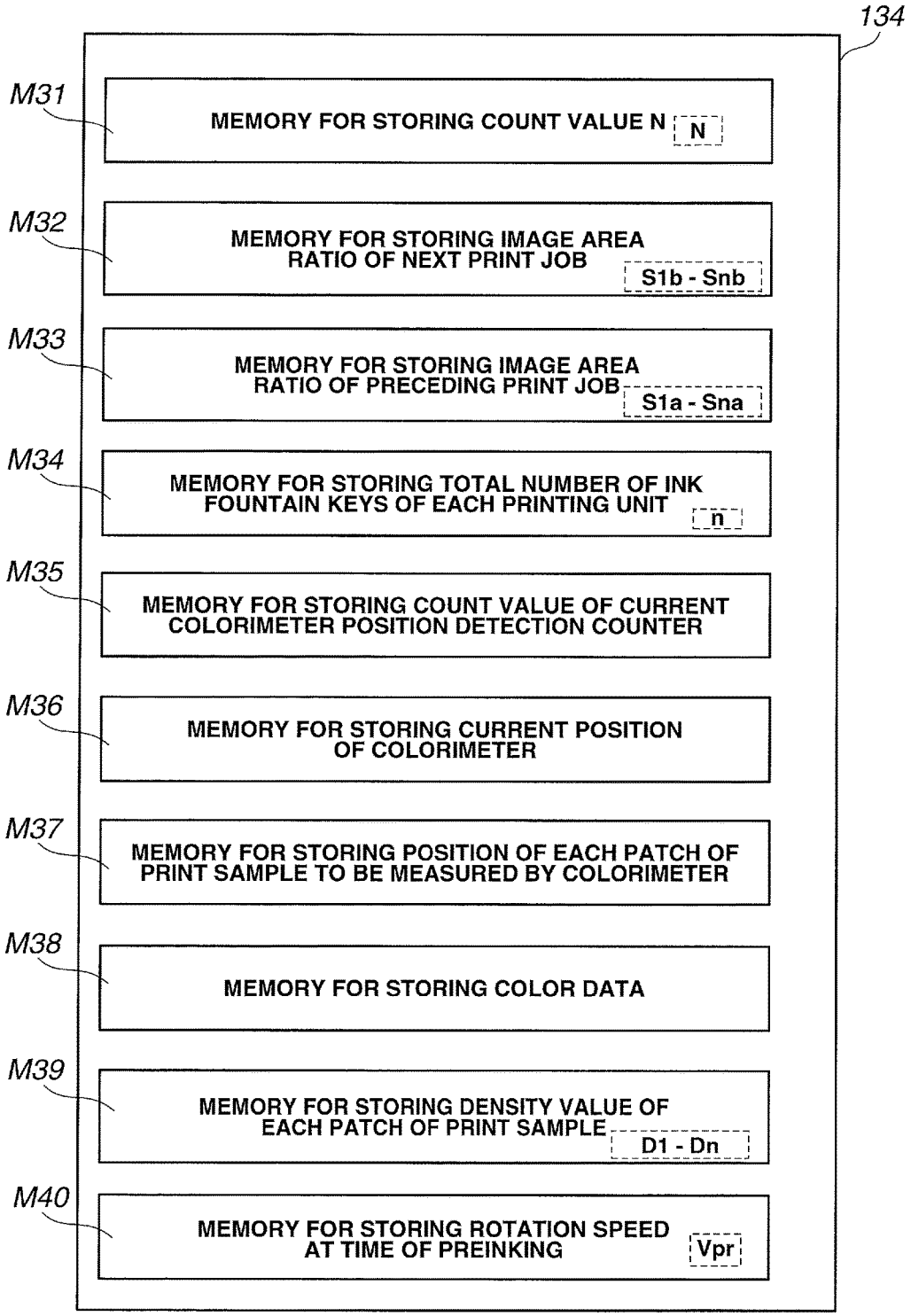
FIGS. 14A to 14C are views showing the contents of a memory in a print job switching control device according to the second embodiment.
Figure 14B:
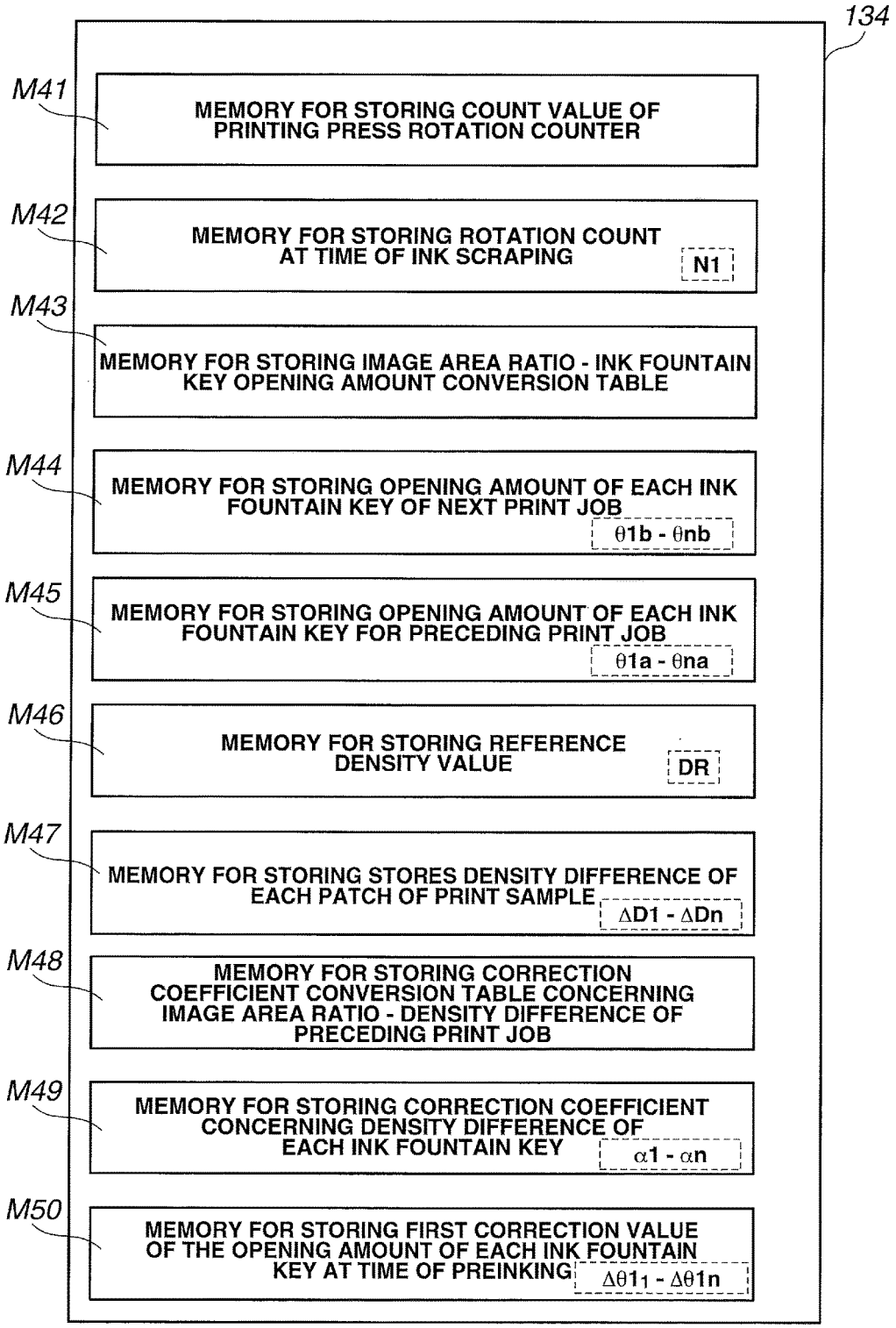
Figure 14C:
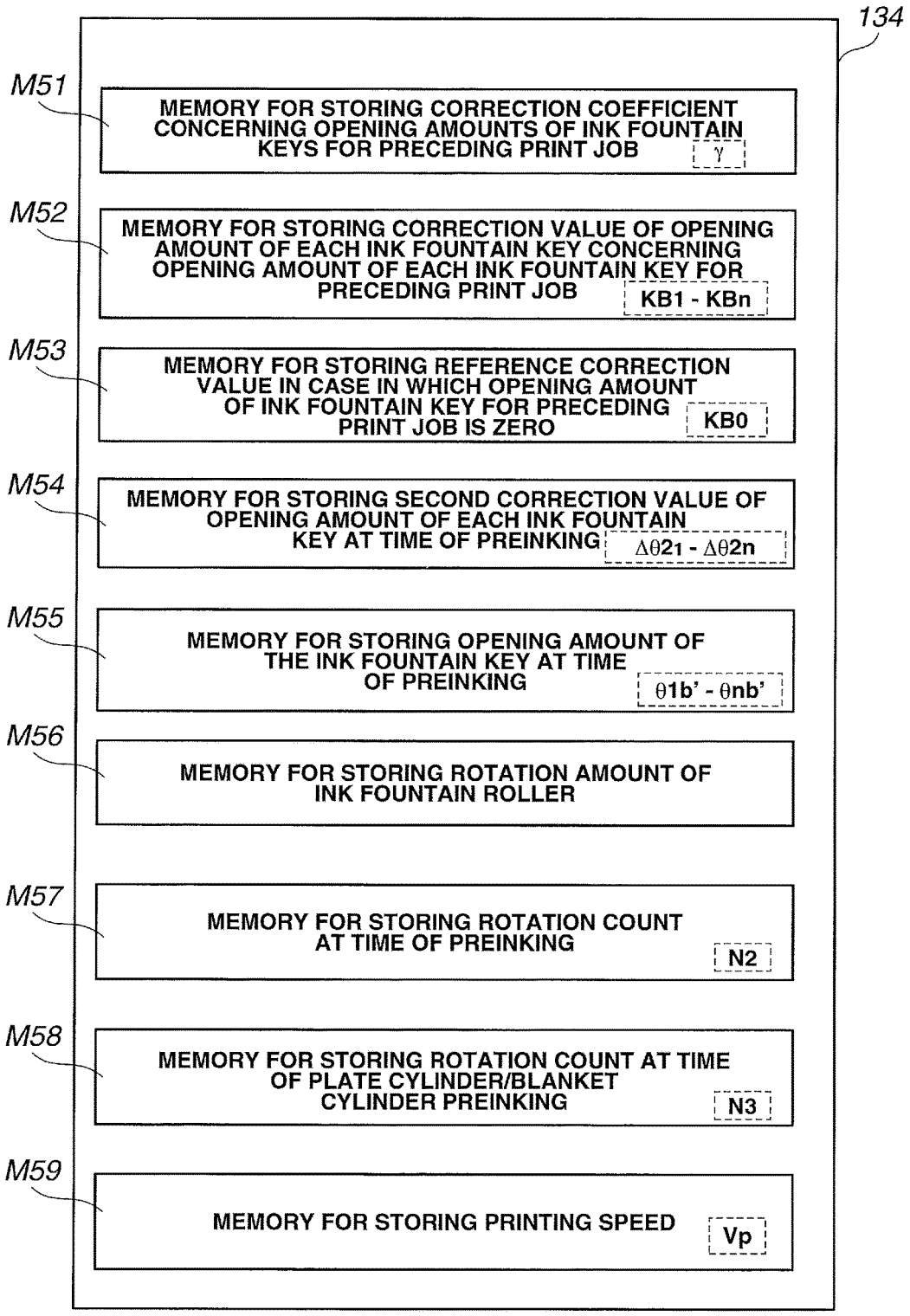

FIGS. 14A and 14B show the contents of a memory 134 according to the second embodiment. Note that since the arrangement of a print job switching control device according to the second embodiment is the same as that of the print job switching control device 100 shown in FIG. 1, the arrangement of the print job switching control device 100 will be used.

The memory 134 is provided with memories M31 to M59. The memory M31 stores a count value N. The memory M32 stores image area ratios S1*b* to Snb in the areas of the printing plate of the next print job corresponding to the ink fountain keys 4-1 to 4-n. The memory M33 stores image area ratios S1*a* to Sna in ranges of the printing plate of the preceding print job corresponding to the ink fountain keys 4-1 to 4-n. The memory M34 stores the total number n of the ink fountain keys of each printing unit. The memory M35 stores the count value of a current colorimeter position detection counter 121 of the colorimeter. The memory M36 stores the current position of a colorimeter 117. The memory M37 stores the positions of the patches of a print sample to be measured by the colorimeter 117. The memory M38 stores color data from the colorimeter 117. The memory M39 stores density values D1 to Dn of the patches of the print sample. The memory M40 stores a rotation speed Vpr at the time of preinking. The memory M41 stores the count value of a printing press rotation counter 115. The memory M42 stores a rotation count N1 of the printing press at the time of ink scraping. The memory M43 stores an image area ratio—ink fountain key opening amount conversion table. The memory M44 stores opening amounts θ1*b* to θnb of the ink fountain keys 4-1 to 4-n corresponding to the image of the printing plate of the next print job. The memory M45 stores opening amounts θ1*a* to θna of the ink fountain keys 4-1 to 4-n corresponding to the image of the printing plate of the preceding print job. The memory M46 stores a reference density value DR. The memory M47 stores differences (density differences) ΔD1 to ΔDn between the reference density value DR and the density values D1 to Dn of the patches of the print sample. The memory M48 stores a correction coefficient conversion table concerning image area ratio—density difference of the preceding print job. The memory M49 stores correction coefficients α1 to an concerning the density differences of the ink fountain keys 4-1 to 4-n. The memory M50 stores first correction values $\Delta\theta_1$ to $\Delta\theta 1_n$ of the opening amounts of the ink fountain keys 4-1 to 4-n at the time of preinking.

The memory M51 stores a correction coefficient γ concerning the opening amounts of the ink fountain keys for the preceding print job. The memory M52 stores correction values KB1 to KBn of the opening amounts of the ink fountain keys 4-1 to 4-n concerning the opening amounts of the ink fountain keys for the preceding print job. The memory M53 stores a reference correction value KB0 in a case in which the opening amount of an ink fountain key for the preceding print job is zero. The memory M54 stores second correction values $\Delta\theta 2_1$ to $\Delta\theta 2_n$ of the opening amounts of the ink fountain keys 4-1 to 4-n at the time of preinking. The memory M55 stores opening amounts θ1*b*' to θnb' of the ink fountain keys 4-1 to 4-nat the time of preinking. The memory M56 stores the rotation amount of the ink fountain roller. The memory M57 stores a rotation count N2 of the printing press at the time of preinking. The memory M58 stores a rotation count N3 of the printing press at the time of plate cylinder/blanket cylinder preinking. The memory M59 stores a printing speed Vp.

Figure 15A:
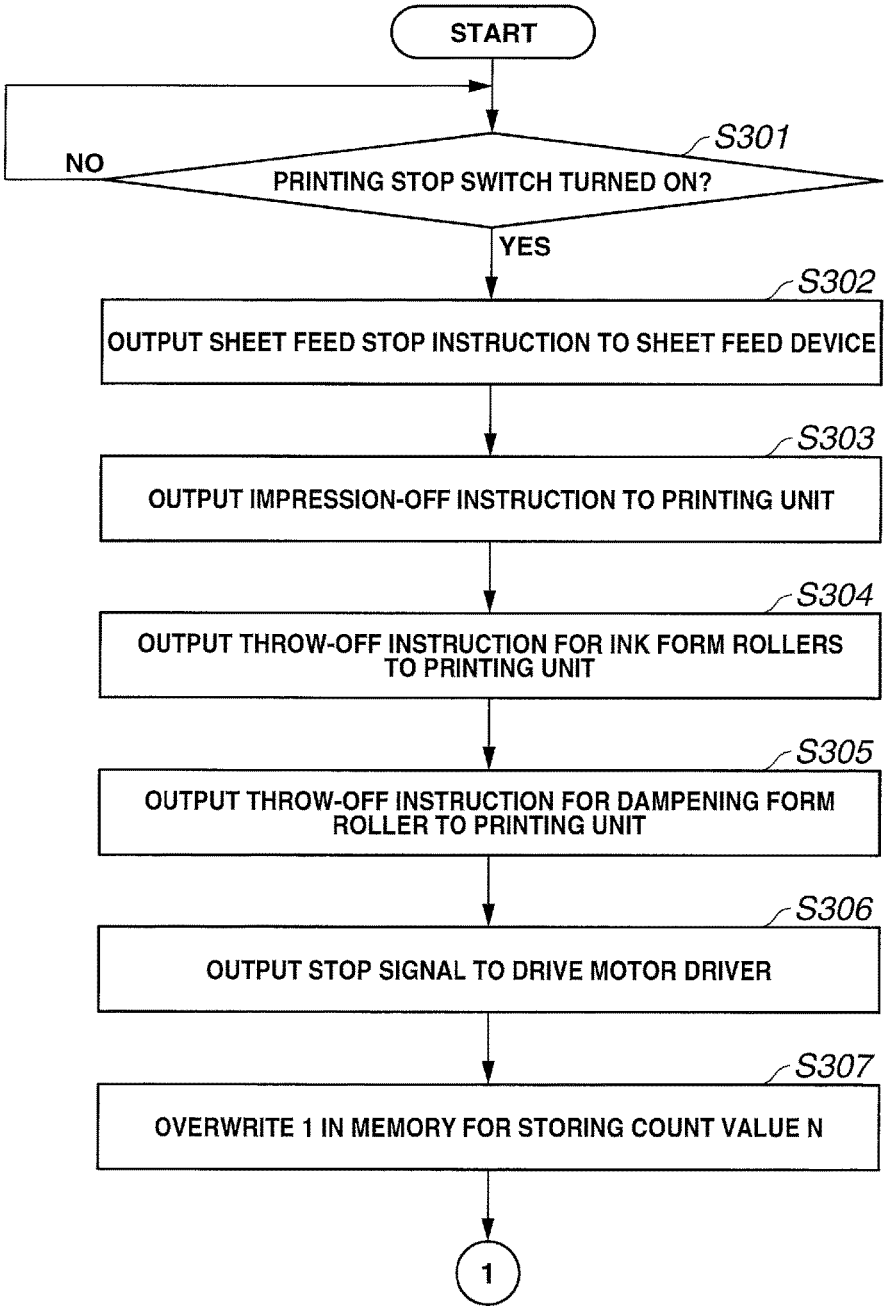
FIGS. 15A to 15S are flowcharts for explaining a detailed operation of the print job switching control device according to the second embodiment.
Figure 15B:
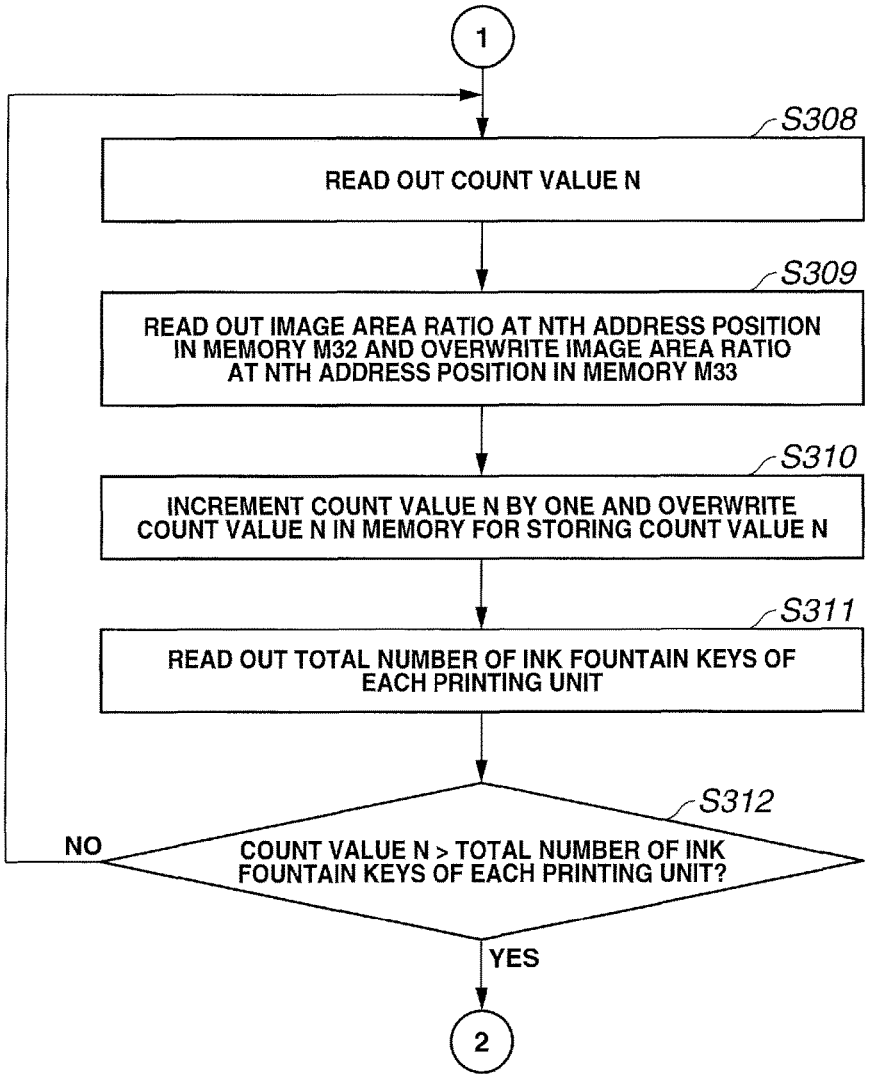
Figure 15C:
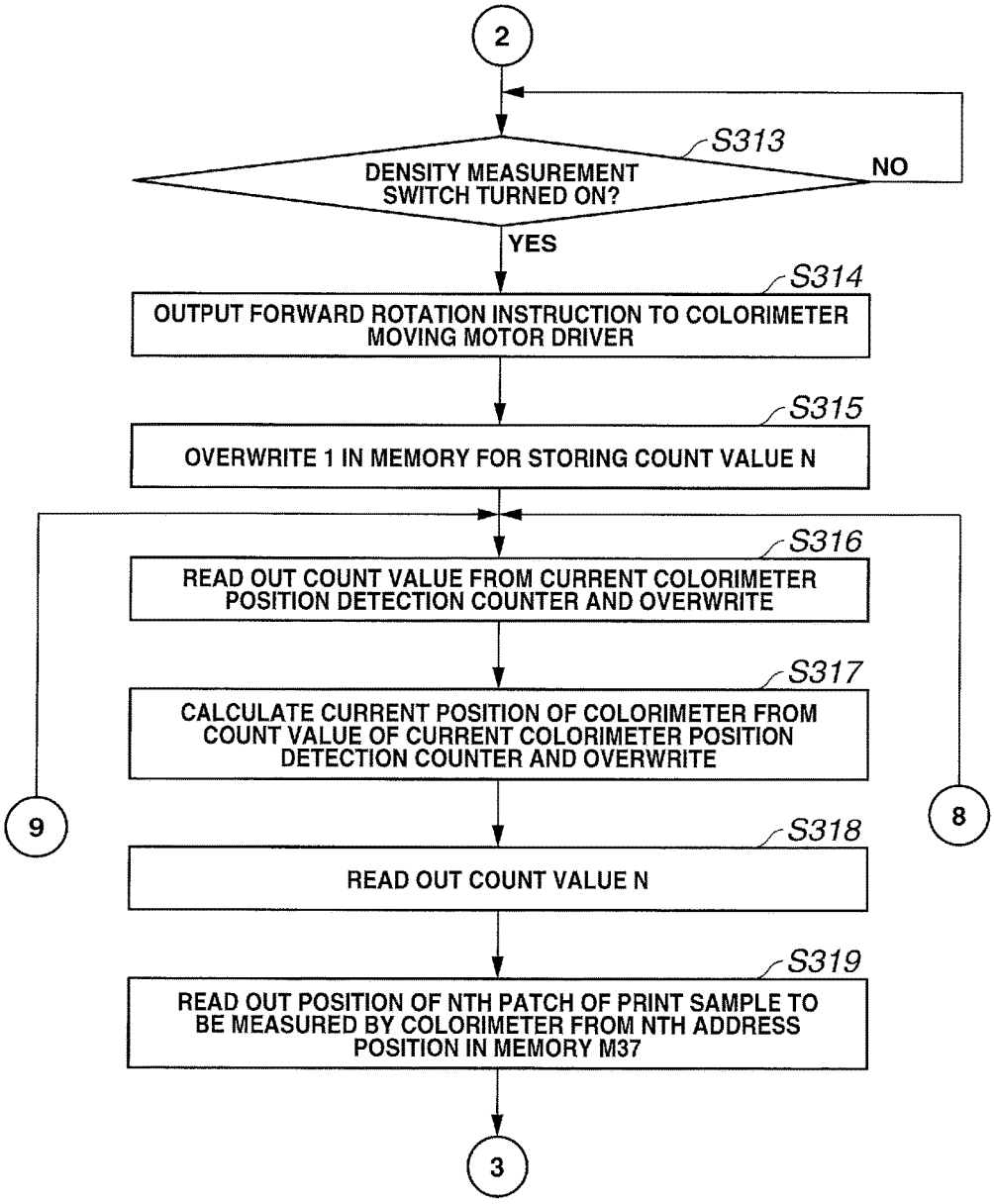
Figure 15D:
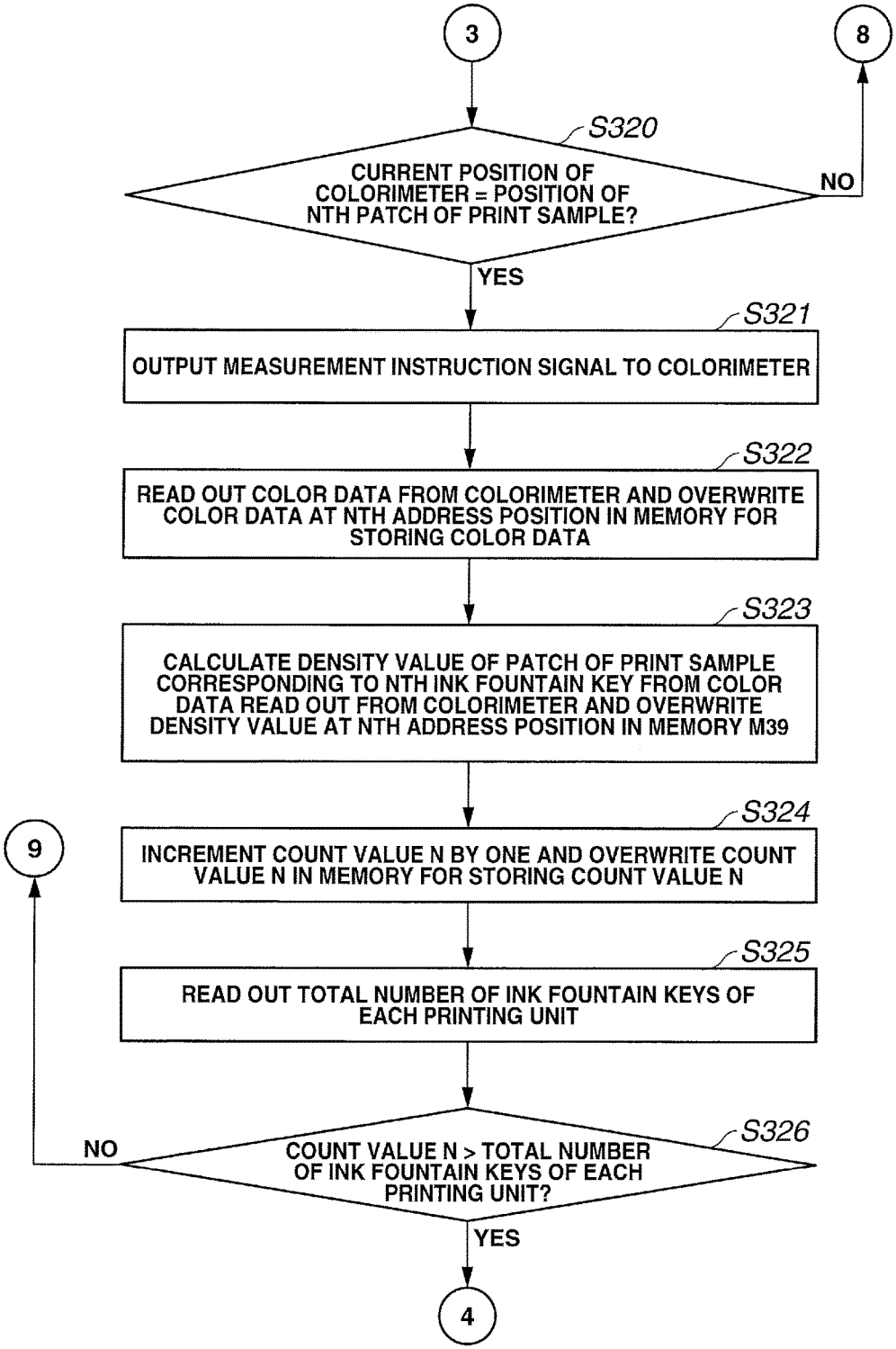
Figure 15E:
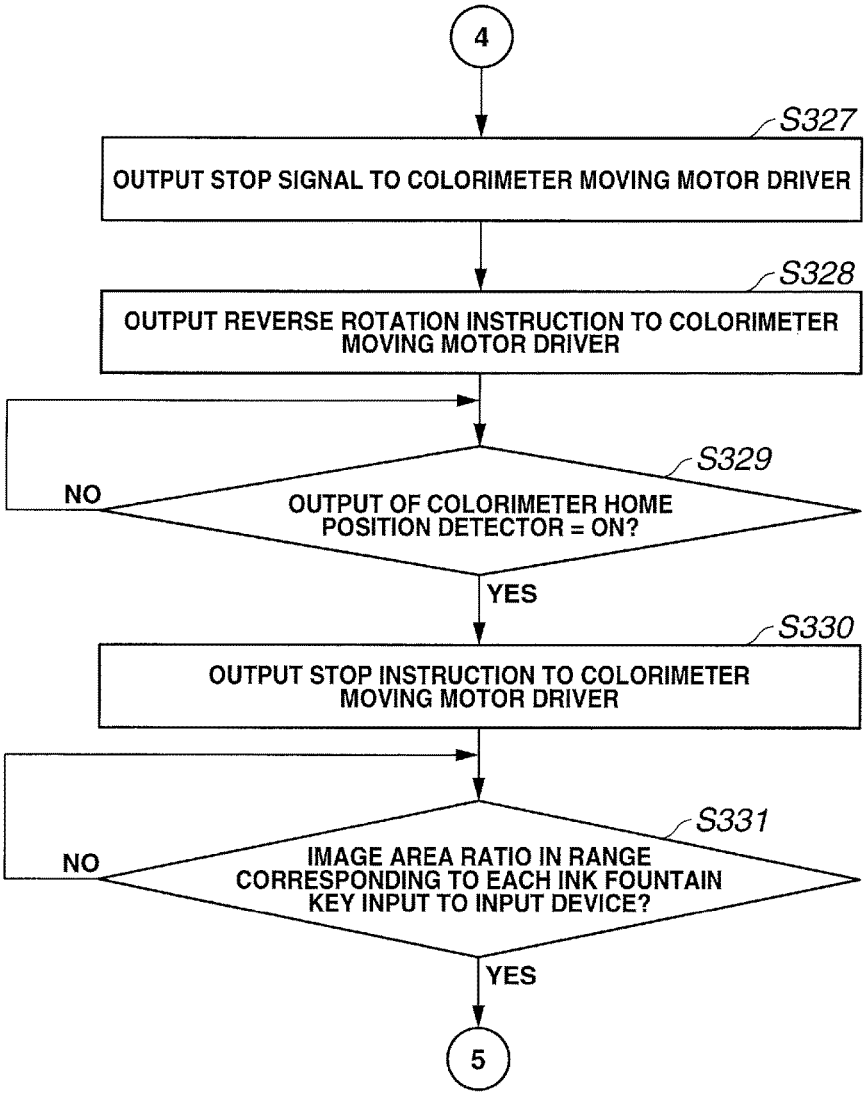
Figure 15F:
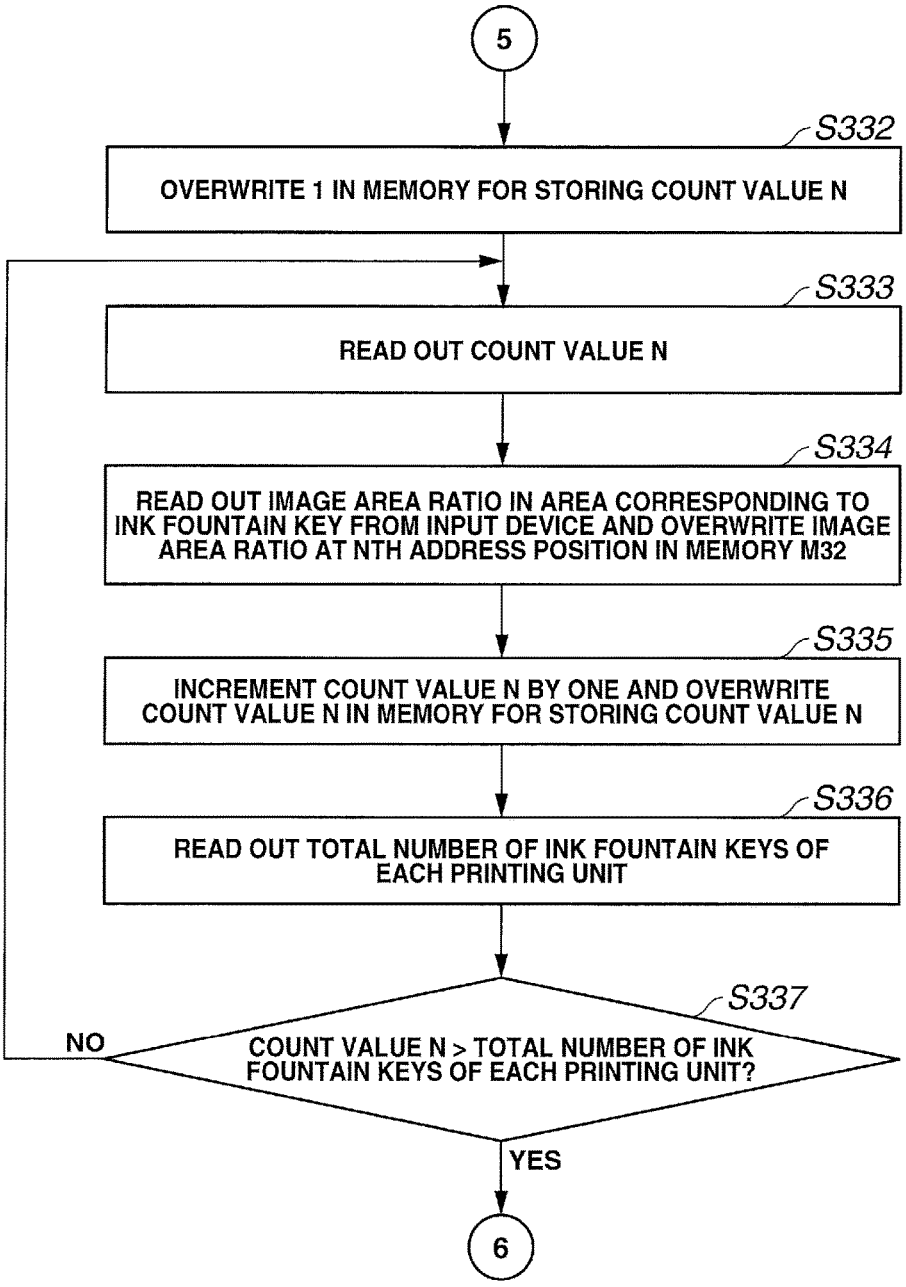
Figure 15G:
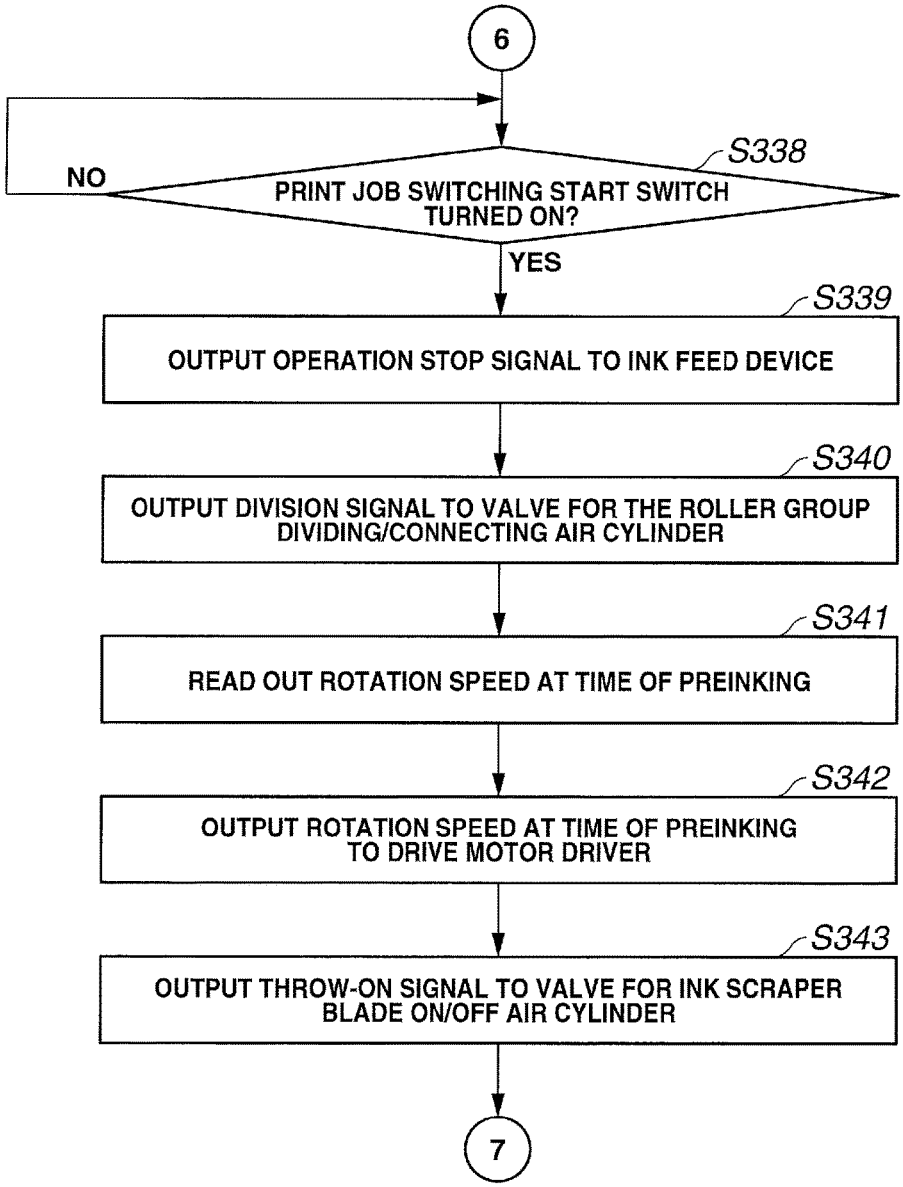
Figure 15H:
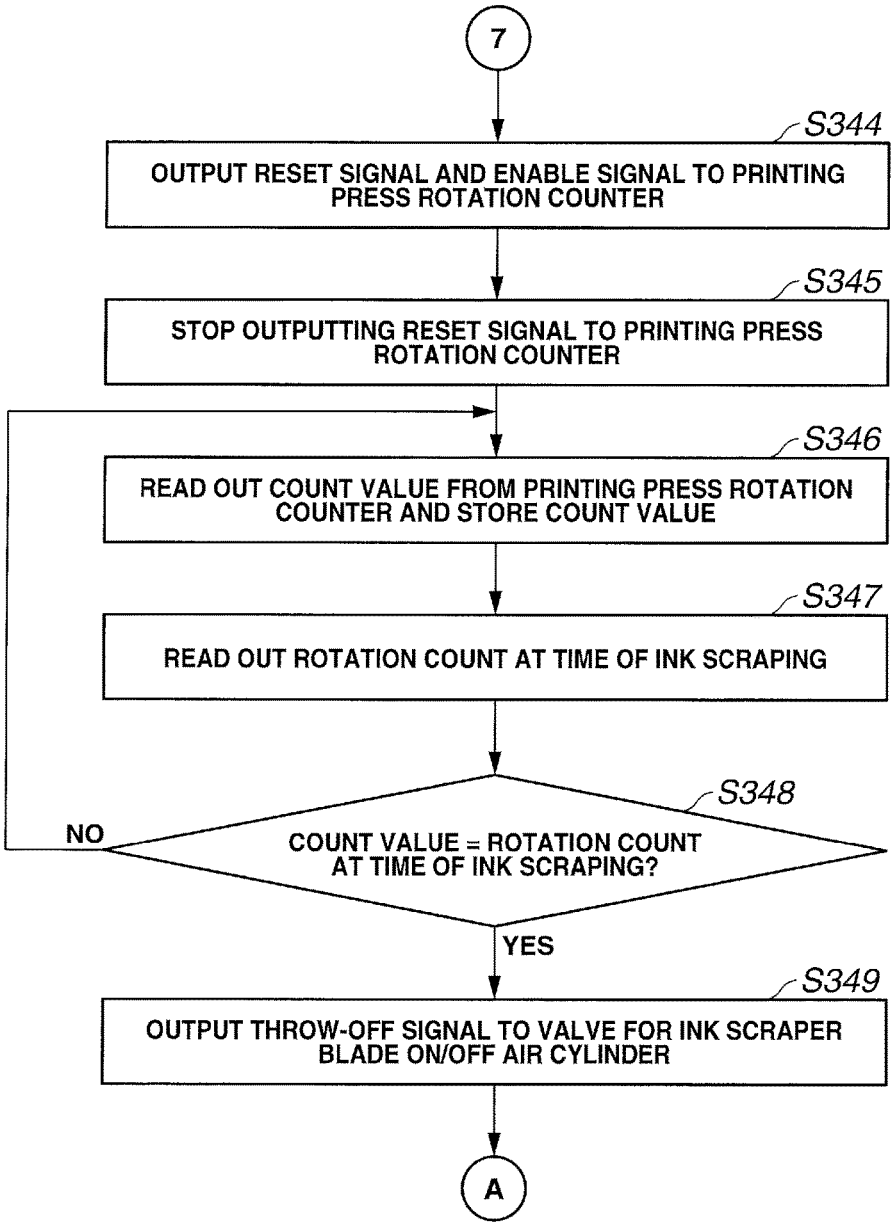
Figure 15I:
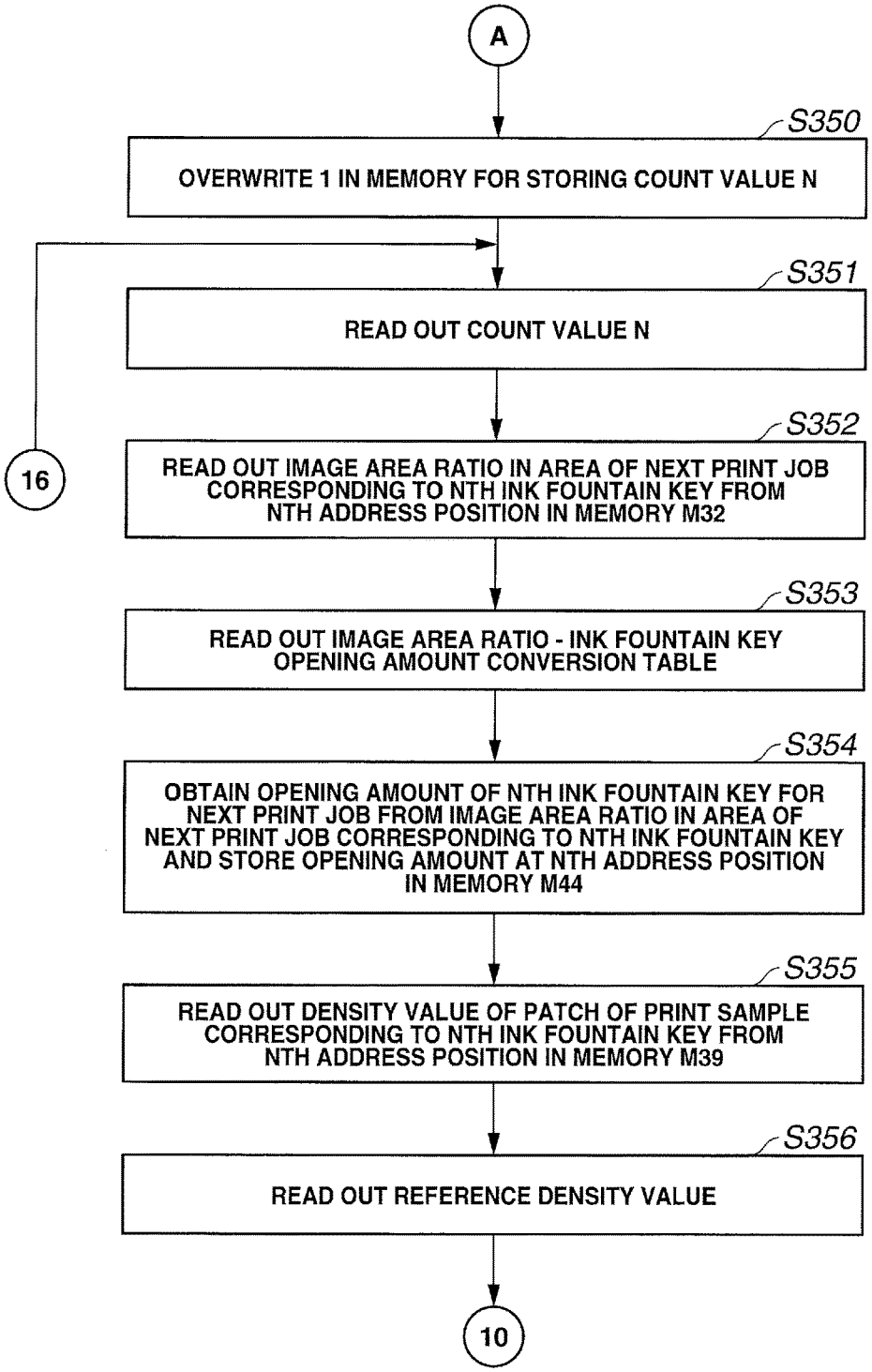
Figure 15J:
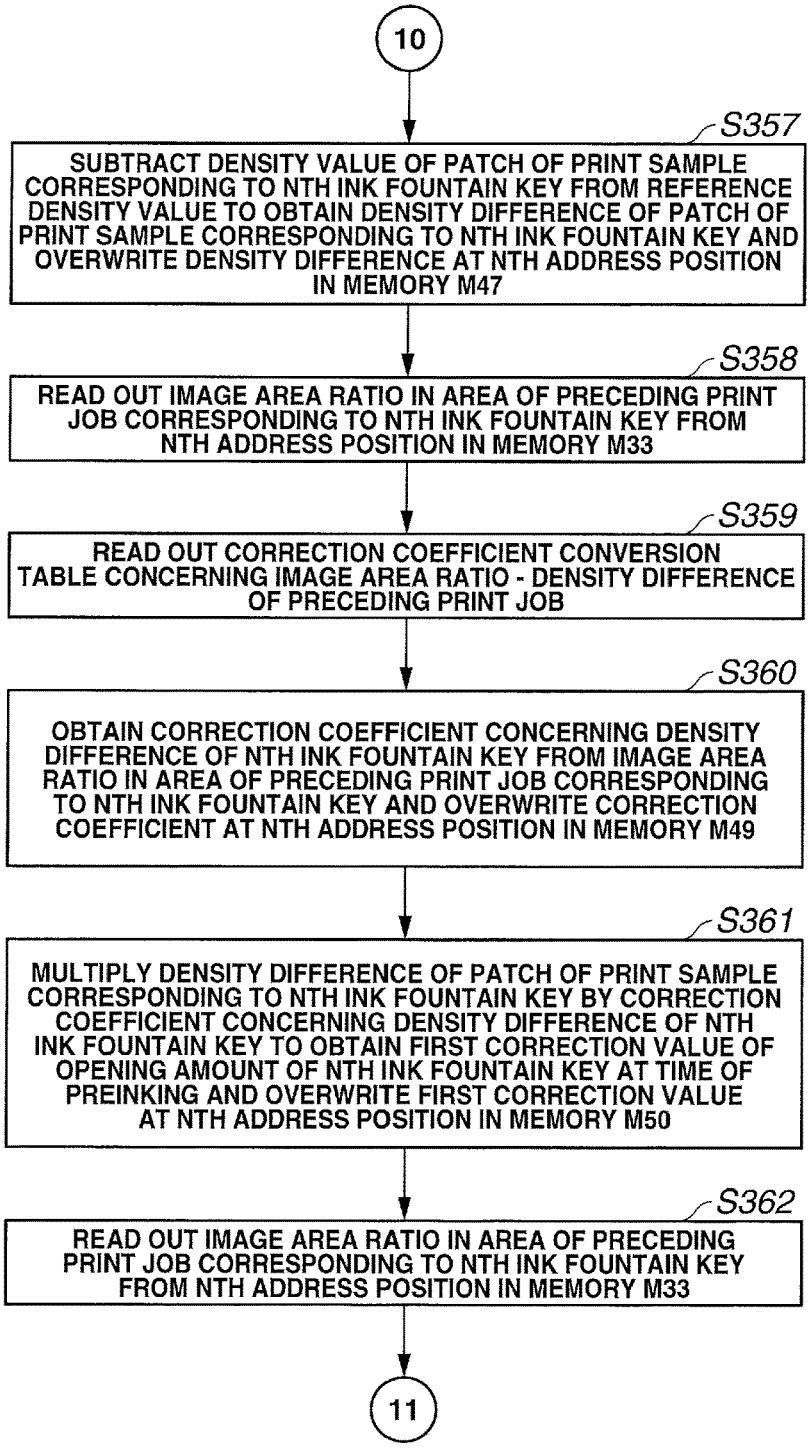
Figure 15K:
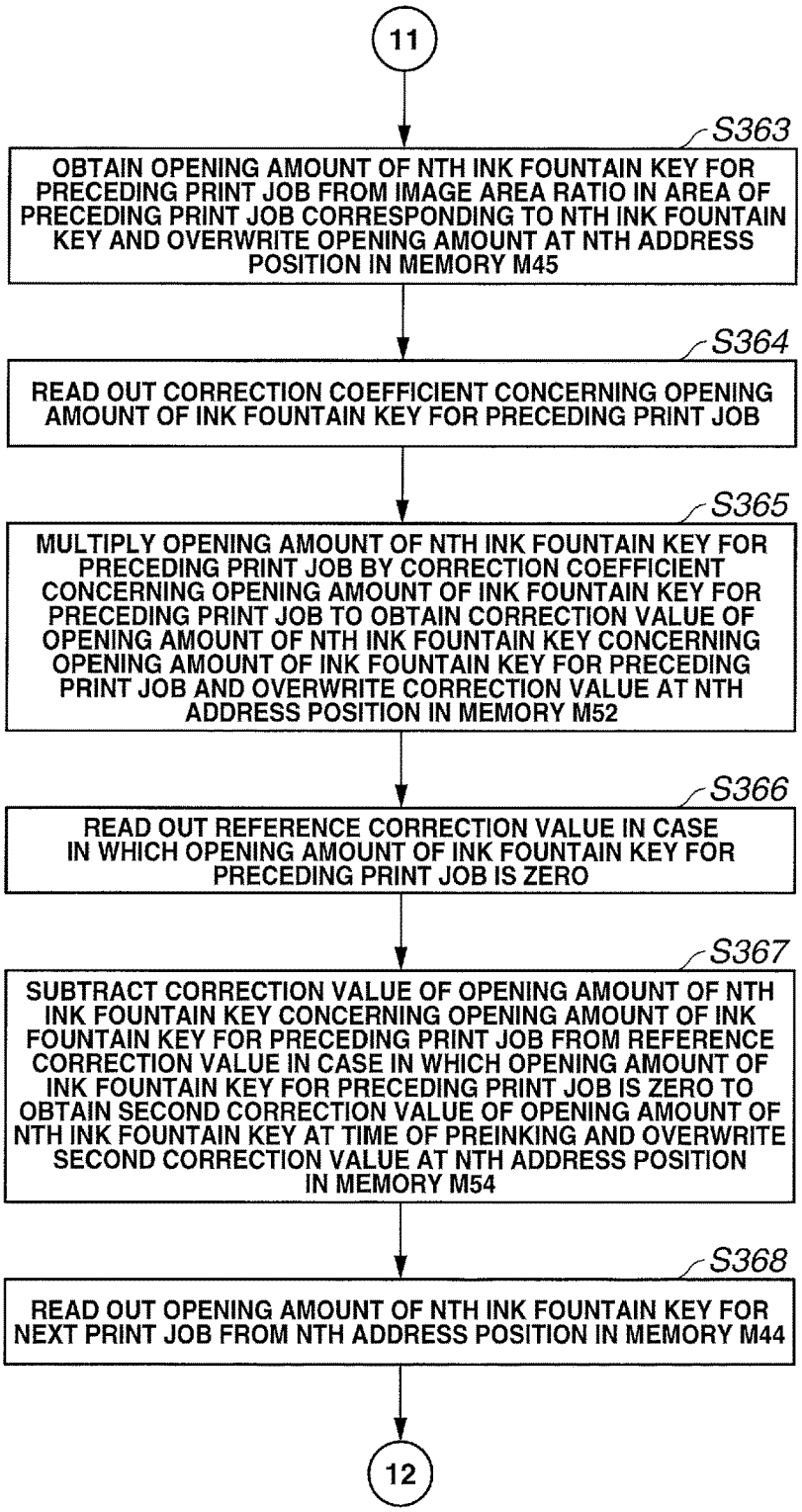
Figure 15L:
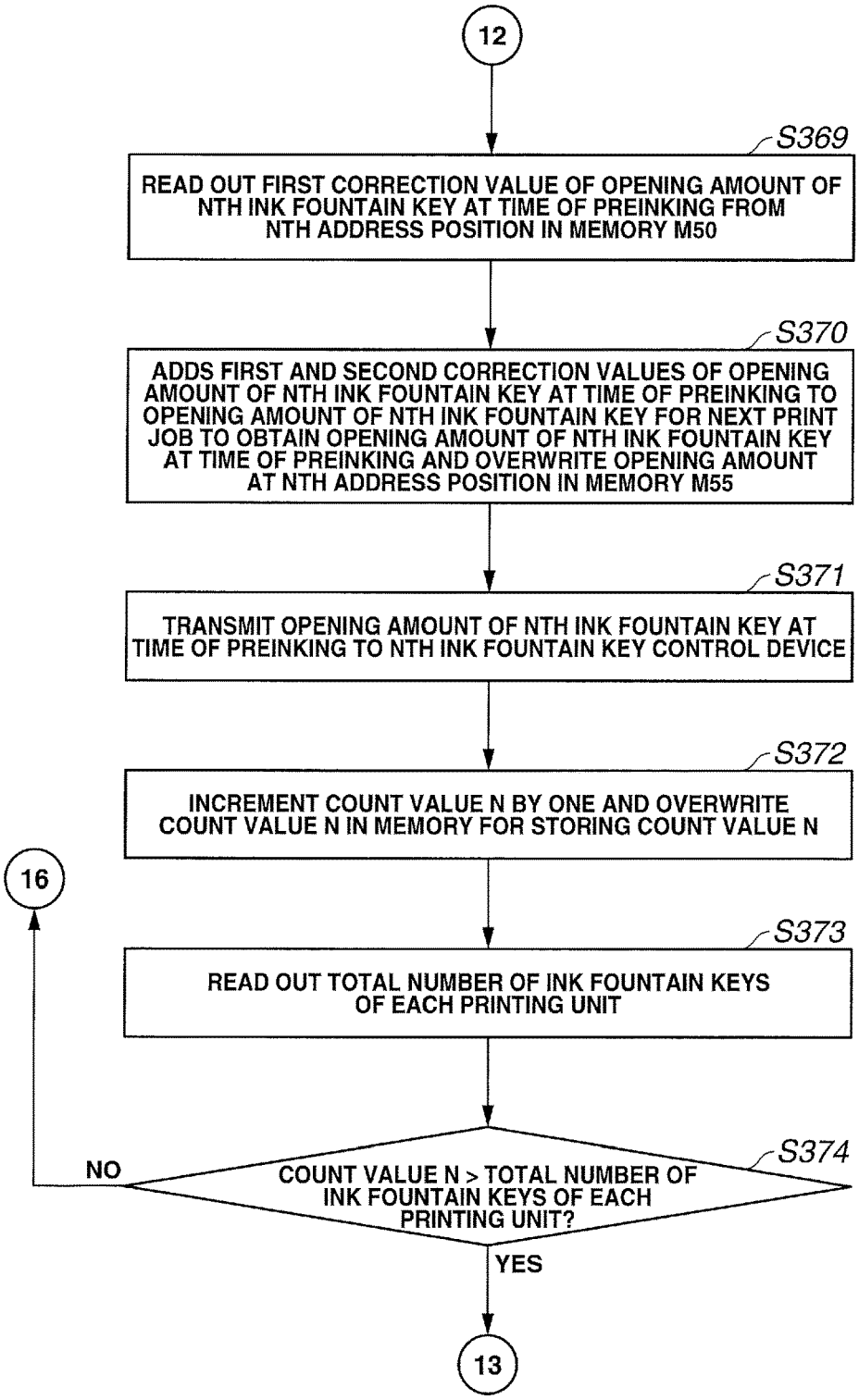
Figure 15M:
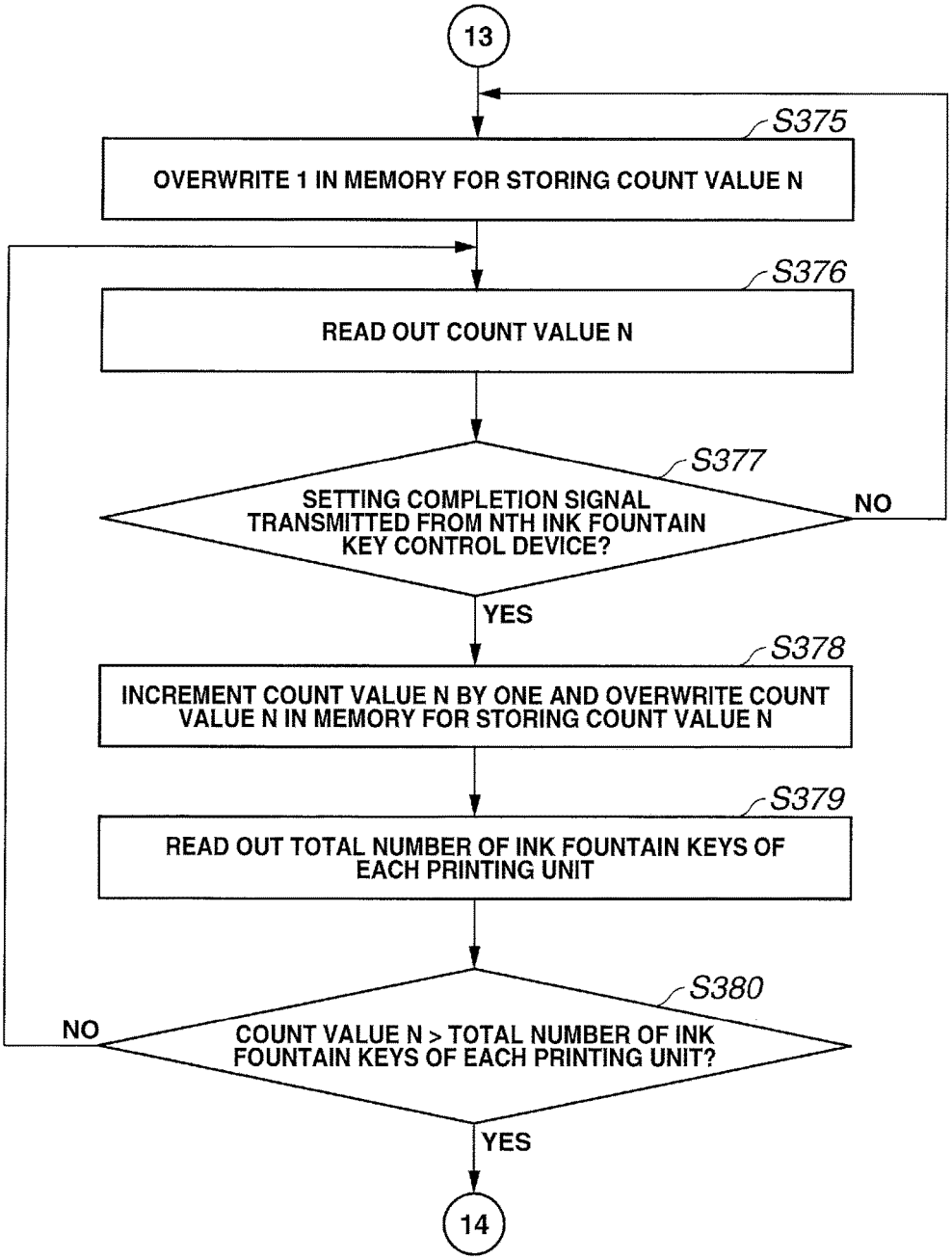
Figure 15N:
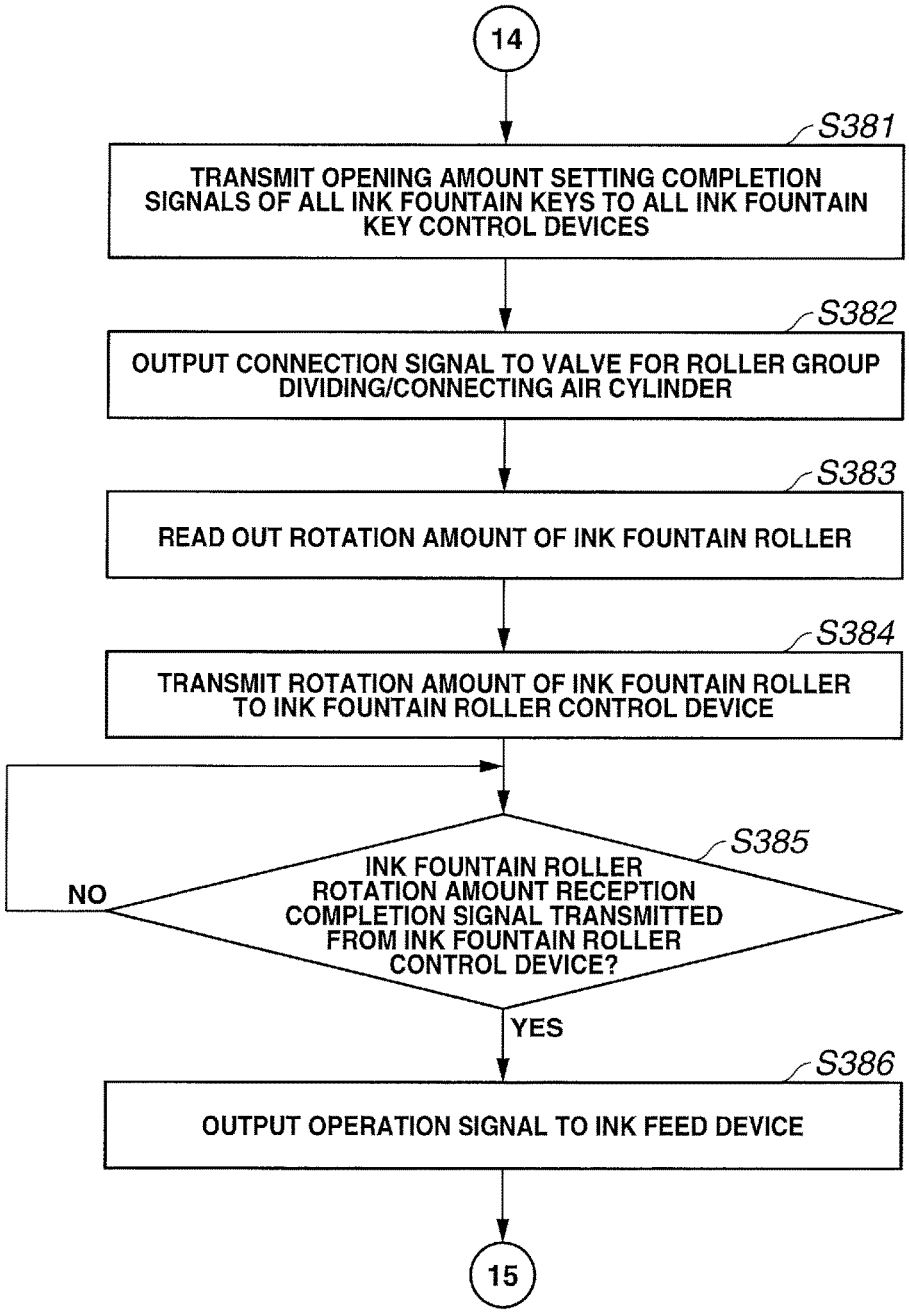
Figure 15O:
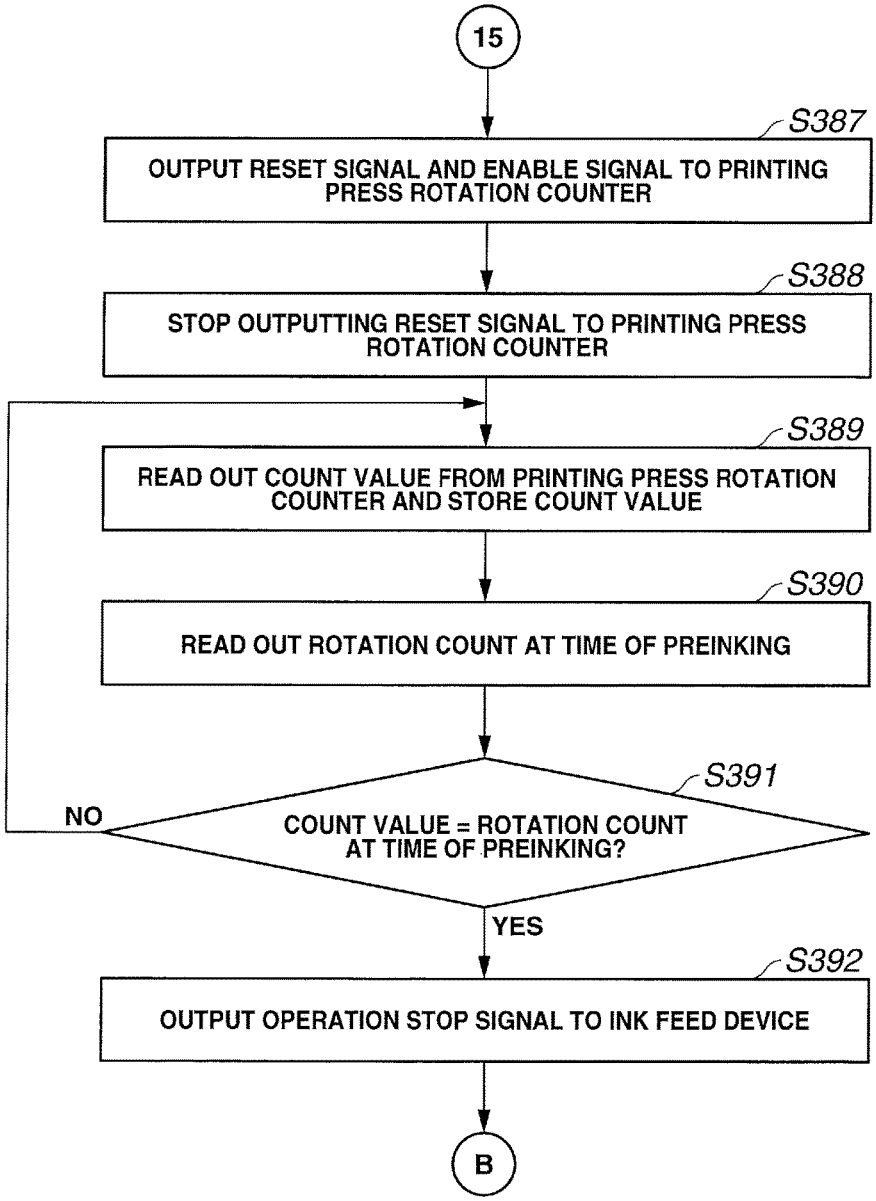
Figure 15P:
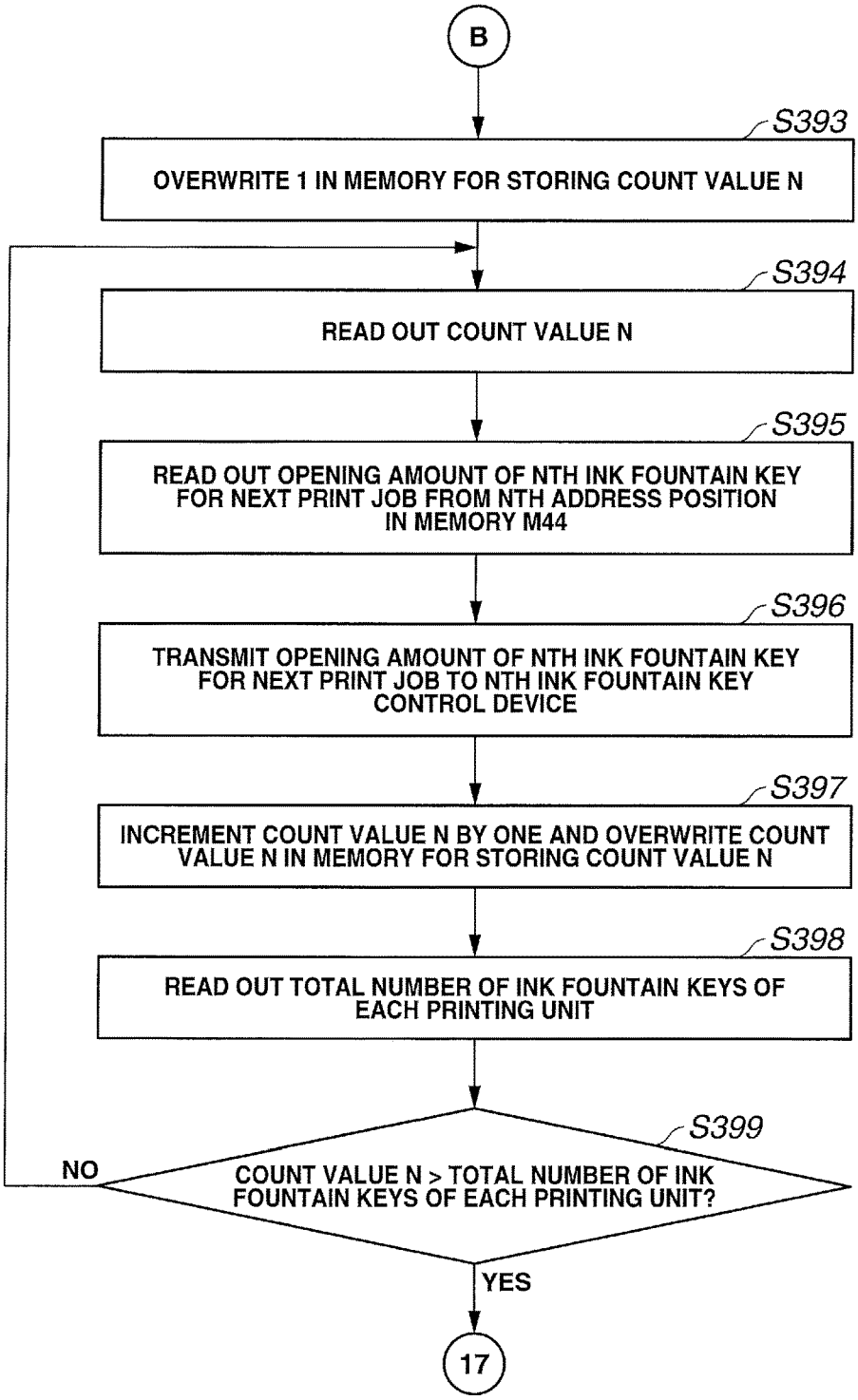
Figure 15Q:
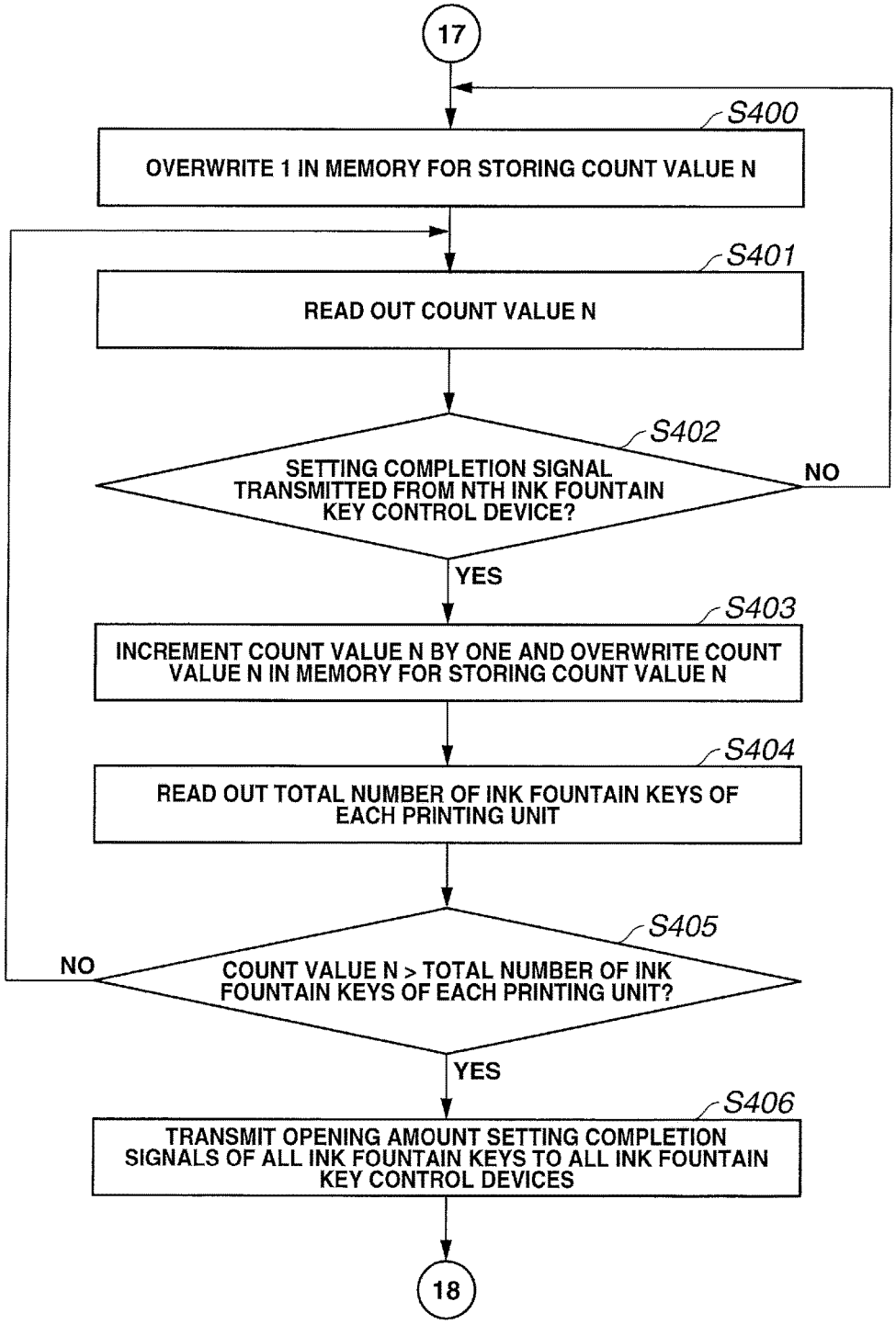
Figure 15R:
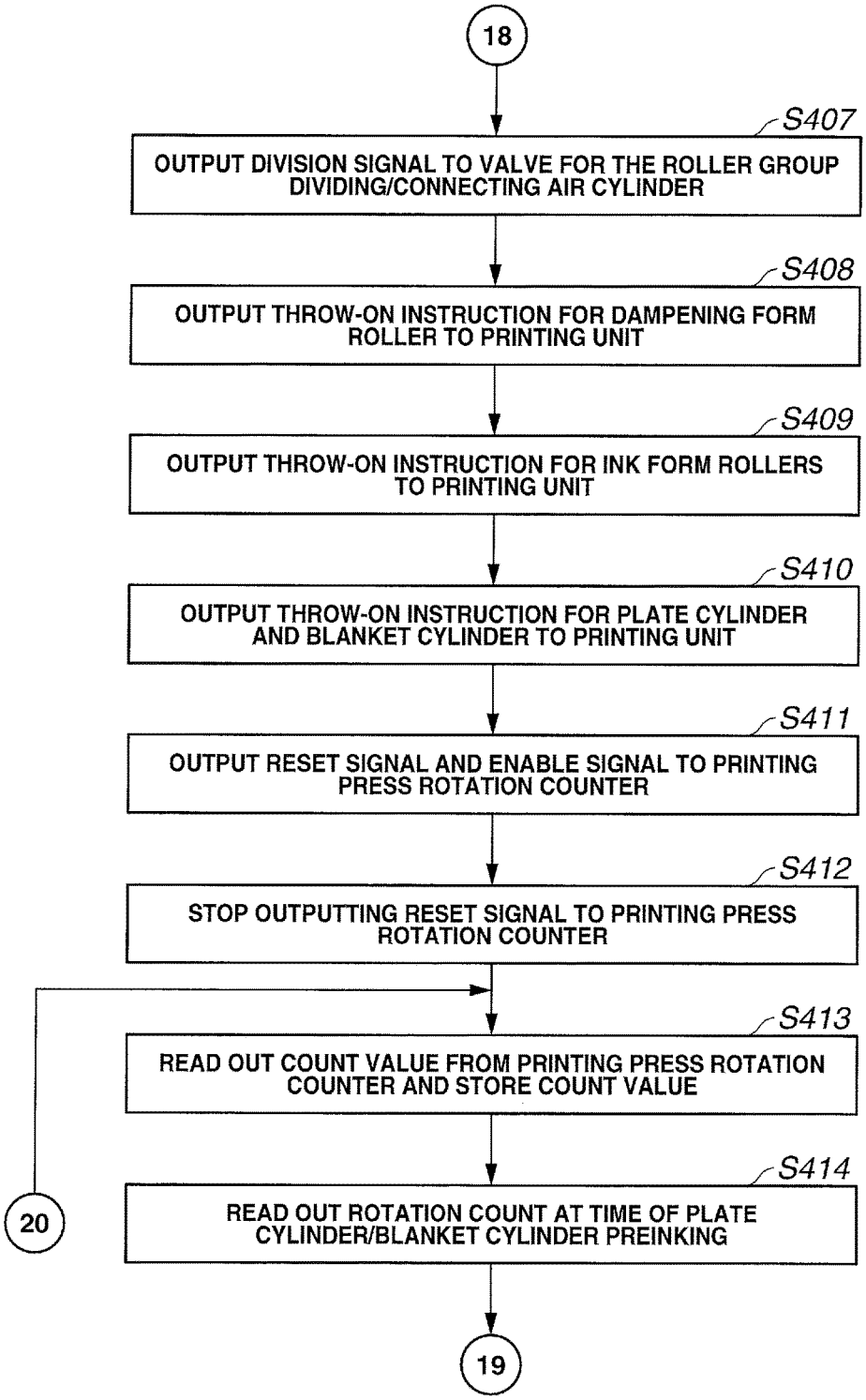
Figure 15S:
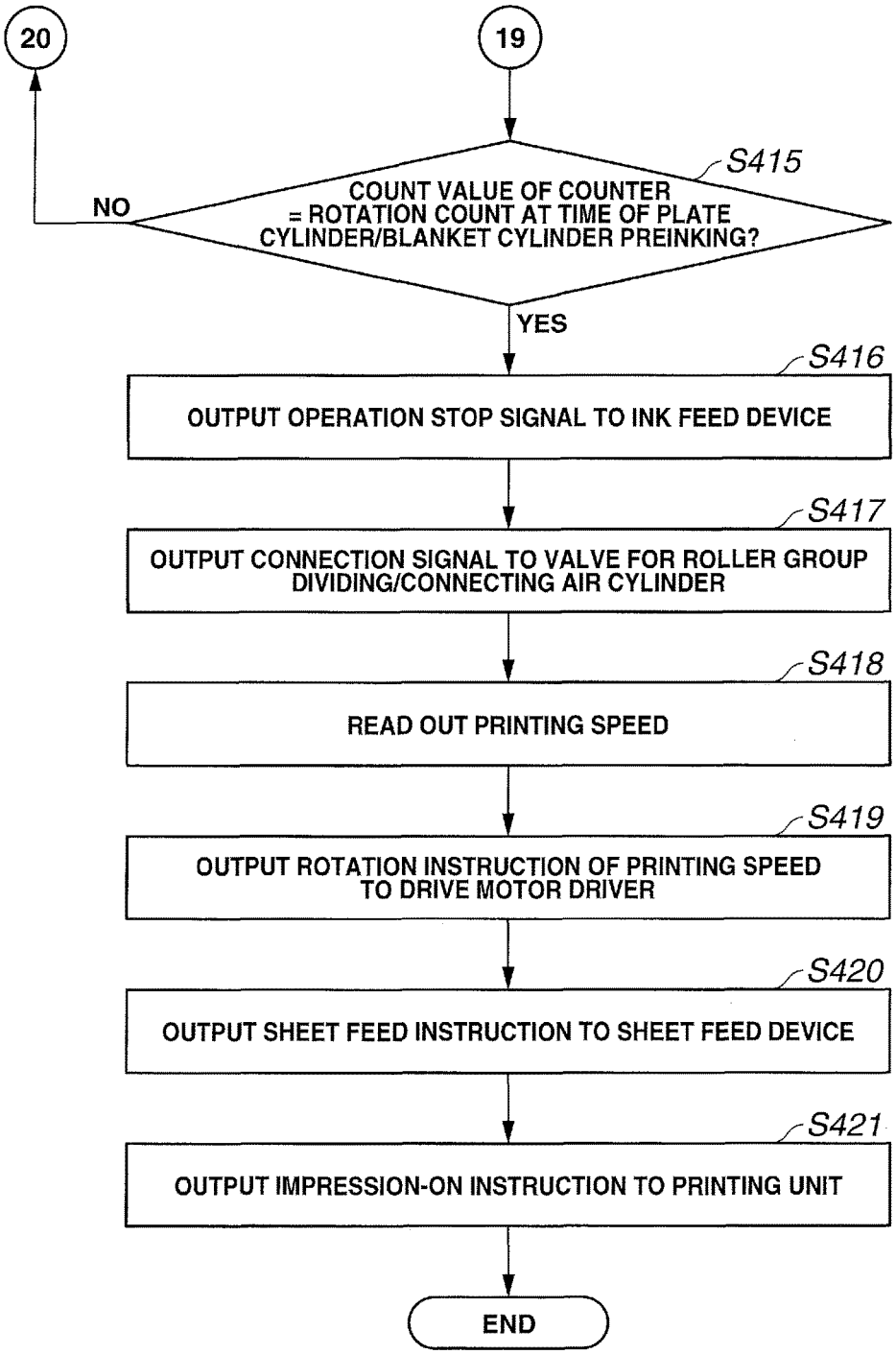

FIGS. 15A to 15S are flowcharts of a print job switching operation executed by a CPU 101 of a print job switching control device 100 according to the second embodiment. Out of processing operations executed by the CPU 101 according to the second embodiment, the processing operations in steps S301 (FIG. 15A) to S349 (FIG. 15H) and in steps S375 (FIG. 15M) to S421 (FIG. 15S) are the same as the processing operations in steps S101 (FIG. 13A) to S149 (FIG. 13H) and in steps S174 (FIG. 13M) to S220 (FIG. 13S) of the first embodiment, and a description thereof will be omitted. Only the processing operation in steps S350 (FIGS. 15I) to S374 (FIG. 15L) including processes different from the first embodiment will be described.

[Setting of Corrected Opening Amounts of Ink Fountain Keys Corresponding to Image on Printing Plate of Next Print Job (Setting of Opening Amounts of Ink Fountain Keys in Preinking)]

The CPU 101 sets the count value N in the memory M31 to 1 (FIG. 15I: step S350), reads out the count value N from the memory M31 (step S351), and reads out an image area ratio SNb in the area of the next print job corresponding to the Nth ink fountain key from the Nth address position in the memory M32 (step S352).

The CPU 101 then reads out the image area ratio—ink fountain key opening amount conversion table in the memory M43 (step S353). Using the image area ratio—ink fountain key opening amount conversion table, the CPU 101 obtains an opening amount θNb of the Nth ink fountain key for the next print job (the opening amount of the Nth ink fountain key corresponding to the image of a printing plate 7' of the next print job) from the image area ratio SNb in the area of the next print job corresponding to the Nth ink fountain key, and stores the obtained opening amount θNb of the Nth ink fountain key for the next print job at the Nth address position in the memory M44 (step S354).

Next, the CPU 101 reads out the density value DN of the patch of the print sample corresponding to the Nth ink fountain key from the Nth address position in the memory M39 (step S355), reads out the reference density value DR from the memory M46 (step S356), subtracts the density value DN of the patch of the print sample corresponding to the Nth ink fountain key from the reference density value DR to obtain the density difference ΔDN of the patch of the print sample corresponding to the Nth ink fountain key, and stores the density difference at the Nth address position in the memory M47 (FIG. 15J: step S357).

The CPU 101 then reads out an image area ratio SNa in the area of the preceding print job corresponding to the Nth ink fountain key from the Nth address position in the memory M33 (step S358), reads out the correction coefficient conversion table concerning image area ratio—density difference of the preceding print job in the memory M48 (step S359), obtains a correction coefficient αN concerning the density difference of the Nth ink fountain key from the image area ratio SNa in the area of the preceding print job corresponding to the Nth ink fountain key using the correction coefficient conversion table concerning image area ratio—density difference of the preceding print job, and stores the correction coefficient in the memory M49 (step S360).

The CPU 101 multiplies the density difference ΔDN of the patch of the print sample corresponding to the Nth ink fountain key obtained in step S357 by the correction coefficient αN concerning the density difference of the Nth ink fountain key obtained in step S360 to obtain a first correction value Δθ1N of the opening amount of the Nth ink fountain key at the time of preinking, and stores the first correction value at the Nth address position in the memory M50 (step S361).

Next, the CPU 101 then reads out the image area ratio SNa in the area of the preceding print job corresponding to the Nth ink fountain key from the Nth address position in the memory M33 (step S362), obtains an opening amount θNa of the Nth ink fountain key for the preceding print job (the opening amount of the Nth ink fountain key corresponding to the image of the printing plate 7 of the preceding print job) from the image area ratio SNa in the area of the preceding print job corresponding to the Nth ink fountain key using the image area ratio—ink fountain key opening amount conversion table read out in step S353, and stores the obtained opening amount θNa of the Nth ink fountain key for the preceding print job at the Nth address position in the memory M45 (FIG. 15K: step S363).

The CPU 101 reads out the correction coefficient γ concerning the opening amounts of the ink fountain keys for the preceding print job from the memory M51 (step S364), multiplies the opening amount θNa of the Nth ink fountain key for the preceding print job by the correction coefficient γ concerning the opening amounts of the ink fountain keys for the preceding print job to obtain a correction value KBN of the opening amount of the Nth ink fountain key concerning the opening amounts of the ink fountain keys for the preceding print job, and stores the correction value at the Nth address position in the memory M52 (step S365).

The CPU 101 reads out the reference correction value KB0 in a case in which the opening amount of an ink fountain key for the preceding print job is zero from the memory M53 (step S366), subtracts the a correction value KBN of the opening amount of the Nth ink fountain key concerning the opening amounts of the ink fountain keys for the preceding print job to obtain a second correction value Δθ2N of the opening amount of the Nth ink fountain key at the time of preinking, and stores the second correction value at the Nth address position in the memory M54 (step S367).

The CPU 101 then reads out the opening amount θNb of the Nth ink fountain key for the next print job from the Nth address position in the memory M44 (step S368), reads out the first correction value Δθ1N of the opening amount of the Nth ink fountain key at the time of preinking from the Nth address position in the memory M50 (FIG. 15L: step S369), adds the readout first correction value Δθ1N of the opening amount of the Nth ink fountain key at the time of preinking and the second correction value Δθ2N of the opening amount of the Nth ink fountain key at the time of preinking obtained in step S367 to the opening amount θNb of the Nth ink fountain key for the next print job to obtain an opening amount θNb' (θNb'=θNb+Δθ1N+Δθ2N) of the Nth ink fountain key at the time of preinking, stores the opening amount θNb' at the Nth address position in the memory M55 (step S370), and also transmits it to an Nth ink fountain key control device 300 (step S371).

The opening amount θNb of the Nth ink fountain key for the next print job corresponds to an image film thickness component JB of a job B described with reference to FIG. 10B, the first correction value Δθ1N of the opening amount of the Nth ink fountain key at the time of preinking corresponds to a correction component JX according to the density of the printed product printed by the preceding print job, and the second correction value Δθ2N of the opening amount of the Nth ink fountain key at the time of preinking corresponds to a reference film thickness compensation component JY described with reference to FIG. 10B. Hence, the opening amount θNb' (θNb'=θNb+Δθ1N+Δθ2N) of the Nth ink fountain key at the time of preinking corresponds to a film thickness component "JB+JX+JY" generated by adding the image film thickness component JB of the job B, the correction component JX according to the density of the printed product printed by the preceding print job, and the reference film thickness compensation component JY.

Then, the CPU 101 increments the count value N in the memory M31 by one (step S372), reads out the total number n of ink fountain keys from the memory M34 (step S373), and repeats the processing operation in steps S351 to S374 until the count value N exceeds the total number n of ink fountain keys (YES in step S374).

The opening amounts θ1*b* to θnb of the ink fountain keys 4-1 to 4-n corresponding to the image in the areas of the printing plate 7' corresponding to the ink fountain keys 4-1 to 4-nare thus corrected by the first correction values $\Delta\theta 1_1$ to $\Delta\theta 1_n$ and the second correction values $\Delta\theta 2_1$ to $\Delta\theta 2_n$ of the opening amounts of the ink fountain keys at the time of preinking to obtain the opening amounts θ1*b*' to θnb' of the ink fountain keys at the time of preinking. The opening amounts θ1*b*' to θnb' of the ink fountain keys at the time of preinking are stored in the memory M55 and transmitted to ink fountain key control devices 300-1 to 300-n.

[Ink Fountain Roller Control Device]

Figure 16:
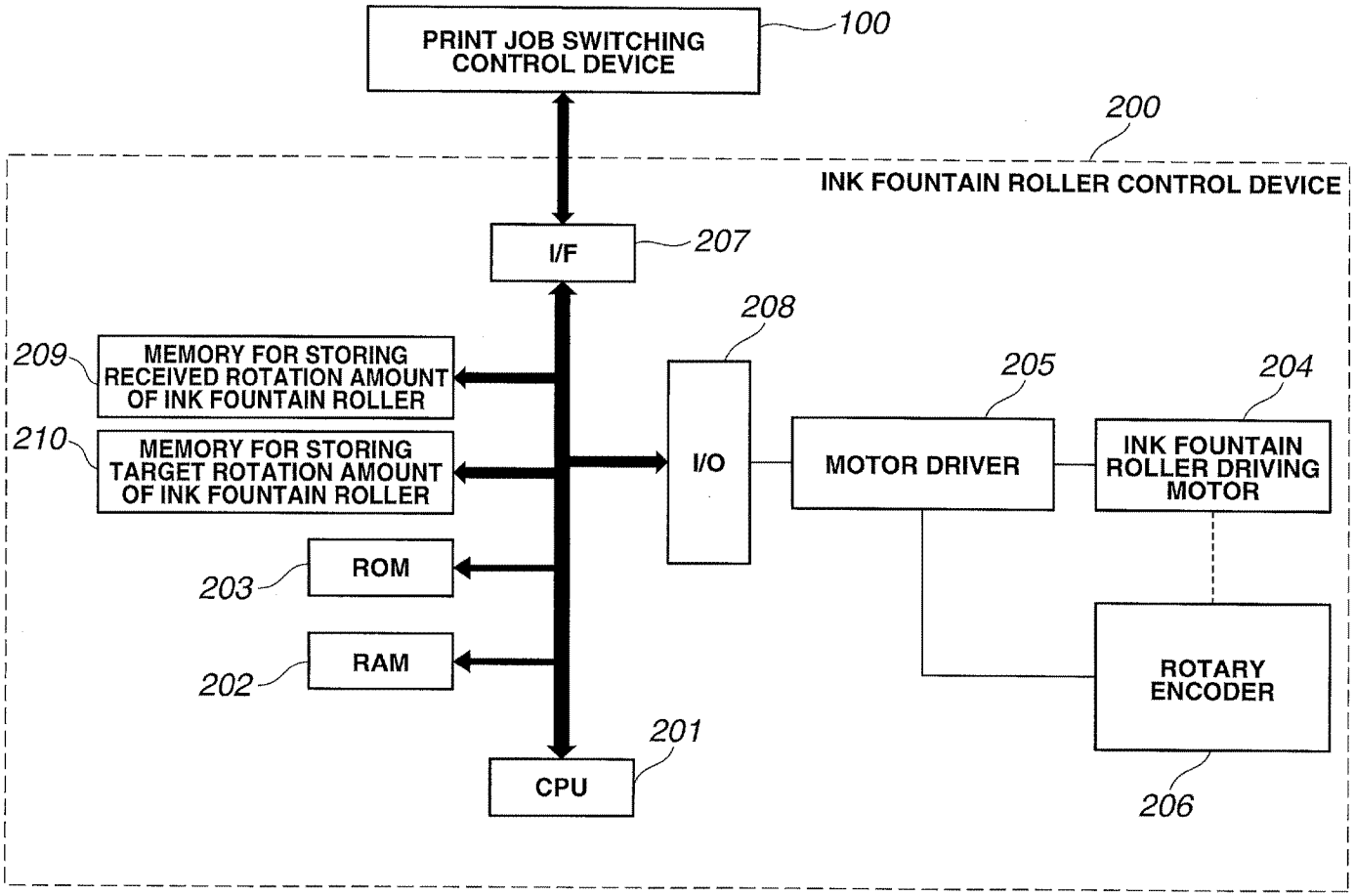
FIG. 16 is a block diagram showing the outline of the internal arrangement of an ink fountain roller control device.

FIG. 16 shows the outline of the internal arrangement of an ink fountain roller control device 200. The ink fountain roller control device 200 includes a CPU 201, a RAM 202, a ROM 203, an ink fountain roller driving motor 204, an ink fountain roller driving motor driver 205, a rotary encoder 206 for ink fountain roller driving motor, input/output interfaces (an I/O and an I/F) 207 and 208, and memories 209 and 210, and is connected to the print job switching control device 100 via the interface 207. The memory 209 stores a received rotation amount of the ink fountain roller. The memory 210 stores a target rotation amount of the ink fountain roller.

Figure 17:
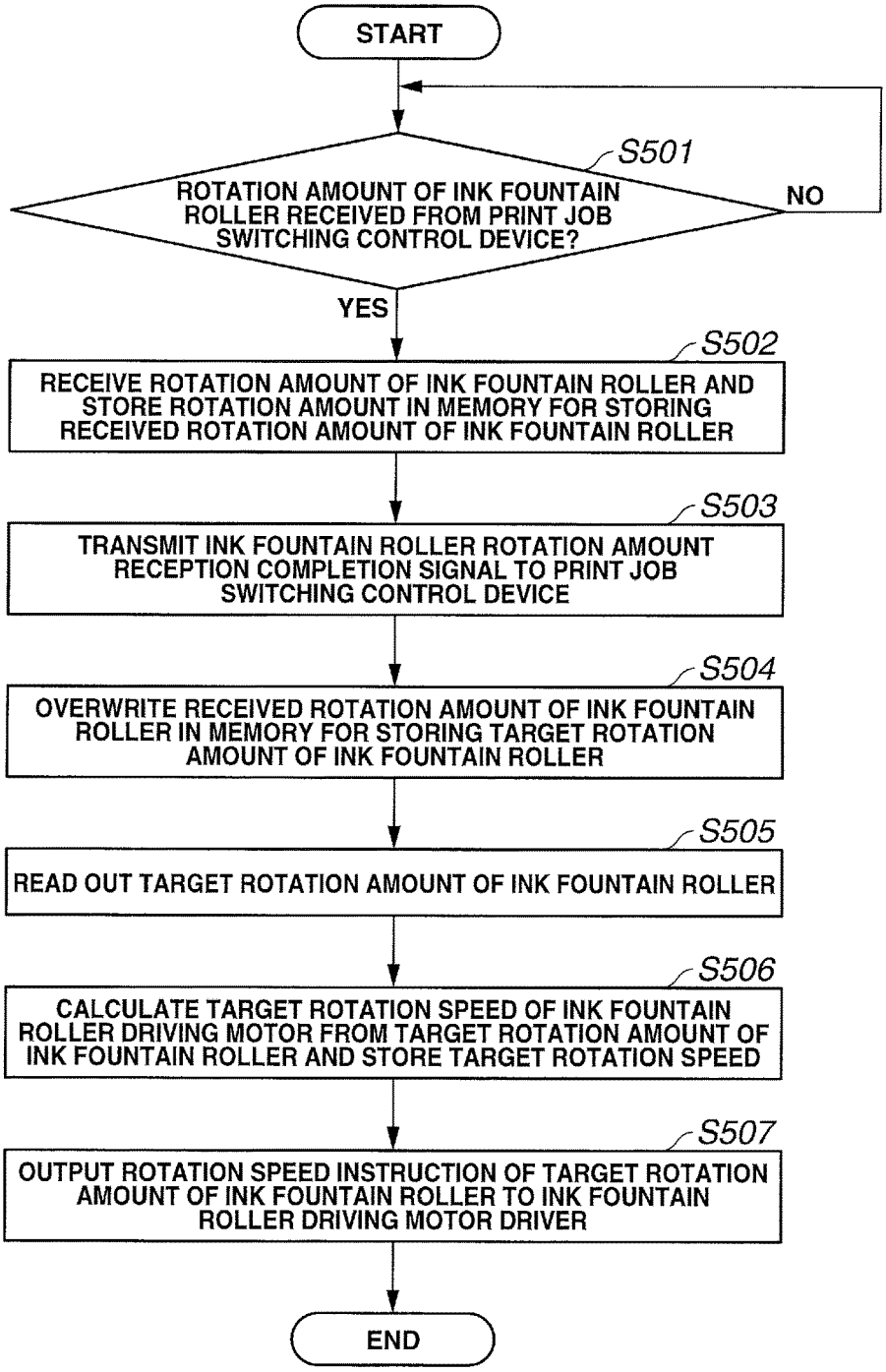
FIG. 17 is a flowchart showing the processing operation of the ink fountain roller control device.

When the rotation amount of the ink fountain roller is transmitted from the print job switching control device 100 (FIG. 17: YES in step S501), the CPU 201 stores the received rotation amount in the memory 209 (step S502). The CPU 201 also transmits an ink fountain roller rotation amount reception completion signal to the print job switching control device 100 (step S503). The CPU 201 stores the received rotation amount of the ink fountain roller in the memory 210 as the target rotation amount (target rotation amount) of the ink fountain roller (step S504). The CPU 201 reads out the target rotation amount from the memory 210 (step S505), calculates the target rotation speed of the ink fountain roller driving motor 204 from the target rotation amount (step S506), and sends the target rotation speed to the ink fountain roller driving motor driver 205 and adjusts the rotation amount of the ink fountain roller to the target rotation amount (step S507).

[Ink Fountain Key Control Device]

Figure 18:
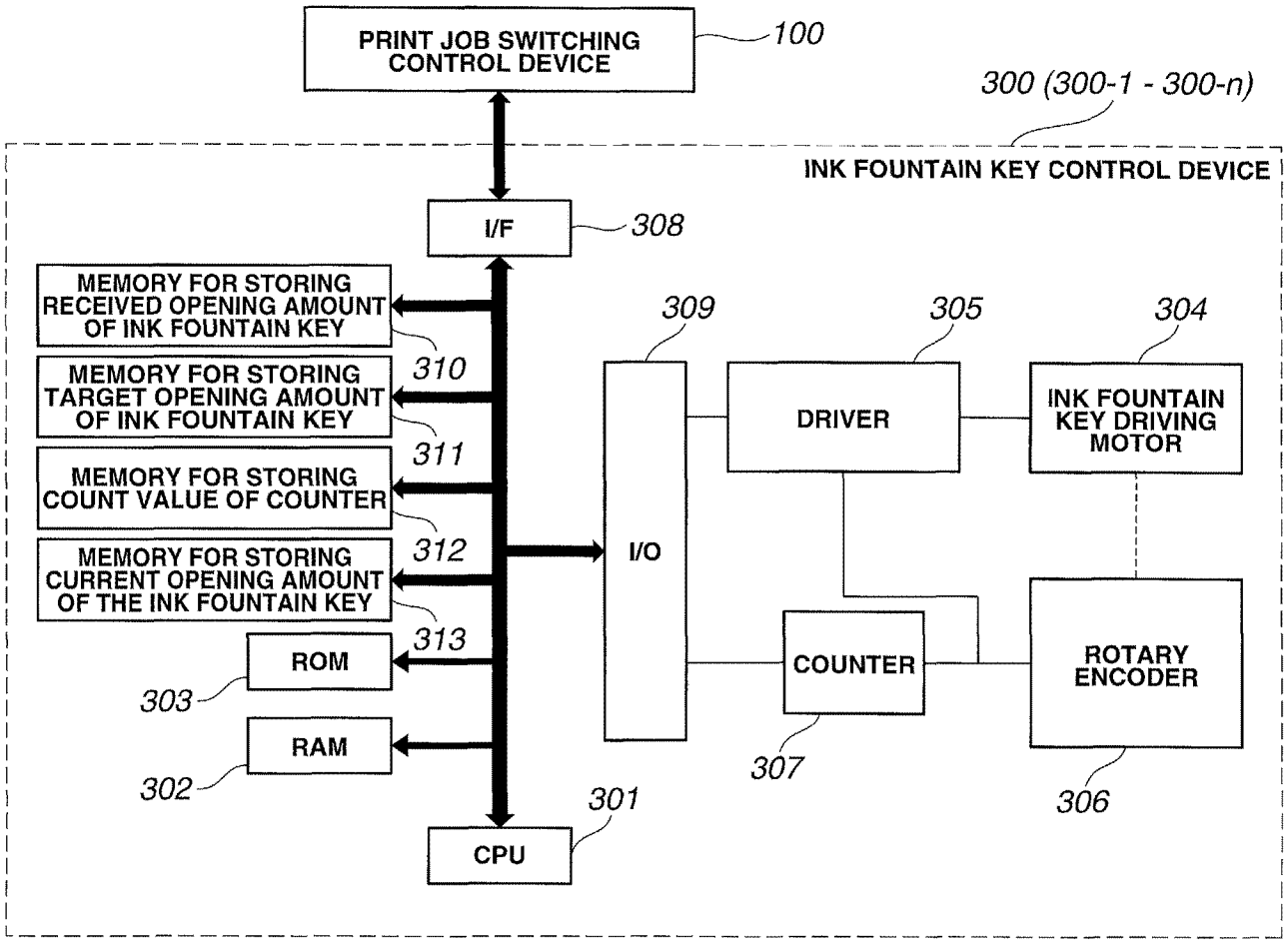
FIG. 18 is a block diagram showing the outline of the internal arrangement of an ink fountain key control device.

FIG. 18 shows the outline of the internal arrangement of the ink fountain key control device 300 (300-1 to 300-n). The ink fountain key control device 300 includes a CPU 301, a RAM 302, a ROM 303, an ink fountain key driving motor 304, an ink fountain key driving motor driver 305, a rotary encoder 306 for ink fountain key driving motor, a counter 307, input/output interfaces (an I/O and an I/F) 308 and 309, and memories 310 to 313, and is connected to the print job switching control device 100 via the interface 308. The memory 310 stores received opening amounts of ink fountain keys. The memory 311 stores target opening amounts of the ink fountain keys. The memory 312 stores the count value of the counter 307. The memory 313 stores the current opening amounts of the ink fountain keys.

Figure 19A:
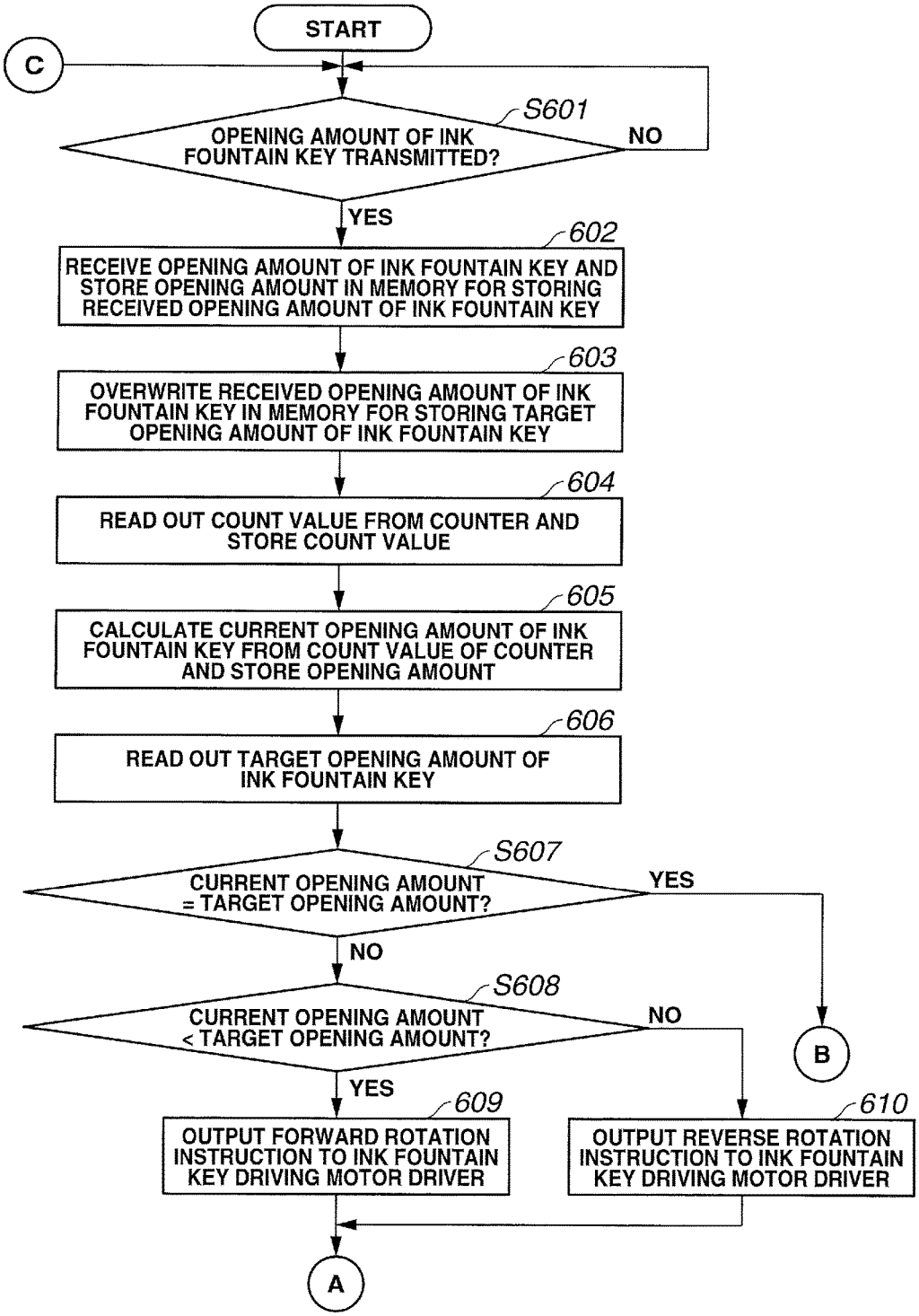
FIGS. 19A and 19B are flowcharts showing the processing operation of the ink fountain key control device.

When the opening amount of an ink fountain key is transmitted from the print job switching control device 100 (FIG. 19A: YES in step S601), the CPU 301 stores the received opening amount in the memory 310 (step S602), and stores the received opening amount of the ink fountain key in the memory 311 as the target opening amount (step S603).

Figure 19B:
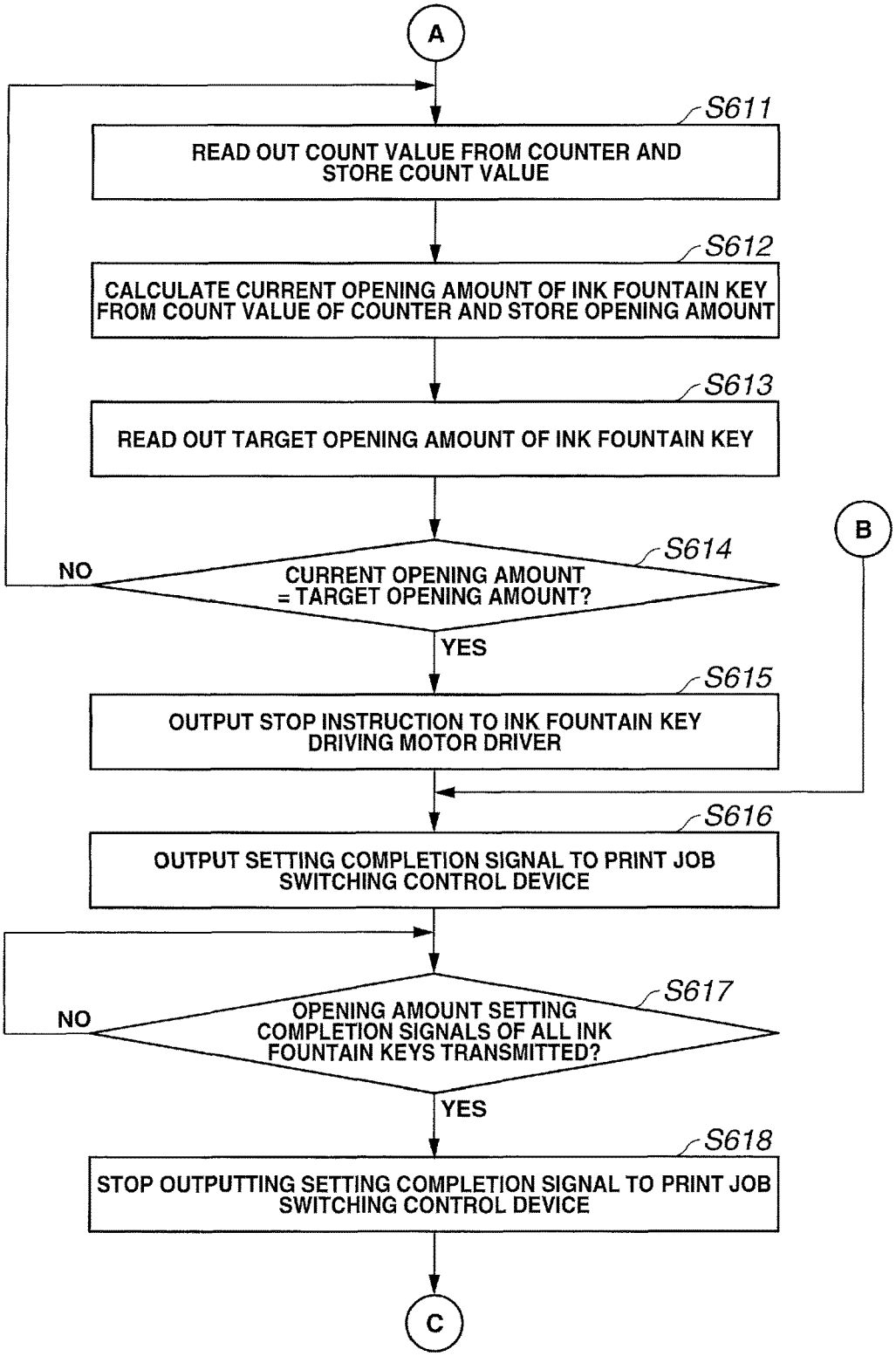

The CPU 301 reads out the count value from the counter 307 and stores it in the memory 312 (step S604), obtains the current opening amount of the ink fountain key from the read count value of the counter 307 and stores it in the memory 313 (step S605), and reads out the target opening amount of the ink fountain key from the memory 311 (step S606). If the current opening amount of the ink fountain key equals the target opening amount (YES in step S607), the process directly advances to step S616 (FIG. 19B) to output an ink fountain key opening amount setting completion signal to the print job switching control device 100.

If the current opening amount of the ink fountain key does not equal the target opening amount (NO in step S607), the ink fountain key driving motor 304 is driven until the current opening amount of the ink fountain key equals the target opening amount (steps S608 to S615 (FIG. 19B)). After that, an ink fountain key opening amount setting completion signal is output to the print job switching control device 100 (step S616).

That is, if the current opening amount of the ink fountain key is smaller than the target opening amount (YES in step S608), the CPU 301 sends a forward rotation instruction to the ink fountain key driving motor driver 305 (step S609), reads out the count value from the counter 307 (step S611), calculates the current opening amount of the ink fountain key from the read count value (step S612), and reads out the target opening amount of the ink fountain key from the memory 311 (step S613). The processing operation in steps S611 to S614 is repeated until the current opening amount of the ink fountain key matches the target opening amount of the ink fountain key (YES in step S614).

If the current opening amount of the ink fountain key is larger than the target opening amount (NO in step S608), the CPU 301 sends a reverse rotation instruction to the ink fountain key driving motor driver 305 (step S610), reads out the count value from the counter 307 (step S611), calculates the current opening amount of the ink fountain key from the read count value (step S612), and reads out the target opening amount of the ink fountain key from the memory 311 (step S613). The processing operation in steps S611 to S614 is repeated until the current opening amount of the ink fountain key matches the target opening amount of the ink fountain key (YES in step S614).

If the current opening amount of the ink fountain key matches the target opening amount of the ink fountain key in step S614 (YES in step S614), the CPU 301 outputs a stop instruction to the ink fountain key driving motor driver 305 (step S615), and outputs an ink fountain key opening amount setting completion signal to the print job switching control device 100 (step S616).

After the ink fountain key opening amount setting completion signal is output to the print job switching control device 100 (step S616), upon receiving the opening amount setting completion signals of all ink fountain keys from the print job switching control device 100 (YES in step S617), the CPU 301 stops outputting the ink fountain key opening amount setting completion signal to the print job switching control device 100 (step S618).

Figure 20:
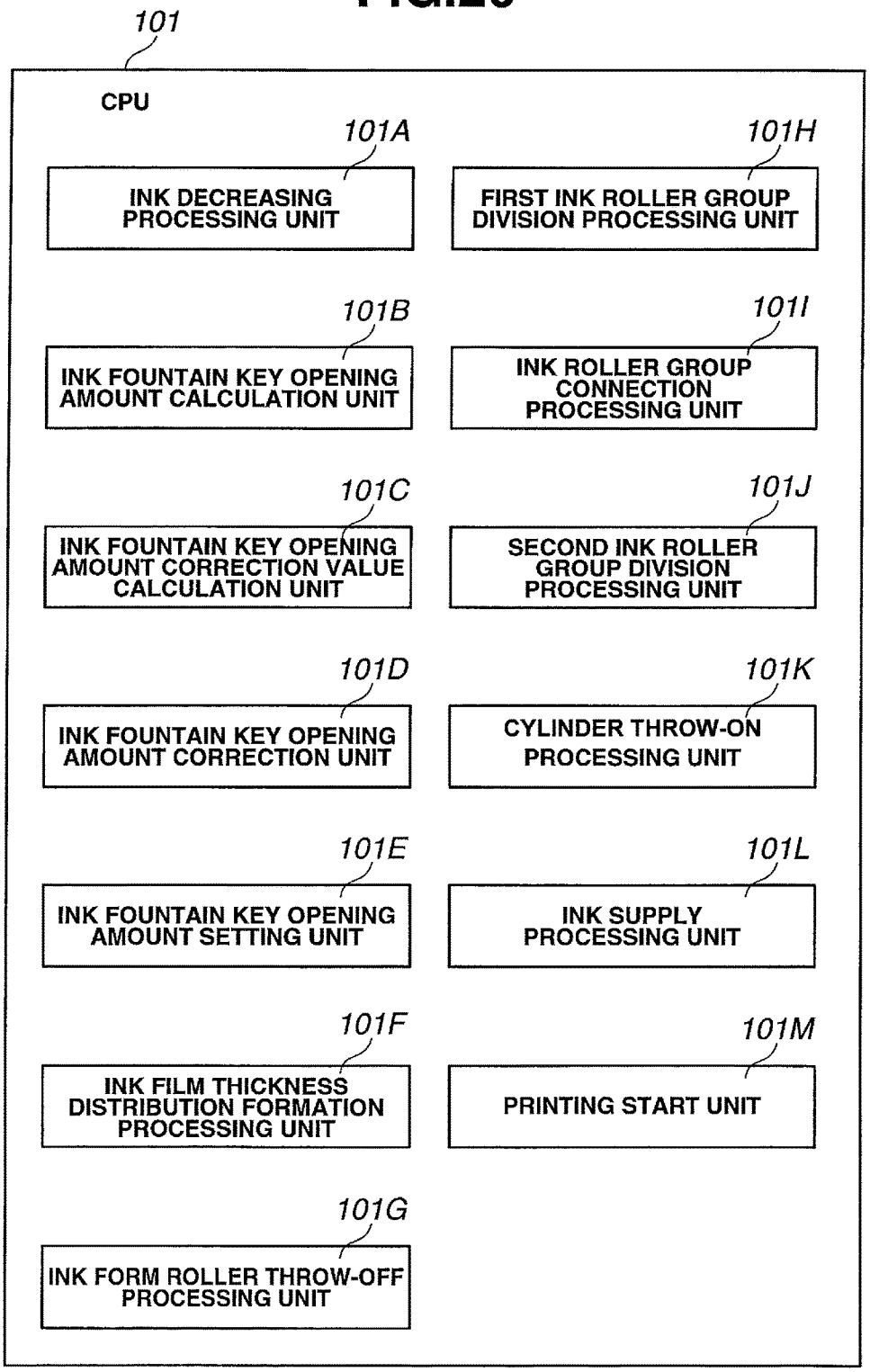
FIG. 20 is a block diagram showing the function of a main part implemented as the processing operation of a CPU in the print job switching control device.

FIG. 20 is a functional block diagram of a main part implemented as the processing operation of the CPU 101 in the print job switching control device 100 shown in FIG. 1. The CPU 101 implements the function of each unit shown in FIG. 20 as a processing operation in accordance with a program stored in a ROM 103 while accessing a RAM 102 or the memory 134.

The CPU 101 includes an ink decreasing processing unit 101A, an ink fountain key opening amount calculation unit 101B, an ink fountain key opening amount correction value calculation unit 101C, an ink fountain key opening amount correction unit 101D, an ink fountain key opening amount setting unit 101E, an ink film thickness distribution formation processing unit 101F, an ink form roller throw-off processing unit 101G, a first ink roller group division processing unit 101H, an ink roller group connection processing unit 101I, a second ink roller group division processing unit 101J, a cylinder throw-on processing unit 101K, an ink supply processing unit 101L, and a printing start unit 101M.

After the end of a print job, the ink decreasing processing unit 101A decreases the ink in the ink roller group 6 by scraping and removing it by an ink scraper blade 15 (step S4 shown in FIG. 7, steps S143 to S149).

The ink fountain key opening amount calculation unit 101B calculates the opening amounts of the ink fountain keys 4-1 to 4-n corresponding to the image of the printing plate 7' of the next print job (steps S150 to S154).

The ink fountain key opening amount correction value calculation unit 101C obtains, as the correction values of the opening amounts of the ink fountain keys 4-1 to 4-n, correction values according to index values representing ink supply amounts corresponding to images in the areas of the printing plate 7 of the preceding print job corresponding to the ink fountain keys 4-1 to 4-n (steps S162 to S166).

The ink fountain key opening amount correction unit 101D corrects the calculated opening amounts of the ink fountain keys 4-1 to 4-n corresponding to the image of the printing plate 7' of the next print job by the obtained correction values of the opening amounts of the ink fountain keys 4-1 to 4-n (steps S167 to S169).

The ink fountain key opening amount correction unit 101E sets the opening amounts of the ink fountain keys 4-1 to 4-n to the corrected opening amounts.

In a state in which the ink in the ink roller group 6 is decreased and in a state in which the opening amounts of the ink fountain keys 4-1 to 4-n have been set to the corrected opening amounts, the ink film thickness distribution formation processing unit 101F causes the ink ductor roller 5 to perform the feed operation a predetermined number of times, thereby forming the ink film thickness distribution corresponding to the image of the printing plate 7' of the next print job on the ink roller group 6 (step S6 shown in FIG. 7, steps S183 to S191).

After the end of a print job, the ink form roller throw-off processing unit 101G stops the printing press and throws off the ink form rollers 6-1 to 6-4 located at the end of the ink flow path of the ink roller group 6 (step S1 shown in FIG. 7: steps S101 to S106).

After the ink form rollers 6-1 to 6-4 are thrown off, the first ink roller group division processing unit 101H divides the ink form rollers 6-1 to 6-4 into the roller subgroup 6A on the upstream side and the roller subgroup 6B on the downstream side (step S3 shown in FIG. 7: step S140).

After the ink in the roller subgroup 6A is removed, the ink roller group connection processing unit 1011 connects the divided roller subgroups 6A and 6B to return them to one ink roller group 6 (step S5 shown in FIG. 7, step S181).

The second ink roller group division processing unit 101J divides the ink roller group 6 on which the ink film thickness distribution corresponding to the image of the printing plate of the next print job is formed into the roller subgroups 6A and 6B (step S7 shown in FIG. 7, step S206).

After the ink roller group 6 is divided, the cylinder throw-on processing unit 101K sets the roller subgroup 6B on the downstream side out of the roller subgroups 6A and 6B and the plate cylinder 8 on which the printing plate 7' to be used in the next print job is mounted in a throw-on state, and also sets the plate cylinder 8 and the blanket cylinder 9 used to transfer the ink supplied to the printing plate 7' mounted on the plate cylinder 8 to a target printing material in a throw-on state (step S8 shown in FIG. 7, steps S207 to S209).

Note that in the ink film thickness distribution formation process shown in FIG. 12, the cylinder throw-on processing unit 101K sets the roller subgroup 6B and the plate cylinder 8 on which the printing plate 7' to be used in the next print job is mounted in the throw-on state, and also sets the plate cylinder 8 and the blanket cylinder 9 used to transfer the ink supplied to the printing plate 7' mounted on the plate cylinder 8 to a target printing material in the throw-on state before the ink roller group 6 is divided (step S7 shown in FIG. 12).

In a state in which the ink roller group 6 is divided and in a state in which the roller subgroup 6B and the plate cylinder 8 are in the throw-on state, and the plate cylinder 8 and the blanket cylinder 9 are in the throw-on state, the ink supply processing unit 101L rotates the plate cylinder 8, the roller subgroup 6B, and the blanket cylinder 9 a predetermined number of times to supply the ink in the roller subgroup 6B to the blanket cylinder 9 and the printing plate 7' mounted on the plate cylinder 8 (step S9 shown in FIG. 7, steps S210 to S214).

After the ink is supplied to the blanket cylinder 9 and the printing plate 7' mounted on the plate cylinder 8, the printing start unit 101M connects the divided roller subgroups 6A and 6B to return them to one ink roller group 6 (step S10 shown in FIG. 7, step S216), and starts printing of the next print job using the printing plate 7' mounted on the plate cylinder 8 (step S11 shown in FIG. 7, steps S216 to S220).

Note that in the above-described first and second embodiments, the ink roller group 6 is divided/connected using the swing arm 14. However, the mechanism used to divide/connect the ink roller group 6 is not limited to the mechanism using the swing arm, as a matter of course.

Figure 21:
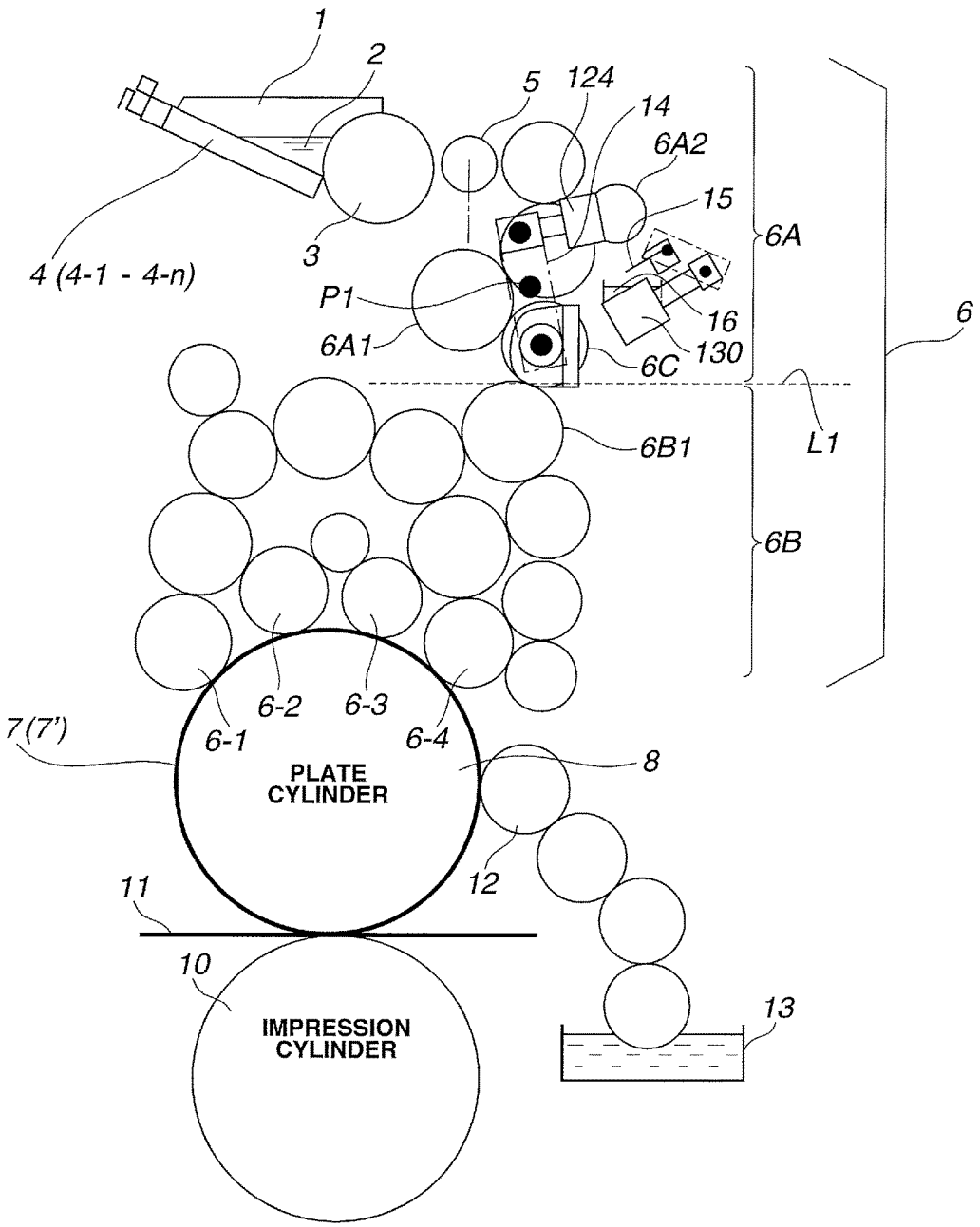
FIG. 21 is a view showing an example in which ink supplied to a printing plate mounted on a plate cylinder is directly transferred to printing paper without intervention of a blanket cylinder.
Figure 22:
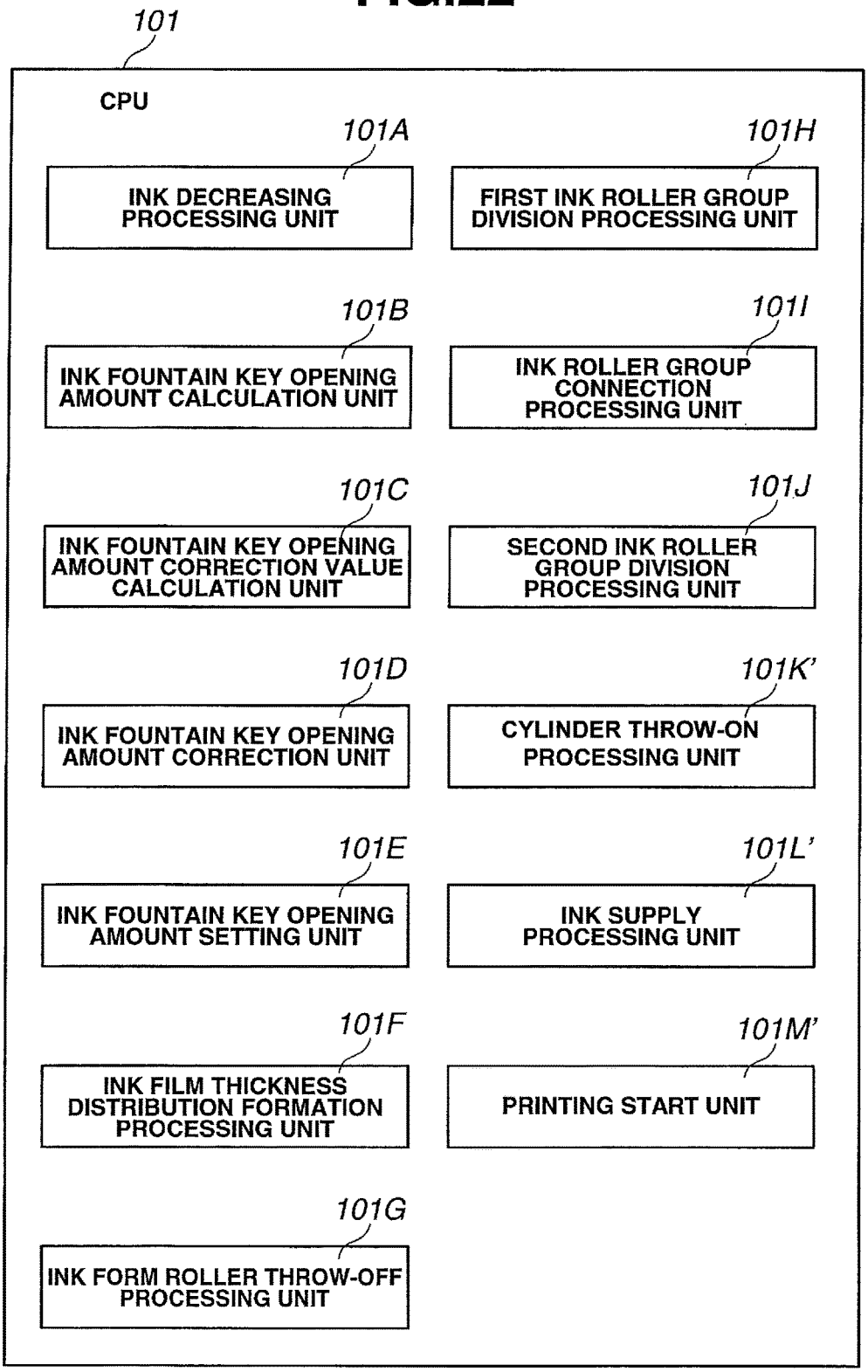
FIG. 22 is a block diagram showing the function of the main part implemented as the processing operation of the CPU in the print job switching control device in a case in which the ink supplied to the printing plate mounted on the plate cylinder is directly transferred to the printing paper without intervention of the blanket cylinder.

In the above-described first and second embodiments, an example in which the ink supplied to the printing plate 7 (7') mounted on the plate cylinder 8 is transferred to the printing paper 11 via the blanket cylinder 9 has been described. Even in an example in which the ink supplied to the printing plate 7 (7') mounted on the plate cylinder 8 is directly transferred to the printing paper 11 without intervention of the blanket cylinder 9 (see FIG. 21), the present invention can similarly be applied, and the same effect as described above can be obtained. FIG. 22 is a functional block diagram corresponding to FIG. 20 in this case.

In the functional block diagram of FIG. 22, a cylinder throw-on processing unit 101K' sets the roller subgroup 6B on the downstream side out of the roller subgroups 6A and 6B and the plate cylinder 8 on which the printing plate 7' to be used in the next print job is mounted in a throw-on state after or before the ink roller group 6 is divided. In a state in which the ink roller group 6 is divided and in a state in which the roller subgroup 6B and the plate cylinder 8 are in the throw-on state, an ink supply processing unit 101L' rotates the plate cylinder 8 and the roller subgroup 6B a predetermined number of times to supply the ink in the roller subgroup 6B to the printing plate 7' mounted on the plate cylinder 8. After the ink is supplied to the printing plate 7' mounted on the plate cylinder 8, a printing start unit 101M' connects the divided roller subgroups 6A and 6B to return them to one ink roller group 6, and starts printing of the next print job using the printing plate 7' mounted on the plate cylinder 8.

In the above-described first and second embodiments, when forming the ink film thickness distribution corresponding to the image of the printing plate of the next print job on the ink roller group 6, the ink roller group 6 is divided into the roller subgroup 6A on the upstream side and the roller subgroup 6B on the downstream side. However, the ink roller group 6 need not always be divided. That is, the present invention may be applied to an ink supply device without a mechanism to do division/connection.

In the above-described first and second embodiments, the operation of one representative ink supply device has been described. However, the same operation as described above is performed in the ink supply devices of the respective colors, as a matter of course. That is, the flowcharts of the above-described first and second embodiments show only processing operations such as density value measurement for one color. In actuality, the same processing operations are performed for all colors. In the ink supply devices of the respective colors, an ink film thickness distribution corresponding to the image of the printing plate of the next print job is formed in a similar manner.

In the above-described first and second embodiments, the opening amounts θ1*b* to θnb of the ink fountain keys 4-1 to 4-n for the next print job are corrected by the first correction values $\Delta\theta\mathbf{1}_1$ to $\Delta\theta\mathbf{1}_n$ and the second correction values $\Delta\theta\mathbf{2}_1$ to $\Delta\theta\mathbf{2}_n$ to obtain the opening amounts θ1*b*' to θnb' of the ink fountain keys at the time of preinking. However, the opening amounts may be corrected by only the second correction values $\Delta\theta\mathbf{2}_1$ to $\Delta\theta\mathbf{2}_n$.

[Extension of Embodiment]

The present invention has been described above with reference to the embodiments. However, the present invention is not limited to the above embodiments. Various changes and modifications understandable by those who are skilled in the art can be done for the arrangements and details of the present invention without departing the scope of the present invention.

INDUSTRIAL APPLICABILITY

The present invention can be used for various kinds of printing presses such as a web offset printing press as an ink supply method and an ink supply device for supplying, via an ink roller group, ink supplied to an ink fountain roller to a printing plate mounted on a plate cylinder by the feed operation of an ink ductor roller.

EXPLANATION OF THE REFERENCE NUMERALS AND SIGNS

1 . . . ink fountain, 2 . . . ink, 3 . . . ink fountain roller, 4 (4-1 to 4-n) . . . ink fountain key, 5 . . . ink ductor roller, 6 . . . ink roller group, 7, 7'. . . printing plate, 8 . . . plate cylinder, 9 . . . blanket cylinder, 10 . . . impression cylinder, 11 . . . printing paper (target printing material), 15 . . . ink scraper blade, 101 . . . CPU, 102 . . . RAM, 103 . . . ROM,

100 . . . print job switching control device, 200 . . . ink fountain roller control device, 300 (300-1 to 300-n) . . . ink fountain key control device

The invention claimed is:

1. An ink supply method comprising the steps of decreasing ink in an ink roller group by scraping and removing the ink by an ink scraping member after an end of a print job including adjusting an amount of ink supplied from an ink fountain to an ink fountain roller by adjusting an opening amount of an ink fountain key and supplying the ink supplied to the ink fountain roller to a printing plate via the ink roller group by a feed operation of an ink ductor roller;

calculating the opening amount of the ink fountain key corresponding to an image of a printing plate of a next print job;

obtaining, as a correction value of the opening amount of the ink fountain key, a correction value according to an index value representing an ink supply amount corresponding to an image in an area of a printing plate of a preceding print job corresponding to the ink fountain key;

correcting the calculated opening amount of the ink fountain key corresponding to the image of the printing plate of the next print job with the obtained correction value of the opening amount of the ink fountain key;

setting the opening amount of the ink fountain key to the corrected opening amount; and forming, on the ink roller group, an ink film thickness distribution corresponding to the image of the printing plate of the next print job by performing the feed operation of the ink ductor roller a predetermined number of times in a state in which the ink in the ink roller group has been decreased and in a state in which the opening amount of the ink fountain key has been set to the corrected opening amount.

2. The ink supply method according to claim 1, wherein the step of obtaining the correction value includes the step of obtaining a correction value according to a density in an area of a printed product printed by the preceding print job corresponding to the ink fountain key as a first correction value of the opening amount of the ink fountain key, and obtaining a correction value according to the index value representing the ink supply amount corresponding to the image in the area of the printing plate of the preceding print job corresponding to the ink fountain key as a second correction value of the opening amount of the ink fountain key, and the step of correcting with the correction value includes the step of correcting the calculated opening amount of the ink fountain key corresponding to the image of the printing plate of the next print job with the first correction value and the second correction value of the opening amount of the ink fountain key which have been obtained.

3. The ink supply method according to claim 2, wherein the step of obtaining the correction value includes the step of obtaining, as the first correction value of the opening amount of the ink fountain key, a correction value according to a differences between a reference density and the density in the area of the printed product printed by the preceding print job corresponding to the ink fountain key and an image area ratio in an area of the printing plate of the preceding print job corresponding to the ink fountain key.

4. The ink supply method according to claim 1, further comprising the steps of:

after the end of the print job, stopping a printing press and throwing off an ink form roller located at the end of an ink flow path of the ink roller group; and after the ink form roller is thrown off, dividing the ink roller group into a plurality of roller subgroups, wherein the step of decreasing the ink includes the step of decreasing ink in one or some roller subgroups out of the plurality of divided roller subgroups by scraping and removing the ink with the ink scraping member.

5. The ink supply method according to claim 4, further comprising the step of, after the ink in the one or some roller subgroups is decreased, connecting the plurality of separated roller subgroups to restore the roller subgroups into one ink roller group, wherein the step of forming the ink film thickness distribution includes the step of forming, on the ink roller group restored to the one ink roller group, the ink film thickness distribution corresponding to the image of the printing plate of the next print job by performing the feed operation of the ink ductor roller the predetermined number of times in a state in which the ink roller group has been restored to the one ink roller group and in the state in which the opening amount of the ink fountain key has been set to the corrected opening amount.

6. The ink supply method according to claim 1, further comprising the steps of:

dividing the ink roller group on which the ink film thickness distribution corresponding to the image of the printing plate of the next print job is formed into a plurality of roller subgroups;

after or before the ink roller group is divided, setting at least a roller subgroup on a most downstream side out of the plurality of roller subgroups and the plate cylinder on which the printing plate to be used in the next print job is mounted in a throw-on state; and in a state in which the ink roller group has been divided and in a state in which at least the roller subgroup on the most downstream side out of the plurality of roller subgroups and the plate cylinder have been set in the throw-on state, rotating the plate cylinder and the roller subgroup in the throw-on state a predetermined number of times to supply the ink in the roller subgroup to the printing plate mounted on the plate cylinder.

7. The ink supply method according to claim 6, further comprising the step of, after the ink is supplied to the printing plate mounted on the plate cylinder, connecting the plurality of separated roller subgroups to restore the one ink roller group and starting printing of the next print job using the printing plate mounted on the plate cylinder, wherein the step of forming the ink film thickness distribution includes the step of setting the opening amount of the ink fountain key to an opening amount corresponding to the image of the printing plate of the next print job after forming the ink film thickness distribution corresponding to the image of the printing plate of the next print job on the ink roller group.

8. The ink supply method according to claim 1, wherein the step of obtaining the correction value includes the step of setting one of an image area ratio in the area of the printing plate of the preceding print job corresponding to the ink fountain key and the opening amount of the ink fountain key corresponding to the image in the area of the printing plate of the preceding print job corresponding to the ink fountain key as the index value representing the ink supply amount corresponding to the image in the area of the printing plate of the preceding print job corresponding to the ink fountain key, and obtaining, as the correction value of the opening amount of the ink fountain key, a correction value according to the one of the image area ratio in the area of the printing plate of the preceding print job corresponding to the ink fountain key and the opening amount of the ink fountain key corresponding to the image in the area of the printing plate of the preceding print job corresponding to the ink fountain key.

9. An ink supply device comprising:

an ink fountain key configured to adjust an amount of ink supplied from an ink fountain to an ink fountain roller;

an ink ductor roller configured to feed the ink supplied to the ink fountain roller;

an ink roller group configured to supply the ink fed by the ink ductor roller to a printing plate;

an ink decreasing processing unit configured to decrease the ink in the ink roller group by scraping and removing the ink by an ink scraping member after an end of a print job;

an ink fountain key opening amount calculation unit configured to calculate an opening amount of the ink fountain key corresponding to an image of a printing plate of a next print job;

an ink fountain key opening amount correction value calculation unit configured to obtain, as a correction value of the opening amount of the ink fountain key, a correction value according to an index value representing an ink supply amount corresponding to an image in an area of a printing plate of a preceding print job corresponding to the ink fountain key;

an ink fountain key opening amount correction unit configured to correct the calculated opening amount of the ink fountain key corresponding to the image of the printing plate of the next print job with the obtained correction value of the opening amount of the ink fountain key;

an ink fountain key opening amount setting unit configured to set the opening amount of the ink fountain key to the corrected opening amount; and an ink film thickness distribution formation processing unit configured to form, on the ink roller group, an ink film thickness distribution corresponding to the image of the printing plate of the next print job by performing the feed operation of the ink ductor roller a predetermined number of times in a state in which the ink in the ink roller group has been decreased and in a state in which the opening amount of the ink fountain key has been set to the corrected opening amount.

10. The ink supply device according to claim 9, wherein the ink fountain key opening amount correction value calculation unit obtains a correction value according to a differences between a reference density and a density in an area of a printed product printed by the preceding print job corresponding to the ink fountain key and an image area ratio in an area of the printing plate of the preceding print job corresponding to the ink fountain key as a first correction value of the opening amount of the ink fountain key, and obtains a correction value according to the index value representing the ink supply amount corresponding to the image in the area of the printing plate of the preceding print job corresponding to the ink fountain key as a second correction value of the opening amount of the ink fountain key, and the ink fountain key opening amount correction unit corrects the calculated opening amount of the ink fountain key corresponding to the image of the printing plate of the next print job with the first correction value and the second correction value of the opening amount of the ink fountain key which have been obtained.

11. The ink supply device according to claim 9, further comprising an ink form roller throw-off processing unit configured to, after the end of the print job, stop a printing press and throw off an ink form roller located at an end of an ink flow path of the ink roller group; and a first ink roller group division processing unit configured, after the ink form roller is thrown off, divide the ink roller group into a plurality of roller subgroups, wherein the ink decreasing processing unit decreases ink in one or some roller subgroups out of the plurality of divided roller subgroups by scraping and removing the ink by the ink scraping member.

12. The ink supply device according to claim 11, further comprising an ink roller group connection processing unit configured to, after the ink in the one or some roller subgroups is decreased, connect the plurality of separated roller subgroups to restore the one ink roller group, wherein the ink film thickness distribution formation processing unit forms, on the ink roller group restored to the one ink roller group, the ink film thickness distribution corresponding to the image of the printing plate of the next print job by performing the feed operation of the ink ductor roller the predetermined number of times in a state in which the ink roller group has been restored to the one ink roller group and in the state in which the opening amount of the ink fountain key has been set to the corrected opening amount.

13. The ink supply device according to claim 9, further comprising:

a second ink roller group division processing unit configured to divide the ink roller group on which the ink film thickness distribution corresponding to the image of the printing plate of the next print job is formed into a plurality of roller subgroups;

a cylinder throw-on processing unit configured to, after or before the ink roller group is divided, set at least a roller subgroup on a most downstream side out of the plurality of roller subgroups and a plate cylinder on which the printing plate to be used in the next print job is mounted in a throw-on state; and an ink supply processing unit configured to, in a state in which the ink roller group has been divided and in a state in which at least the roller subgroup on the most downstream side out of the plurality of roller subgroups and the plate cylinder have been set in the throw-on state, rotate the plate cylinder and the roller subgroup in the throw-on state a predetermined number of times to supply the ink in the roller subgroup to the printing plate mounted on the plate cylinder.

14. The ink supply device according to claim 13, further comprising a printing start unit configured to, after the ink is supplied to the printing plate mounted on the plate cylinder, connect the plurality of divided roller subgroups to restore the one ink roller group and start printing of the next print job using the printing plate mounted on the plate cylinder, wherein the ink film thickness distribution formation processing unit sets the opening amount of the ink fountain key to an opening amount corresponding to the image of the printing plate of the next print job after forming the ink film thickness distribution corresponding to the image of the printing plate of the next print job on the ink roller group.

15. The ink supply device according to claim 9, wherein the ink fountain key opening amount correction value calculation unit sets one of an image area ratio in the area of the printing plate of the preceding print job corresponding to the ink fountain key and the opening amount of the ink fountain key corresponding to the image in the area of the printing plate of the preceding print job corresponding to the ink fountain key as the index value representing the ink supply amount corresponding to the image in the area of the printing plate of the preceding print job corresponding to the ink fountain key, and obtains, as the correction value of the opening amount of the ink fountain key, a correction value according to the one of the image area ratio in the area of the printing plate of the preceding print job corresponding to the ink fountain key and the opening amount of the ink fountain key corresponding to the image in the area of the printing plate of the preceding print job corresponding to the ink fountain key.

* * * * *